US010900312B2

(12) United States Patent
Funkhouser et al.

(10) Patent No.: US 10,900,312 B2
(45) Date of Patent: Jan. 26, 2021

(54) PLUGGING DEVICES AND DEPLOYMENT IN SUBTERRANEAN WELLS

(71) Applicant: THRU TUBING SOLUTIONS, INC., Oklahoma City, OK (US)

(72) Inventors: Gary P. Funkhouser, Roman Forest, TX (US); Brock W. Watson, Sadler, TX (US); Andrew M. Ferguson, Moore, OK (US); Jenna N. Robertson, Norman, OK (US); Roger L. Schultz, Newcastle, OK (US)

(73) Assignee: THRU TUBING SOLUTIONS, INC., Oklahoma City, OK (US)

( * ) Notice: Subject to any disclaimer, the term of this patent is extended or adjusted under 35 U.S.C. 154(b) by 71 days.

(21) Appl. No.: 16/264,758

(22) Filed: Feb. 1, 2019

(65) Prior Publication Data

US 2019/0162034 A1 May 30, 2019

Related U.S. Application Data

(60) Division of application No. 15/726,160, filed on Oct. 5, 2017, now Pat. No. 10,513,902, which is a (Continued)

(51) Int. Cl.
*E21B 43/263* (2006.01)
*E21B 29/02* (2006.01)
(Continued)

(52) U.S. Cl.
CPC ..... *E21B 29/02* (2013.01); *E21B 17/20* (2013.01); *E21B 33/138* (2013.01); *E21B 43/114* (2013.01); *E21B 43/26* (2013.01)

(58) Field of Classification Search
CPC ..... E21B 7/007; E21B 43/26; E21B 43/11; E21B 43/162; E21B 43/263
See application file for complete search history.

(56) References Cited

U.S. PATENT DOCUMENTS 2,157,493 A 5/1939 Miller et al.
2,621,351 A 12/1952 Piety
(Continued)

FOREIGN PATENT DOCUMENTS

WO 1991011587 A1 8/1991
WO 2007066254 A2 7/2007
(Continued)

OTHER PUBLICATIONS

Examination Report dated Dec. 24, 2018 for GCC Patent Application No. 2016-31224, 4 pages.
(Continued)

*Primary Examiner* — Kenneth L Thompson
(74) *Attorney, Agent, or Firm* — Smith IP Services, P.C.

(57) ABSTRACT

A method can include deploying a plugging device into a well, the plugging device including a body, and an outer material enveloping the body and having a greater flexibility than a material of the body, and conveying the plugging device by fluid flow into engagement with the opening, the body preventing the plugging device from extruding through the opening, and the outer material blocking the fluid flow between the body and the opening. In another method, the plugging device can include at least two bodies, and a washer element connected between the bodies, the washer element being generally disk-shaped and comprising a hole, a line extending through the hole and connected to the bodies on respective opposite sides of the washer element, the washer element preventing the plugging device from being conveyed through the opening, and the washer element blocking the fluid flow through the opening.

5 Claims, 54 Drawing Sheets

Related U.S. Application Data continuation of application No. 15/296,342, filed on Oct. 18, 2016, now Pat. No. 9,816,341, which is a continuation-in-part of application No. 15/138,968, filed on Apr. 26, 2016, now Pat. No. 9,745,820, which is a continuation-in-part of application No. 14/698,578, filed on Apr. 28, 2015, now Pat. No. 10,641,069, and a continuation-in-part of application No. PCT/US2015/038248, filed on Jun. 29, 2015.

(60) Provisional application No. 62/348,637, filed on Jun. 10, 2016, provisional application No. 62/195,078, filed on Jul. 21, 2015, provisional application No. 62/243,444, filed on Oct. 19, 2015.

(51) Int. Cl.

| | |
|---|---|
| ***E21B 43/26*** | (2006.01) |
| ***E21B 17/20*** | (2006.01) |
| ***E21B 43/114*** | (2006.01) |
| ***E21B 33/138*** | (2006.01) |

(56) References Cited

U.S. PATENT DOCUMENTS 2,754,910 A 7/1956 Derrick et al.
2,768,693 A 10/1956 Hughes, Jr.
2,788,072 A 4/1957 Goodwin
2,838,117 A 6/1958 Clark, Jr. et al.
2,970,645 A 2/1961 Glass
3,011,548 A 12/1961 Holt
3,028,914 A 4/1962 Flickinger
3,086,587 A 4/1963 Zandmer et al.
3,170,517 A 2/1965 Graham et al.
3,174,546 A 3/1965 Flickinger
3,292,700 A 12/1966 Berry
3,376,934 A 4/1968 Willman et al.
3,399,726 A 9/1968 Harris et al.
3,417,821 A 12/1968 Tinsley et al.
3,437,147 A 4/1969 Davies
3,595,314 A 7/1971 Garner
3,707,194 A 12/1972 Svaldi
3,814,187 A 6/1974 Holman
3,895,678 A 7/1975 Wright et al.
4,187,909 A 2/1980 Erbstoesser
4,194,561 A 3/1980 Stokley et al.
4,244,425 A 1/1981 Erbstoesser
4,716,964 A 1/1988 Erbstoesser
4,921,577 A 5/1990 Eubank
5,052,220 A 10/1991 Piers
5,052,489 A 10/1991 Carisella et al.
5,507,345 A 4/1996 Wehunt, Jr. et al.
5,551,344 A * 9/1996 Couet ..... E21B 43/025 102/312
5,890,536 A * 4/1999 Nierode ..... E21B 43/006 166/284
5,908,073 A 6/1999 Nguyen et al.
6,070,666 A 6/2000 Montgomery
6,394,184 B2 5/2002 Tolman et al.
6,427,776 B1 8/2002 Hoffman et al.
6,543,538 B2 4/2003 Tolman et al.
6,655,475 B1 12/2003 Wald
6,973,966 B2 12/2005 Szarka
7,225,869 B2 6/2007 Willet et al.
7,273,099 B2 9/2007 East, Jr. et al.
7,337,844 B2 * 3/2008 Surjaatmadja ..... E21B 43/26 166/308.1
7,559,363 B2 7/2009 Howell et al.
7,571,766 B2 * 8/2009 Pauls ..... C09K 8/68 166/280.1
7,624,810 B2 12/2009 Fould et al.
7,673,673 B2 3/2010 Surjaatmadja et al.
7,673,688 B1 3/2010 Jones et al.
7,748,452 B2 7/2010 Sullivan et al.
7,810,567 B2 10/2010 Daniels et al.
7,810,569 B2 * 10/2010 Hill ..... E21B 23/065 166/177.5
7,874,365 B2 1/2011 East, Jr. et al.
7,891,424 B2 2/2011 Creel et al.
8,088,717 B2 1/2012 Polizzotti et al.
8,240,392 B2 8/2012 Barnard et al.
8,281,860 B2 10/2012 Boney et al.
8,307,916 B1 11/2012 Wald
8,596,362 B2 12/2013 Nelson
8,646,529 B2 2/2014 Clark et al.
8,776,886 B2 7/2014 Rondeau
8,851,172 B1 10/2014 Dudzinski
8,853,137 B2 10/2014 Todd et al.
8,887,803 B2 11/2014 East, Jr. et al.
8,950,438 B2 2/2015 Ryan
9,187,975 B2 11/2015 Rochen
9,284,798 B2 3/2016 Jamison et al.
9,523,267 B2 12/2016 Schultz et al.
9,551,204 B2 1/2017 Schultz et al.
9,567,824 B2 2/2017 Watson et al.
9,567,825 B2 2/2017 Schultz et al.
9,567,826 B2 2/2017 Schultz et al.
9,708,883 B2 7/2017 Schultz et al.
9,745,820 B2 8/2017 Watson et al.
9,784,085 B2 * 10/2017 Liu ..... E21B 49/006
9,816,341 B2 11/2017 Funkhouser et al.
9,920,589 B2 3/2018 Watson et al.
10,221,667 B2 * 3/2019 Montaron ..... E21B 43/26
10,233,719 B2 3/2019 Schultz et al.
10,480,302 B2 * 11/2019 Irani ..... E21B 7/007
10,513,653 B2 12/2019 Schultz et al.
10,513,902 B2 * 12/2019 Funkhouser ..... E21B 29/02
10,641,057 B2 5/2020 Schultz et al.
10,641,069 B2 * 5/2020 Schultz ..... E21B 43/26
10,641,070 B2 5/2020 Schultz et al.
10,655,427 B2 5/2020 Schultz et al.
10,738,564 B2 8/2020 Watson et al.
2004/0129460 A1 7/2004 MacQuoid et al.
2004/0261990 A1 12/2004 Boseman et al.
2005/0184083 A1 8/2005 Diaz et al.
2005/0230117 A1 10/2005 Wilkinson
2006/0102336 A1 5/2006 Campbell
2006/0113077 A1 6/2006 Willberg et al.
2006/0213662 A1 9/2006 Creel et al.
2007/0039739 A1 2/2007 Wilson
2007/0169935 A1 7/2007 Akbar et al.
2007/0187099 A1 8/2007 Wang
2008/0000639 A1 1/2008 Clark et al.
2008/0128133 A1 6/2008 Turley et al.
2008/0196896 A1 8/2008 Bustos et al.
2008/0220991 A1 9/2008 Slay et al.
2009/0101334 A1 4/2009 Baser et al.
2010/0122813 A1 5/2010 Trummer et al.
2010/0147866 A1 6/2010 Witkowski et al.
2010/0152070 A1 6/2010 Ghassemzadeh
2010/0175889 A1 7/2010 Gartz et al.
2010/0200235 A1 8/2010 Luo et al.
2011/0048712 A1 3/2011 Barbee
2011/0226479 A1 9/2011 Tippel et al.
2011/0297396 A1 12/2011 Hendel et al.
2012/0031614 A1 2/2012 Rondeau et al.
2012/0085548 A1 4/2012 Fleckenstein et al.
2012/0090835 A1 4/2012 Kefi
2012/0181032 A1 7/2012 Naedler et al.
2012/0234538 A1 9/2012 Martin et al.
2012/0285659 A1 11/2012 Lafferty et al.
2012/0285695 A1 11/2012 Lafferty et al.
2013/0062055 A1 3/2013 Tolman et al.
2013/0098600 A1 4/2013 Roberts
2013/0186632 A1 7/2013 Makowiecki et al.
2013/0233553 A1 9/2013 Burgrin et al.
2013/0327528 A1 12/2013 Frost
2014/0116712 A1 5/2014 Bansal et al.
2014/0231086 A1 8/2014 Jamison et al.
2014/0299334 A1 10/2014 Hallundbaek et al.
2015/0060069 A1 3/2015 Potapenko et al.
2015/0060072 A1 3/2015 Busby et al.
2015/0075793 A1 3/2015 Dotson et al.

(56) References Cited

U.S. PATENT DOCUMENTS

| | | | |
|---|---|---|---|
| 2015/0191988 | A1 | 7/2015 | Kiesel et al. |
| 2015/0240583 | A1 | 8/2015 | Mineo et al. |
| 2016/0040520 | A1 | 2/2016 | Tolman et al. |
| 2016/0130933 | A1 | 5/2016 | Madasu |
| 2016/0237767 | A1 | 6/2016 | Snoswell et al. |
| 2016/0251930 | A1 | 9/2016 | Jacob et al. |
| 2016/0319628 | A1 | 11/2016 | Schultz et al. |
| 2016/0348466 | A1 | 12/2016 | Schultz et al. |
| 2018/0135394 | A1 | 5/2018 | Tolman |
| 2018/0148994 | A1 | 5/2018 | Schultz et al. |
| 2018/0245439 | A1 | 8/2018 | Entchev et al. |

FOREIGN PATENT DOCUMENTS

| | | | |
|---|---|---|---|
| WO | 2014042552 | A1 | 3/2014 |
| WO | 2016175876 | A1 | 11/2016 |
| WO | 2017014820 | A1 | 1/2017 |
| WO | 2017070105 | A1 | 4/2017 |

OTHER PUBLICATIONS

Oxford Dictionaries; "body", definition of body in English, dated May 23, 2019, 7 pages.
Office Action dated May 29, 2019 for U.S. Appl. No. 15/567,779, 18 pages.
Office Action dated May 29, 2019 for U.S. Appl. No. 16/214,174, 26 pages.
Examination Report dated Mar. 11, 2019 for GCC Patent Application No. 2016-32206, 5 pages.
Examiner's Answer dated Jun. 3, 2019 for U.S. Appl. No. 15/615,136, 17 pages.
Examination Report dated Feb. 12, 2019 for GCC Patent Application No. 2017-33854, 5 pages.
Specifications and drawings for U.S. Appl. No. 16/402,396, filed May 3, 2019, 93 pages.
Office Action dated Jul. 3, 2019 for U.S. Appl. No. 15/726,160, 17 pages.
GCC Examination Report dated Jun. 17, 2019 for GCC Patent Application No. 2016-36182, 3 pages.
Canadian Office Action dated Aug. 2, 2019 for CA Patent Application No. 3,019,772, 5 pages.
GCC Examination Report dated Dec. 23, 2018 for GCC Patent Application No. 2016-31222, 4 pages.
GCC Examination Report dated Feb. 3, 2019 for GCC Patent Application No. 2016-31242, 4 pages.
GCC Examination Report dated Feb. 4, 2019 for GCC Patent Application No. 2016-31243, 4 pages.
U.S. Office Action dated Mar. 18, 2019 for U.S. Appl. No. 15/726,160, 62 pages.
U.S. Office Action dated Mar. 18, 2019 for U.S. Appl. No. 15/658,697, 34 pages.
U.S. Examiners Answer dated Mar. 20, 2019 for U.S. Appl. No. 15/432,041, 39 pages.
Perf Sealers; "History of Perforation Ball Sealers in the Oil and Gas Industry", company web article via www.perfsealers.com, dated 2014-2019, 4 pages.
Canadian Office Action dated Apr. 11, 2019 for CA Patent Application No. 2,992,712, 4 pages.
U.S. Office Action dated Apr. 19, 2019 for U.S. Appl. No. 15/609,671, 23 pages.
Office Action dated Sep. 16, 2019 for U.S. Appl. No. 15/609,671, 39 pages.
Office Action dated Sep. 23, 2019 for U.S. Appl. No. 16/214,174, 26 pages.
Lexico Dictionary; "body", Definition of body in English, dated Sep. 17, 2019, 7 pages.
Lexico Dictionary; "knot", Main definitions of knot in English, dated Sep. 17, 2019, 8 pages.
Examiner's Answer dated Sep. 25, 2019 for U.S. Appl. No. 15/658,697, 26 pages.
Office Action dated Oct. 11, 2019 for U.S. Appl. No. 15/567,779, 33 pages.
Office Action dated Oct. 23, 2019 for U.S. Appl. No. 15/745,608, 69 pages.
Australian Examination Report dated Dec. 18, 2019 for AU Patent Application No. 2017347510, 8 pages.
Canadian Office Action dated Dec. 9, 2019 for CA Patent Application No. 3,019,772, 4 pages.
International Search Report with Written Opinion dated Jan. 26, 2016 for PCT Patent Application No. PCT/US15/038248, 16 pages.
Office Action dated Apr. 13, 2016 for U.S. Appl. No. 14/698,578, 27 pages.
Office Action dated Apr. 13, 2016 for U.S. Appl. No. 14/966,812, 27 pages.
"Fabric." Menriam-Webster.com. Merriam-Webster, n.d. Web. Apr. 5, 2016, 6 pages.
"Rope." Merriam-Webster.com. Merriam-Webster, n.d. Web. Apr. 5, 2016, 10 pages.
Monosol; "Film Data Sheet", product information brochure, dated Mar. 6, 2012, 1 page.
Office Action dated Jul. 11, 2017 for U.S. Appl. No. 15/622,016, 16 pages.
Office Action dated Jul. 13, 2017 for U.S. Appl. No. 15/615,136, 13 pages.
Office Action dated Jul. 14, 2017 for U.S. Appl. No. 15/391,014, 24 pages.
Office Action dated Jul. 17, 2017 for U.S. Appl. No. 15/138,685, 21 pages.
"Yarn"; Definition of Yarn by Merriam-Webster.com, Merrian-Webster, n.d. Web., Aug. 11, 2017, 6 pages.
Office Action dated May 5, 2017 for U.S. Appl. No. 15/347,535, 20 pages.
Office Action dated May 9, 2017 for U.S. Appl. No. 15/138,685, 42 pages.
Office Action dated May 12, 2017 for U.S. Appl. No. 15/296,342, 23 pages.
Specification and Drawings for U.S. Appl. No. 15/567,779, filed Oct. 19, 2017, 63 pages.
Office Action dated Nov. 3, 2017 for U.S. Appl. No. 15/138,685, 15 pages.
Office Action dated Nov. 7, 2017 for U.S. Appl. No. 15/162,334, 16 pages.
Office Action dated Nov. 13, 2017 for U.S. Appl. No. 15/622,016, 44 pages.
Office Action dated Nov. 13, 2017 for U.S. Appl. No. 15/615,136, 34 pages.
Examiner's Answer dated Nov. 15, 2017 for U.S. Appl. No. 15/347,535, 14 pages.
Office Action dated Apr. 13, 2017 for U.S. Appl. No. 15/162,334, 26 pages.
"Thread." Merriam-Webster.com. Merriam-Webster, n.d. Web. Feb. 16, 2017, 12 pages.
"Knot." Merriam-Webster.com. Merriam-Webster, n.d. Web. Feb. 16, 2017, 13 pages.
Office Action dated Jul. 20, 2017 for U.S. Appl. No. 15/162,334, 18 pages.
Office Action dated Jan. 14, 2019 for U.S. Appl. No. 15/609,671, 66 pages.
GCC Examination Report dated Dec. 24, 2018 for GCC Patent Application No. 2016-31223, 4 pages.
GCC Examination Report dated Dec. 24, 2018 for GCC Patent Application No. 2016-31224, 4 pages.
Office Action dated Jan. 29, 2019 for U.S. Appl. No. 15/622,016, 22 pages.
Office Action dated Feb. 11, 2019 for U.S. Appl. No. 15/567,779, 58 pages.
Office Action dated Feb. 11, 2019 for U.S. Appl. No. 16/214,174, 17 pages.
Office Action dated Feb. 11, 2019 for U.S. Appl. No. 16/238,838, 25 pages.

(56) References Cited

OTHER PUBLICATIONS

Australian Examination Report dated Feb. 18, 2019 for AU Patent Application No. 2017279758, 3 pages.
Australian Examination Report dated Feb. 18, 2019 for AU Patent Application No. 2017219082, 3 pages.
Australian Examination Report dated Feb. 26, 2019 for AU Patent Application No. 2017276220, 4 pages.
Notice of Allowance and Fees Due dated Jun. 17, 2020 for U.S. Appl. No. 15/745,608, 16 pages.
Office Action dated Jun. 18, 2020 for U.S. Appl. No. 15/609,671, 19 pages.
Office Action dated Sep. 21, 2020 for U.S. Appl. No. 16/597,183, 60 pages.
Office Action dated Sep. 21, 2020 for U.S. Appl. No. 16/987,094, 60 pages.

* cited by examiner

PLUGGING DEVICES AND DEPLOYMENT IN SUBTERRANEAN WELLS

CROSS-REFERENCE TO RELATED APPLICATIONS

This application is a division of U.S. application Ser. No. 15/726,160 filed on 5 Oct. 2017, which is a continuation of U.S. Pat. No. 9,816,341 filed on 18 Oct. 2016. U.S. Pat. No. 9,816,341 claims the benefit of the filing date of U.S. provisional application Ser. No. 62/348,637 filed on 10 Jun. 2016, and is a continuation-in-part of U.S. Pat. No. 9,745,820 filed on 26 Apr. 2016, which: a) is a continuation-in-part of U.S. application Ser. No. 14/698,578 filed on 28 Apr. 2015, b) is a continuation-in-part of International application serial no. PCT/US15/38248 filed on 29 Jun. 2015, c) claims the benefit of the filing date of US provisional application Ser. No. 62/195,078 filed on 21 Jul. 2015, and d) claims the benefit of the filing date of U.S. provisional application Ser. No. 62/243,444 filed on 19 Oct. 2015. The entire disclosures of these prior applications are incorporated herein by this reference.

BACKGROUND

This disclosure relates generally to equipment utilized and operations performed in conjunction with a subterranean well and, in one example described below, more particularly provides for plugging devices and their deployment in wells.

It can be beneficial to be able to control how and where fluid flows in a well. For example, it may be desirable in some circumstances to be able to prevent fluid from flowing into a particular formation zone. As another example, it may be desirable in some circumstances to cause fluid to flow into a particular formation zone, instead of into another formation zone. As yet another example, it may be desirable to temporarily prevent fluid from flowing through a passage of a well tool. Therefore, it will be readily appreciated that improvements are continually needed in the art of controlling fluid flow in wells.

DETAILED DESCRIPTION

Figure 1:
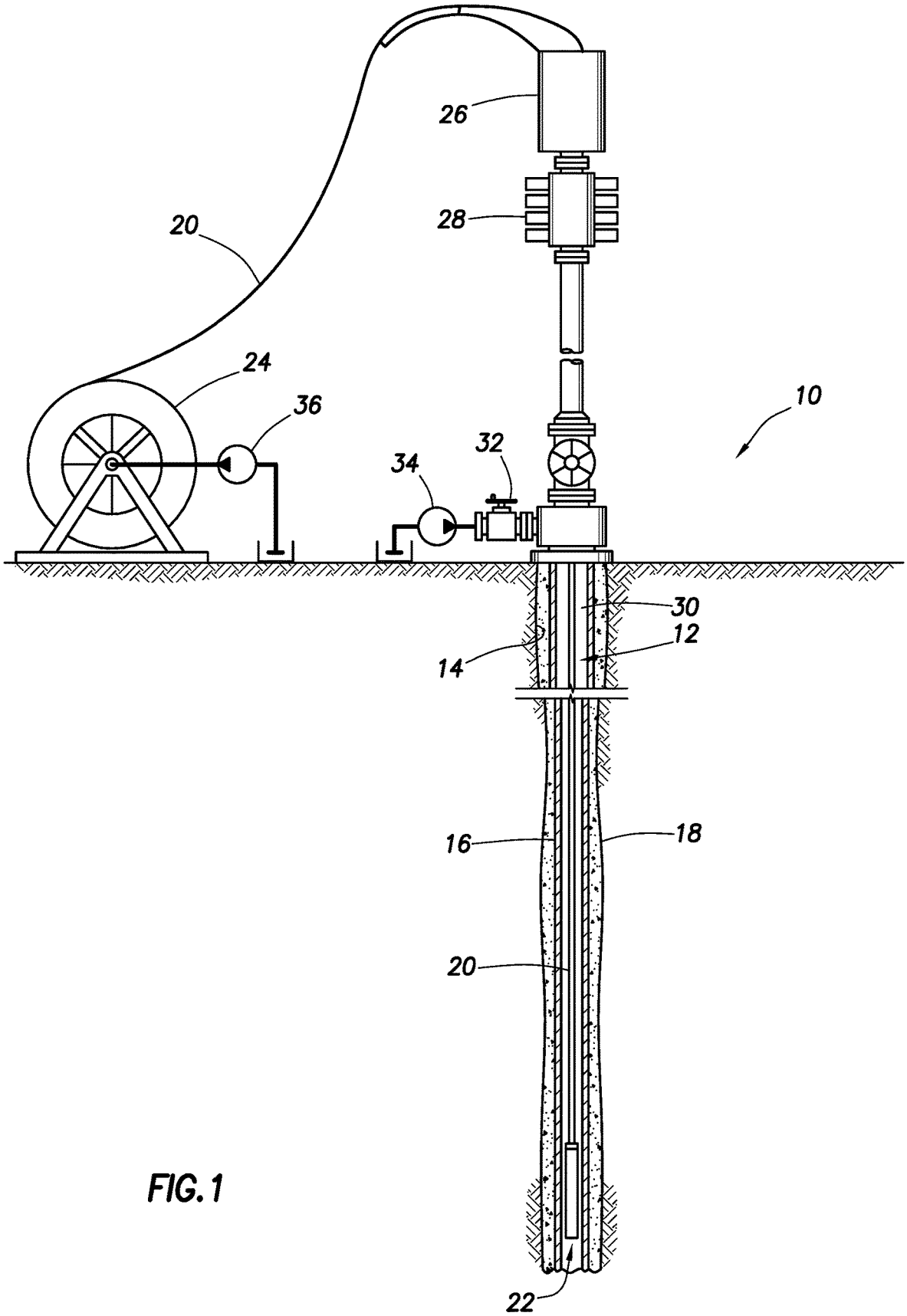
FIG. 1 is a representative partially cross-sectional view of an example of a well system and associated method which can embody principles of this disclosure.

Representatively illustrated in FIG. 1 is a system 10 for use with a well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a tubular string 12 is conveyed into a wellbore 14 lined with casing 16 and cement 18. Although multiple casing strings would typically be used in actual practice, for clarity of illustration only one casing string 16 is depicted in the drawings.

Although the wellbore 14 is illustrated as being vertical, sections of the wellbore could instead be horizontal or otherwise inclined relative to vertical. Although the wellbore 14 is completely cased and cemented as depicted in FIG. 1, any sections of the wellbore in which operations described in more detail below are performed could be uncased or open hole. Thus, the scope of this disclosure is not limited to any particular details of the system 10 and method.

The tubular string 12 of FIG. 1 comprises coiled tubing 20 and a bottom hole assembly 22. As used herein, the term "coiled tubing" refers to a substantially continuous tubing that is stored on a spool or reel 24. The reel 24 could be mounted, for example, on a skid, a trailer, a floating vessel, a vehicle, etc., for transport to a wellsite. Although not shown in FIG. 1, a control room or cab would typically be provided with instrumentation, computers, controllers, recorders, etc., for controlling equipment such as an injector 26 and a blowout preventer stack 28.

As used herein, the term "bottom hole assembly" refers to an assembly connected at a distal end of a tubular string in a well. It is not necessary for a bottom hole assembly to be positioned or used at a "bottom" of a hole or well.

When the tubular string 12 is positioned in the wellbore 14, an annulus 30 is formed radially between them. Fluid, slurries, etc., can be flowed from surface into the annulus 30 via, for example, a casing valve 32. One or more pumps 34 may be used for this purpose. Fluid can also be flowed to surface from the wellbore 14 via the annulus 30 and valve 32.

Fluid, slurries, etc., can also be flowed from surface into the wellbore 14 via the tubing 20, for example, using one or more pumps 36. Fluid can also be flowed to surface from the wellbore 14 via the tubing 20.

In the further description below of the examples of FIGS. 2A-14, one or more flow conveyed devices are used to block or plug openings in the system 10 of FIG. 1. However, it should be clearly understood that these methods and the flow conveyed device may be used with other systems, and the flow conveyed device may be used in other methods in keeping with the principles of this disclosure.

The example methods described below allow existing fluid passageways to be blocked permanently or temporarily in a variety of different applications. Certain flow conveyed device examples described below are made of a fibrous material and may comprise a central body, a "knot" or other enlarged geometry.

The devices may be conveyed into the passageways or leak paths using pumped fluid. Fibrous material extending outwardly from a body of a device can "find" and follow the fluid flow, pulling the enlarged geometry or fibers into a restricted portion of a flow path, causing the enlarged geometry and additional strands to become tightly wedged into the flow path, thereby sealing off fluid communication.

The devices can be made of degradable or non-degradable materials. The degradable materials can be either self-degrading, or can require degrading treatments, such as, by exposing the materials to certain acids, certain base compositions, certain chemicals, certain types of radiation (e.g., electromagnetic or "nuclear"), or elevated temperature. The exposure can be performed at a desired time using a form of well intervention, such as, by spotting or circulating a fluid in the well so that the material is exposed to the fluid.

In some examples, the material can be an acid degradable material (e.g., nylon, etc.), a mix of acid degradable material (for example, nylon fibers mixed with particulate such as calcium carbonate), self-degrading material (e.g., poly-lactic acid (PLA), poly-glycolic acid (PGA), etc.), material that degrades by galvanic action (such as, magnesium alloys, aluminum alloys, etc.), a combination of different self-degrading materials, or a combination of self-degrading and non-self-degrading materials.

Multiple materials can be pumped together or separately. For example, nylon and calcium carbonate could be pumped as a mixture, or the nylon could be pumped first to initiate a seal, followed by calcium carbonate to enhance the seal.

In certain examples described below, the device can be made of knotted fibrous materials. Multiple knots can be used with any number of loose ends. The ends can be frayed or un-frayed. The fibrous material can be rope, fabric, metal wool, cloth or another woven or braided structure.

The device can be used to block open sleeve valves, perforations or any leak paths in a well (such as, leaking connections in casing, corrosion holes, etc.). Any opening or passageway through which fluid flows can be blocked with a suitably configured device. For example, an intentionally or inadvertently opened rupture disk, or another opening in a well tool, could be plugged using the device.

In one example method described below, a well with an existing perforated zone can be re-completed. Devices (either degradable or non-degradable) are conveyed by flow to plug all existing perforations.

The well can then be re-completed using any desired completion technique. If the devices are degradable, a degrading treatment can then be placed in the well to open up the plugged perforations (if desired).

In another example method described below, multiple formation zones can be perforated and fractured (or otherwise stimulated, such as, by acidizing) in a single trip of the bottom hole assembly 22 into the well. In the method, one zone is perforated, the zone is stimulated, and then the perforated zone is plugged using one or more devices.

These steps are repeated for each additional zone, except that a last zone may not be plugged. All of the plugged zones are eventually unplugged by waiting a certain period of time (if the devices are self-degrading), by applying an appropriate degrading treatment, or by mechanically removing the devices.

Referring specifically now to FIGS. 2A-D, steps in an example of a method in which the bottom hole assembly 22 of FIG. 1 can be used in re-completing a well are representatively illustrated. In this method (see FIG. 2A), the well has existing perforations 38 that provide for fluid communication between an earth formation zone 40 and an interior of the casing 16. However, it is desired to re-complete the zone 40, in order to enhance the fluid communication.

Figure 2A:
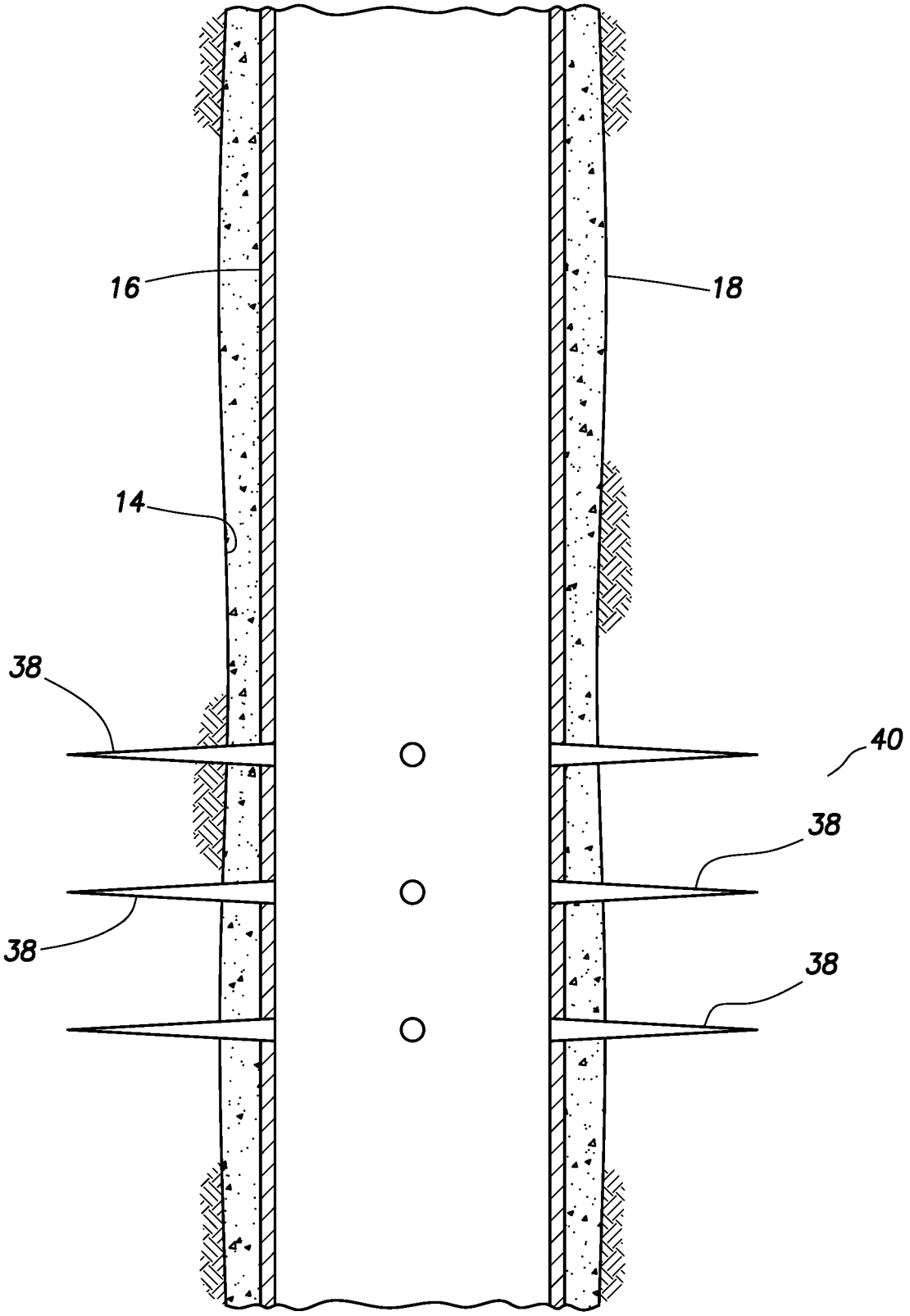
FIGS. 2A-D are enlarged scale representative partially cross-sectional views of steps in an example of a re-completion method that may be practiced with the system of FIG. 1.
Figure 2B:
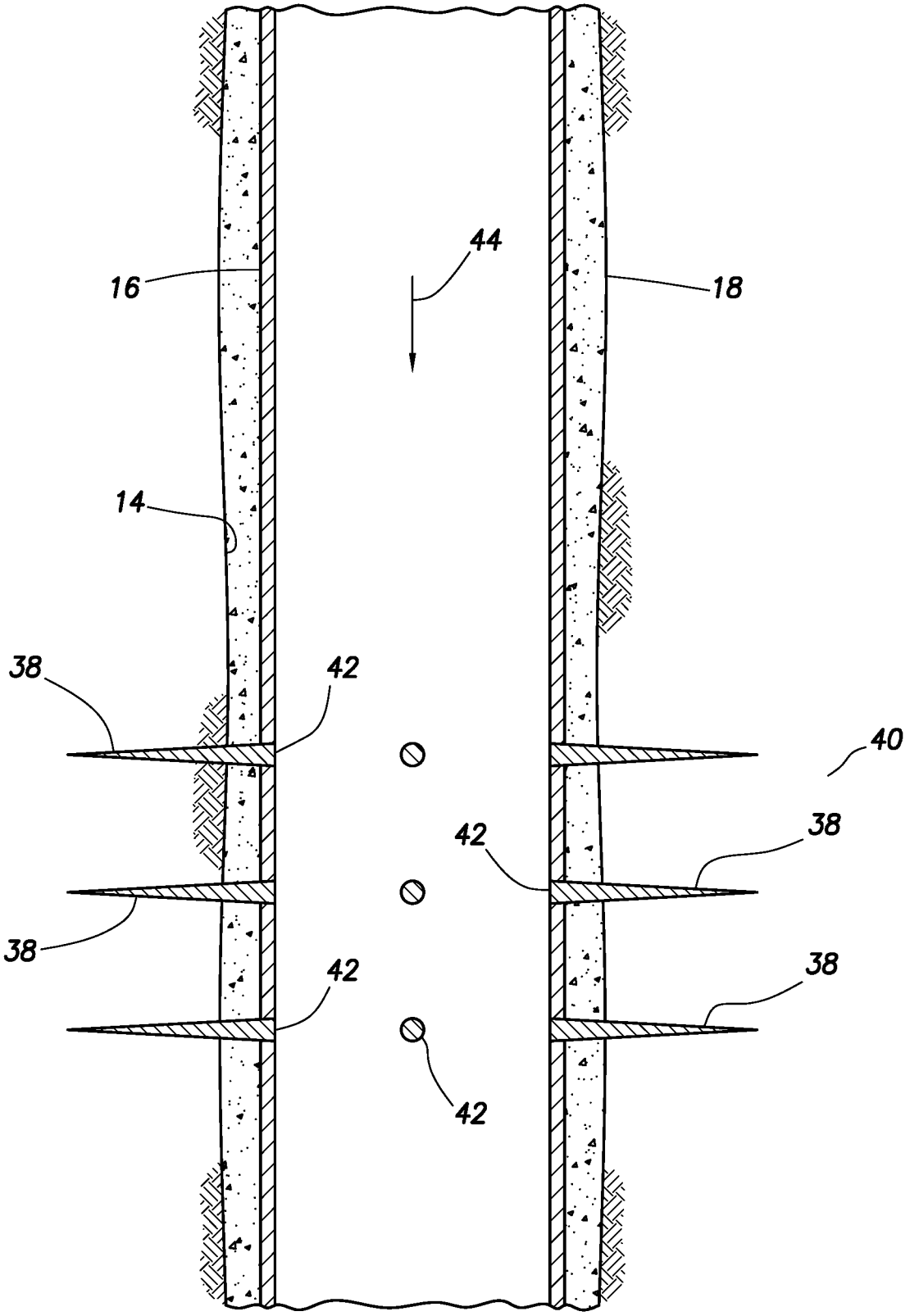

Referring additionally now to FIG. 2B, the perforations 38 are plugged, thereby preventing flow through the perforations into the zone 40. Plugs 42 in the perforations can be flow conveyed devices, as described more fully below. In that case, the plugs 42 can be conveyed through the casing 16 and into engagement with the perforations 38 by fluid flow 44.

Figure 2C:
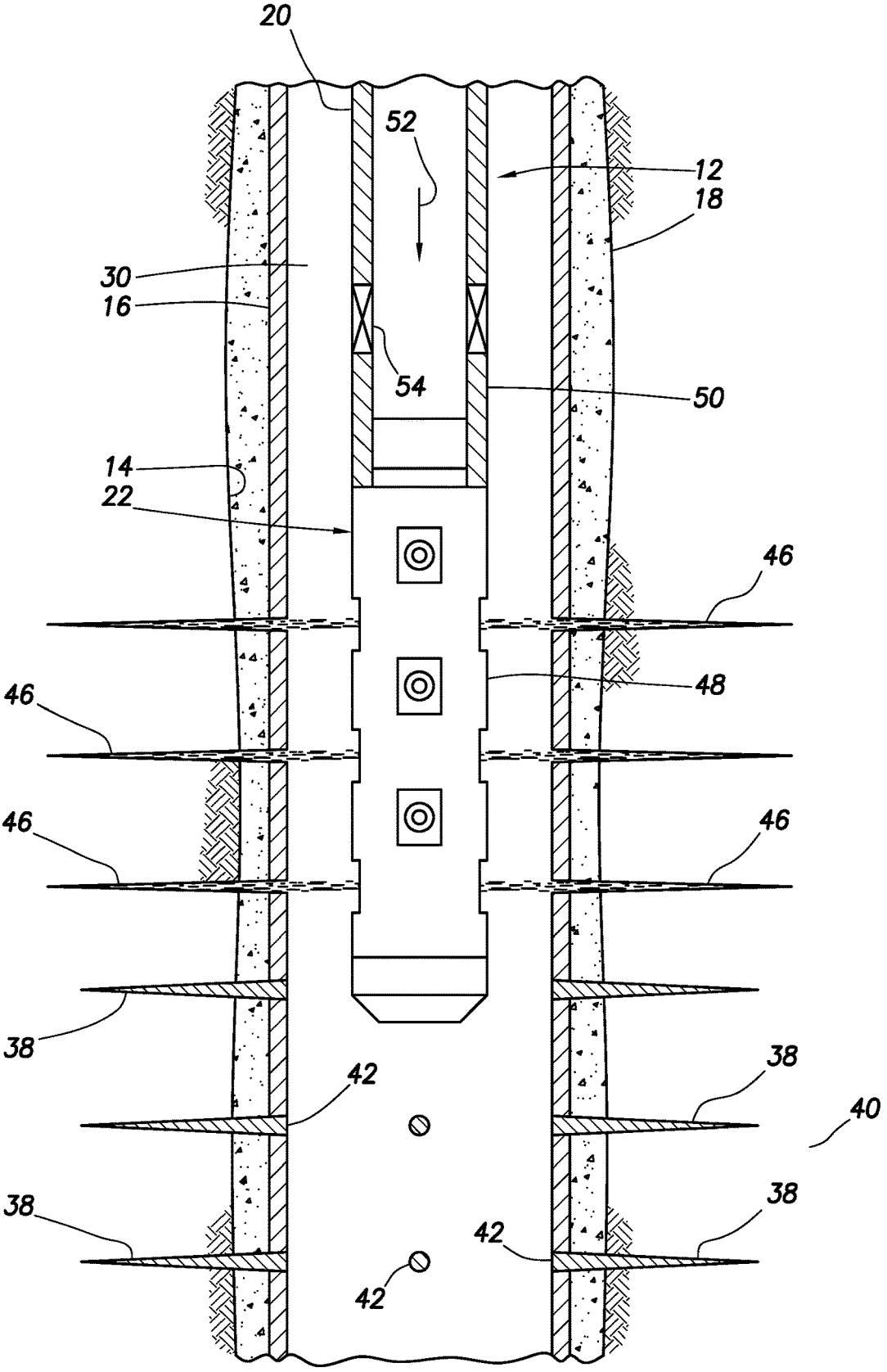

Referring additionally now to FIG. 2C, new perforations 46 are formed through the casing 16 and cement 18 by use of an abrasive jet perforator 48. In this example, the bottom hole assembly 22 includes the perforator 48 and a circulating valve assembly 50. Although the new perforations 46 are depicted as being formed above the existing perforations 38, the new perforations could be formed in any location in keeping with the principles of this disclosure.

Note that other means of providing perforations 46 may be used in other examples. Explosive perforators, drills, etc., may be used if desired. The scope of this disclosure is not limited to any particular perforating means, or to use with perforating at all.

The circulating valve assembly 50 controls flow between the coiled tubing 20 and the perforator 48, and controls flow between the annulus 30 and an interior of the tubular string 12. Instead of conveying the plugs 42 into the well via flow 44 through the interior of the casing 16 (see FIG. 2B), in other examples the plugs could be deployed into the tubular string 12 and conveyed by fluid flow 52 through the tubular string prior to the perforating operation. In that case, a valve 54 of the circulating valve assembly 50 could be opened to allow the plugs 42 to exit the tubular string 12 and flow into the interior of the casing 16 external to the tubular string.

Figure 2D:
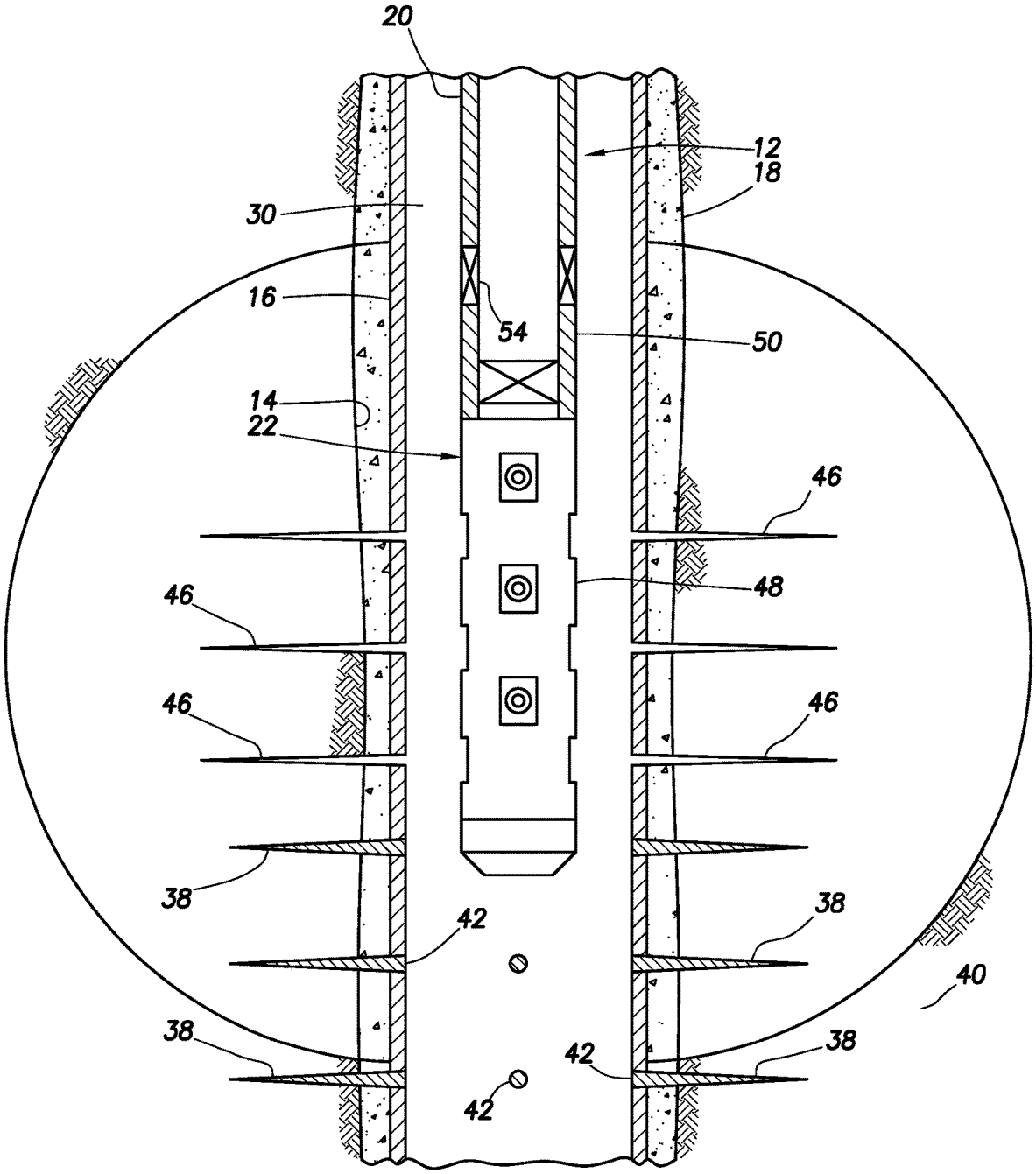

Referring additionally now to FIG. 2D, the zone 40 has been fractured by applying increased pressure to the zone after the perforating operation. Enhanced fluid communication is now permitted between the zone 40 and the interior of the casing 16.

Note that fracturing is not necessary in keeping with the principles of this disclosure. A zone could be stimulated (for example, by acidizing) with or without fracturing. Thus, although fracturing is described for certain examples, it should be understood that other types of stimulation treatments, in addition to or instead of fracturing, could be performed.

In the FIG. 2D example, the plugs 42 prevent the pressure applied to fracture the zone 40 via the perforations 46 from leaking into the zone via the perforations 38. The plugs 42 may remain in the perforations 38 and continue to prevent flow through the perforations, or the plugs may degrade, if desired, so that flow is eventually permitted through the perforations.

In other examples, fractures may be formed via the existing perforations 38, and no new perforations may be formed. In one technique, pressure may be applied in the casing 16 (e.g., using the pump 34), thereby initially fracturing the zone 40 via some of the perforations 38 that receive most of the fluid flow 44. After the initial fracturing of the zone 40, and while the fluid is flowed through the casing 16, plugs 42 can be released into the casing, so that the plugs seal off those perforations 38 that are receiving most of the fluid flow.

In this way, the fluid 44 will be diverted to other perforations 38, so that the zone 40 will also be fractured via those other perforations 38. The plugs 42 can be released into the casing 16 continuously or periodically as the fracturing operation progresses, so that the plugs gradually seal off all, or most, of the perforations 38 as the zone 40 is fractured via the perforations. That is, at each point in the fracturing operation, the plugs 42 will seal off those perforations 38 through which most of the fluid flow 44 passes, which are the perforations via which the zone 40 has been fractured.

Referring additionally now to FIGS. 3A-D, steps in another example of a method in which the bottom hole assembly 22 of FIG. 1 can be used in completing multiple zones 40*a-c* of a well are representatively illustrated. The multiple zones 40*a-c* are each perforated and fractured during a single trip of the tubular string 12 into the well.

Figure 3A:
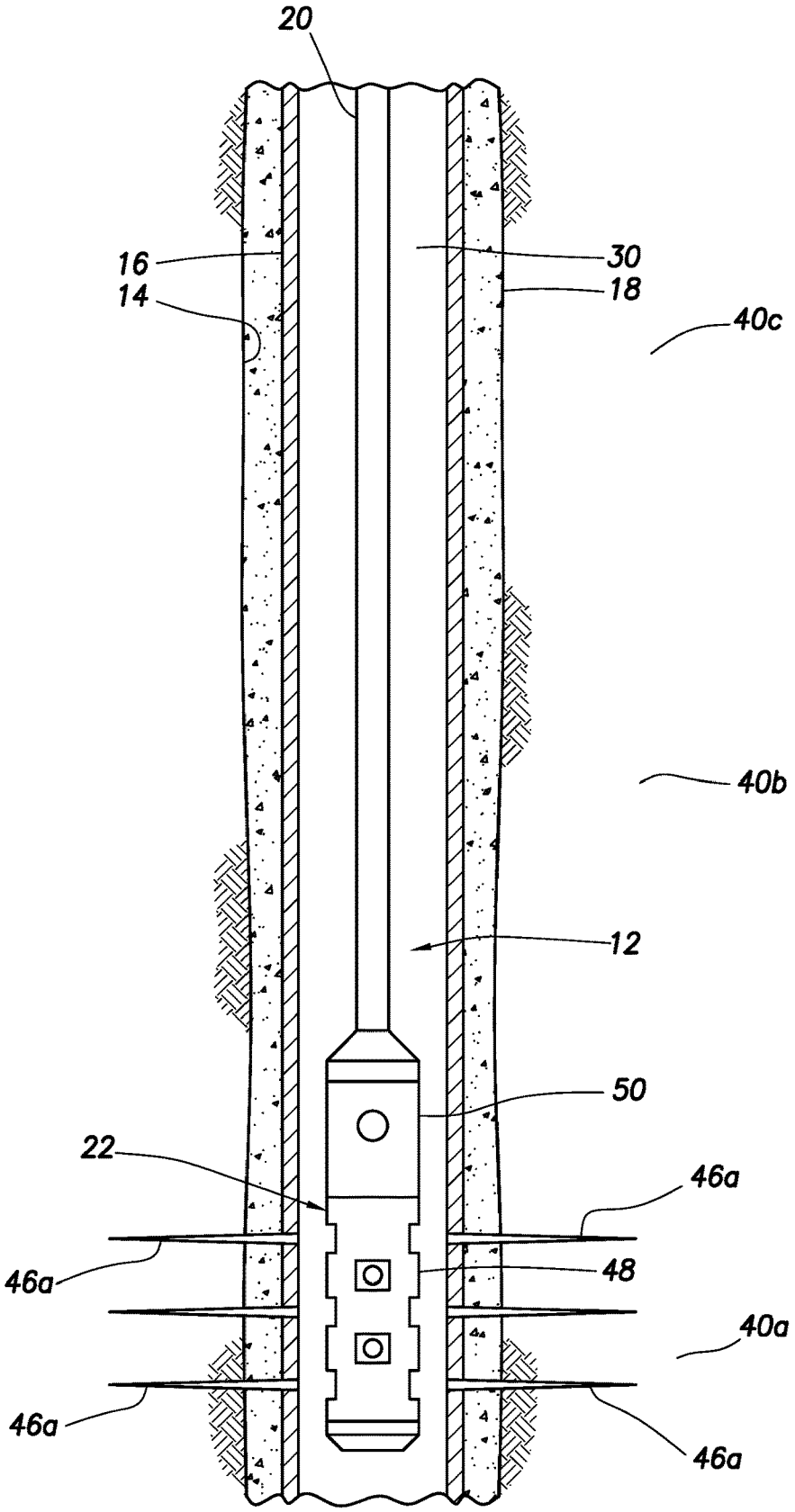
FIGS. 3A-D are representative partially cross-sectional views of steps in another example of a method that may be practiced with the system of FIG. 1.

In FIG. 3A, the tubular string 12 has been deployed into the casing 16, and has been positioned so that the perforator 48 is at the first zone 40*a* to be completed. The perforator 48 is then used to form perforations 46*a* through the casing 16 and cement 18, and into the zone 40*a*.

Figure 3B:
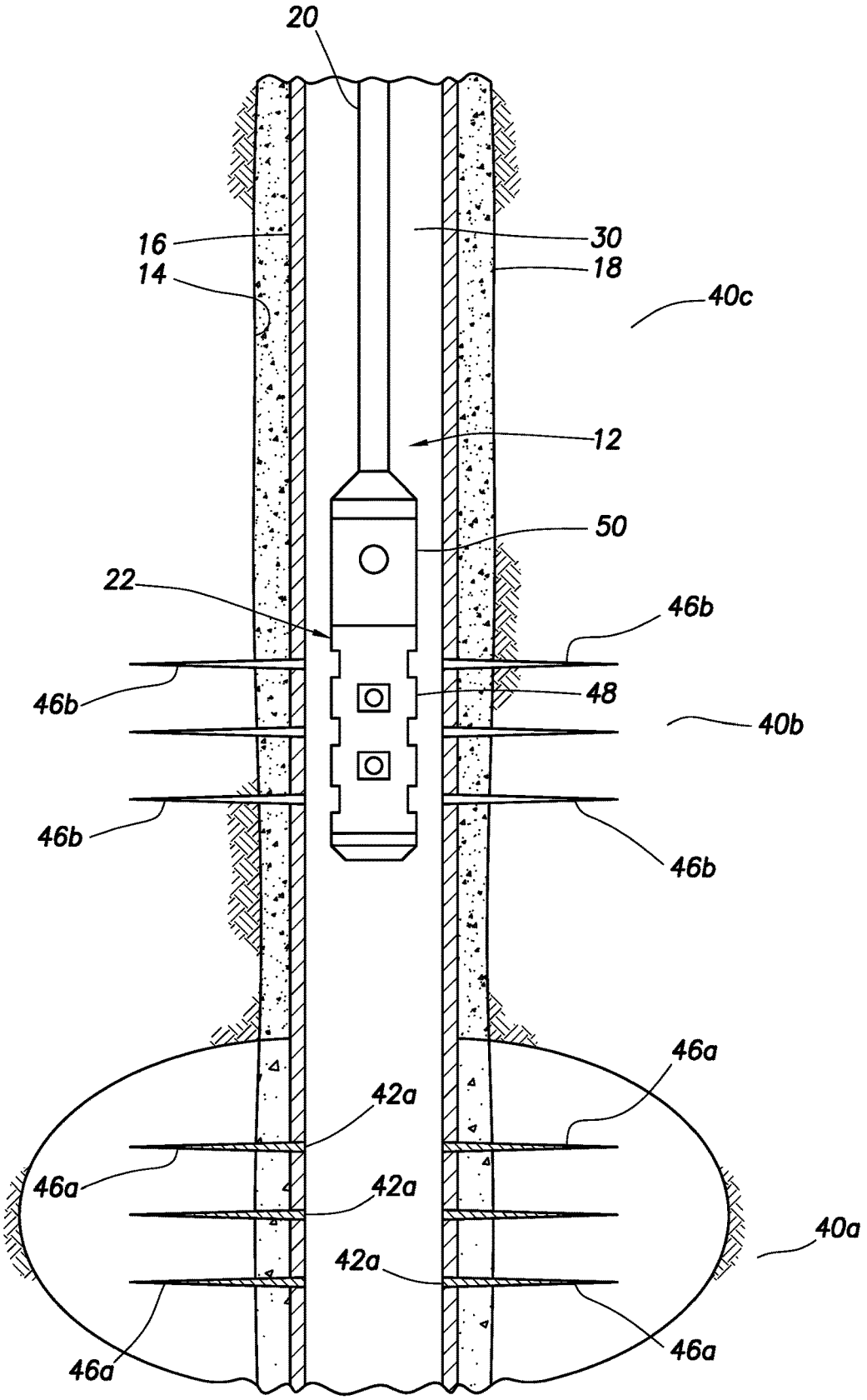

In FIG. 3B, the zone 40*a* has been fractured by applying increased pressure to the zone via the perforations 46*a*. The fracturing pressure may be applied, for example, via the annulus 30 from the surface (e.g., using the pump 34 of FIG. 1), or via the tubular string 12 (e.g., using the pump 36 of FIG. 1). The scope of this disclosure is not limited to any particular fracturing means or technique, or to the use of fracturing at all.

After fracturing of the zone 40*a*, the perforations 46*a* are plugged by deploying plugs 42*a* into the well and conveying them by fluid flow into sealing engagement with the perforations. The plugs 42*a* may be conveyed by flow 44 through the casing 16 (e.g., as in FIG. 2B), or by flow 52 through the tubular string 12 (e.g., as in FIG. 2C).

The tubular string 12 is repositioned in the casing 16, so that the perforator 48 is now located at the next zone 40*b* to be completed. The perforator 48 is then used to form perforations 46*b* through the casing 16 and cement 18, and into the zone 40*b*. The tubular string 12 may be repositioned before or after the plugs 42*a* are deployed into the well.

Figure 3C:
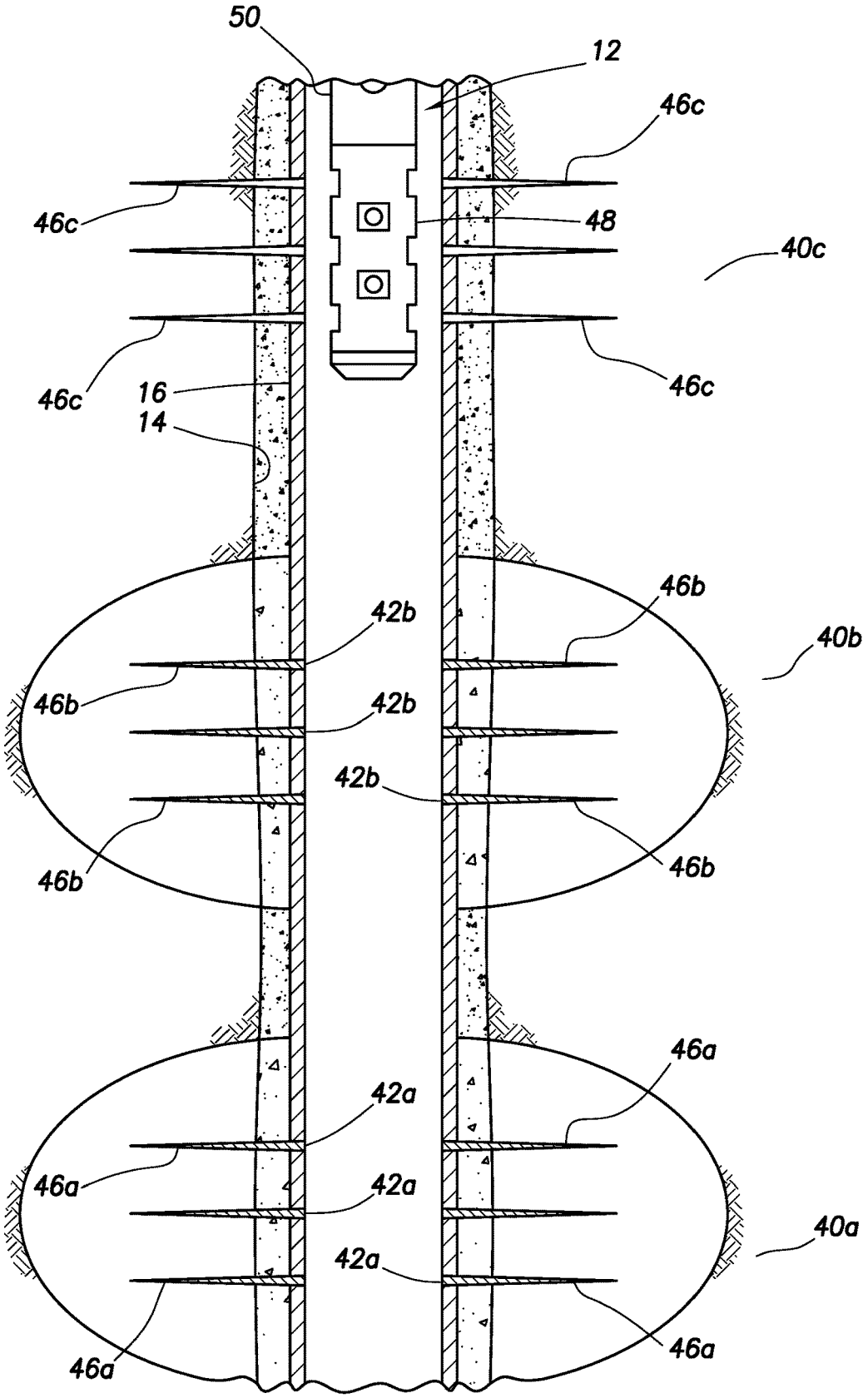

In FIG. 3C, the zone 40*b* has been fractured by applying increased pressure to the zone via the perforations 46*b*. The fracturing pressure may be applied, for example, via the annulus 30 from the surface (e.g., using the pump 34 of FIG. 1), or via the tubular string 12 (e.g., using the pump 36 of FIG. 1).

After fracturing of the zone 40*b*, the perforations 46*b* are plugged by deploying plugs 42*b* into the well and conveying them by fluid flow into sealing engagement with the perforations. The plugs 42*b* may be conveyed by flow 44 through the casing 16, or by flow 52 through the tubular string 12.

The tubular string 12 is repositioned in the casing 16, so that the perforator 48 is now located at the next zone 40*c* to be completed. The perforator 48 is then used to form perforations 46*c* through the casing 16 and cement 18, and into the zone 40*c*. The tubular string 12 may be repositioned before or after the plugs 42*b* are deployed into the well.

Figure 3D:
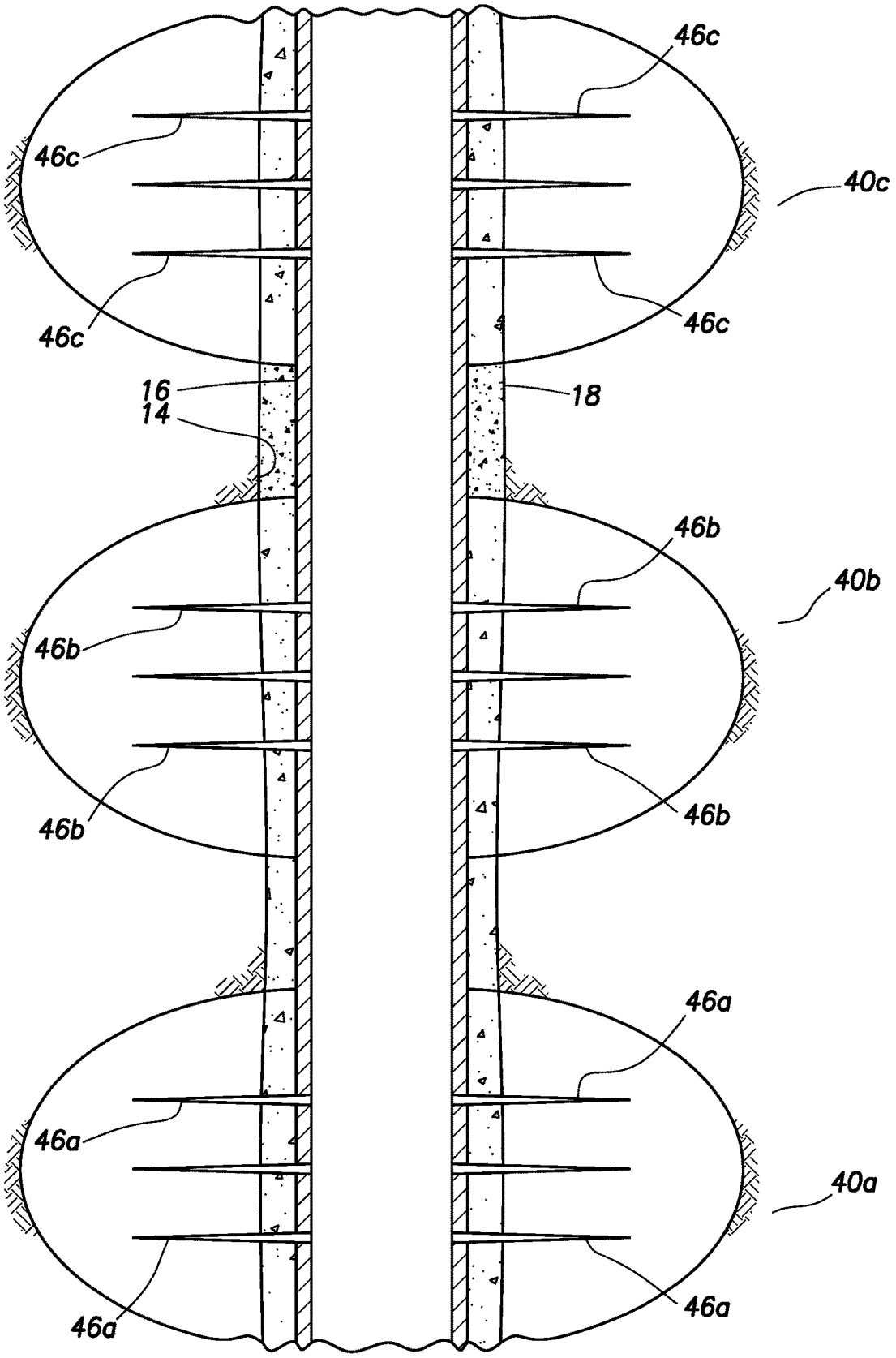

In FIG. 3D, the zone 40*c* has been fractured by applying increased pressure to the zone via the perforations 46*c*. The fracturing pressure may be applied, for example, via the annulus 30 from the surface (e.g., using the pump 34 of FIG. 1), or via the tubular string 12 (e.g., using the pump 36 of FIG. 1).

The plugs 42*a,b* are then degraded and no longer prevent flow through the perforations 46*a,b*. Thus, as depicted in FIG. 3D, flow is permitted between the interior of the casing 16 and each of the zones 40*a-c*.

The plugs 42*a,b* may be degraded in any manner. The plugs 42*a,b* may degrade in response to application of a degrading treatment, in response to passage of a certain period of time, or in response to exposure to elevated downhole temperature. The degrading treatment could include exposing the plugs 42*a,b* to a particular type of radiation, such as electromagnetic radiation (e.g., light having a certain wavelength or range of wavelengths, gamma rays, etc.) or "nuclear" particles (e.g., gamma, beta, alpha or neutron).

The plugs 42*a,b* may degrade by galvanic action or by dissolving. The plugs 42*a,b* may degrade in response to exposure to a particular fluid, either naturally occurring in the well (such as water or hydrocarbon fluid), or introduced therein (such as a fluid having a particular pH).

Note that any number of zones may be completed in any order in keeping with the principles of this disclosure. The zones 40*a-c* may be sections of a single earth formation, or they may be sections of separate formations. Although the perforations 46*c* are not described above as being plugged in the method, the perforations 46*c* could be plugged after the zone 40*c* is fractured or otherwise stimulated (e.g., to verify that the plugs are indeed preventing flow from the casing 16 to the zones 40*a-c*).

In other examples, the plugs 42 may not be degraded. The plugs 42 could instead be mechanically removed, for example, by milling or otherwise cutting the plugs 42 away from the perforations. In any of the method examples described above, after the fracturing operation(s) are completed, the plugs 42 can be milled off or otherwise removed from the perforations 38, 46, 46*a,b* without dissolving, melting, dispersing or otherwise degrading a material of the plugs.

In some examples, the plugs 42 can be mechanically removed, without necessarily cutting the plugs. A tool with appropriate gripping structures (such as a mill or another cutting or grabbing device) could grab the plugs 42 and pull them from the perforations.

Figure 4A:
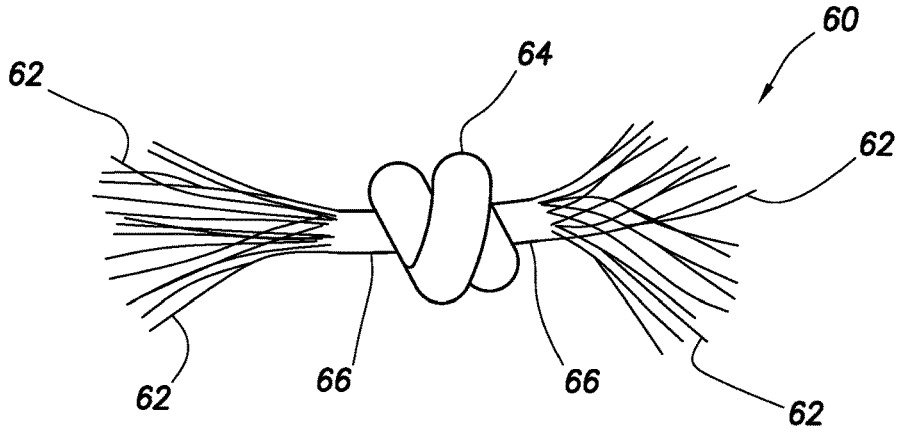
FIGS. 4A & B are enlarged scale representative elevational views of examples of a flow conveyed device that may be used in the system and methods of FIGS. 1-3D, and which can embody the principles of this disclosure.

Referring additionally now to FIG. 4A, an example of a flow conveyed device 60 that can incorporate the principles of this disclosure is representatively illustrated. The device 60 may be used for any of the plugs 42, 42*a,b* in the method examples described above, or the device may be used in other methods.

The device 60 example of FIG. 4A includes multiple fibers 62 extending outwardly from an enlarged body 64. As depicted in FIG. 4A, each of the fibers 62 has a lateral dimension (e.g., a thickness or diameter) that is substantially smaller than a size (e.g., a thickness or diameter) of the body 64.

The body 64 can be dimensioned so that it will effectively engage and seal off a particular opening in a well. For example, if it is desired for the device 60 to seal off a perforation in a well, the body 64 can be formed so that it is somewhat larger than a diameter of the perforation. If it is desired for multiple devices 60 to seal off multiple openings having a variety of dimensions (such as holes caused by corrosion of the casing 16), then the bodies 64 of the devices can be formed with a corresponding variety of sizes.

In the FIG. 4A example, the fibers 62 are joined together (e.g., by braiding, weaving, cabling, etc.) to form lines 66 that extend outwardly from the body 64. In this example, there are two such lines 66, but any number of lines (including one) may be used in other examples.

The lines 66 may be in the form of one or more ropes, in which case the fibers 62 could comprise frayed ends of the rope(s). In addition, the body 64 could be formed by one or more knots in the rope(s). In some examples, the body 64 can comprise a fabric or cloth, the body could be formed by one or more knots in the fabric or cloth, and the fibers 62 could extend from the fabric or cloth.

In other examples, the device 60 could comprise a single sheet of material, or multiple strips of sheet material. The device 60 could comprise one or more films. The body 64 and lines 66 may not be made of the same material, and the body and/or lines may not be made of a fibrous material.

In the FIG. 4A example, the body 64 is formed by a double overhand knot in a rope, and ends of the rope are frayed, so that the fibers 62 are splayed outward. In this manner, the fibers 62 will cause significant fluid drag when the device 60 is deployed into a flow stream, so that the device will be effectively "carried" by, and "follow," the flow.

However, it should be clearly understood that other types of bodies and other types of fibers may be used in other examples. The body 64 could have other shapes, the body could be hollow or solid, and the body could be made up of one or multiple materials. The fibers 62 are not necessarily joined by lines 66, and the fibers are not necessarily formed by fraying ends of ropes or other lines. The body 64 is not necessarily centrally located in the device 60 (for example, the body could be at one end of the lines 66). Thus, the scope of this disclosure is not limited to the construction, configuration or other details of the device 60 as described herein or depicted in the drawings.

Figure 4B:
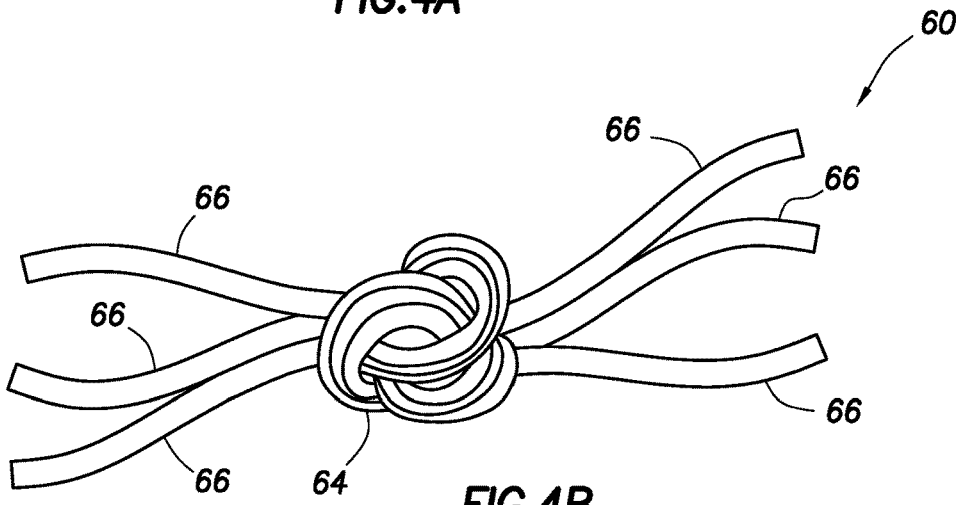

Referring additionally now to FIG. 4B, another example of the device 60 is representatively illustrated. In this example, the device 60 is formed using multiple braided lines 66 of the type known as "mason twine." The multiple lines 66 are knotted (such as, with a double or triple overhand knot or other type of knot) to form the body 64. Ends of the lines 66 are not necessarily frayed in these examples, although the lines do comprise fibers (such as the fibers 62 described above).

Figure 5:
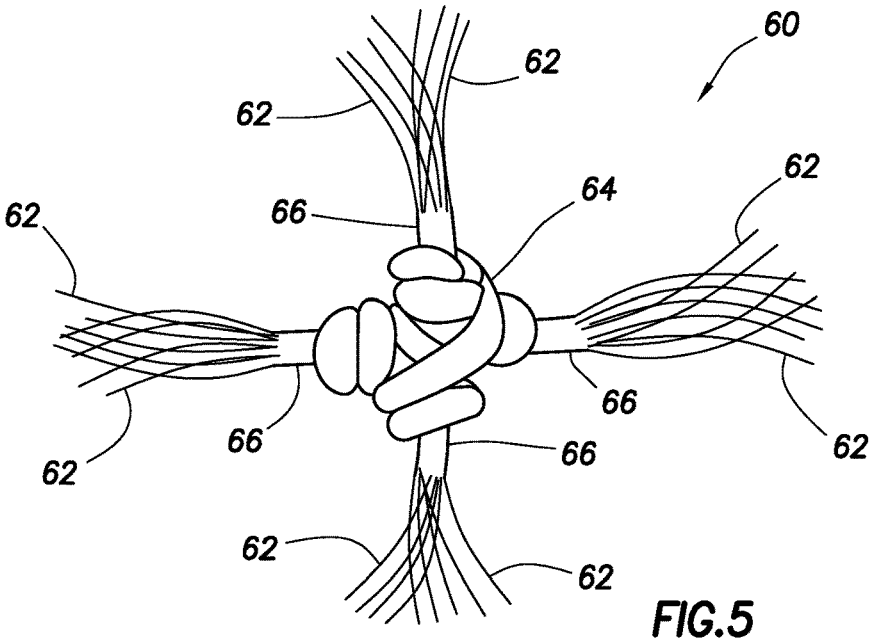
FIG. 5 is a representative elevational view of another example of the flow conveyed device.

Referring additionally now to FIG. 5, another example of the device 60 is representatively illustrated. In this example, four sets of the fibers 62 are joined by a corresponding number of lines 66 to the body 64. The body 64 is formed by one or more knots in the lines 66.

FIG. 5 demonstrates that a variety of different configurations are possible for the device 60. Accordingly, the principles of this disclosure can be incorporated into other configurations not specifically described herein or depicted in the drawings. Such other configurations may include fibers joined to bodies without use of lines, bodies formed by techniques other than knotting, etc.

Figure 6B:
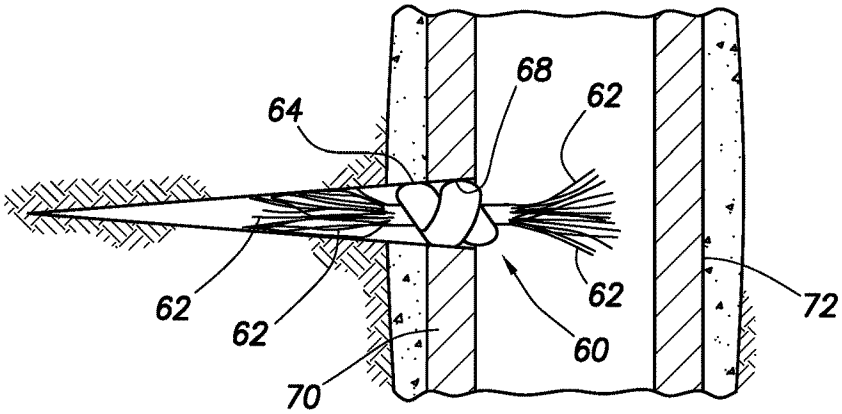
FIGS. 6A & B are representative partially cross-sectional views of the flow conveyed device in a well, the device being conveyed by flow in FIG. 6A, and engaging a casing opening in FIG. 6B.
Figure 6A:
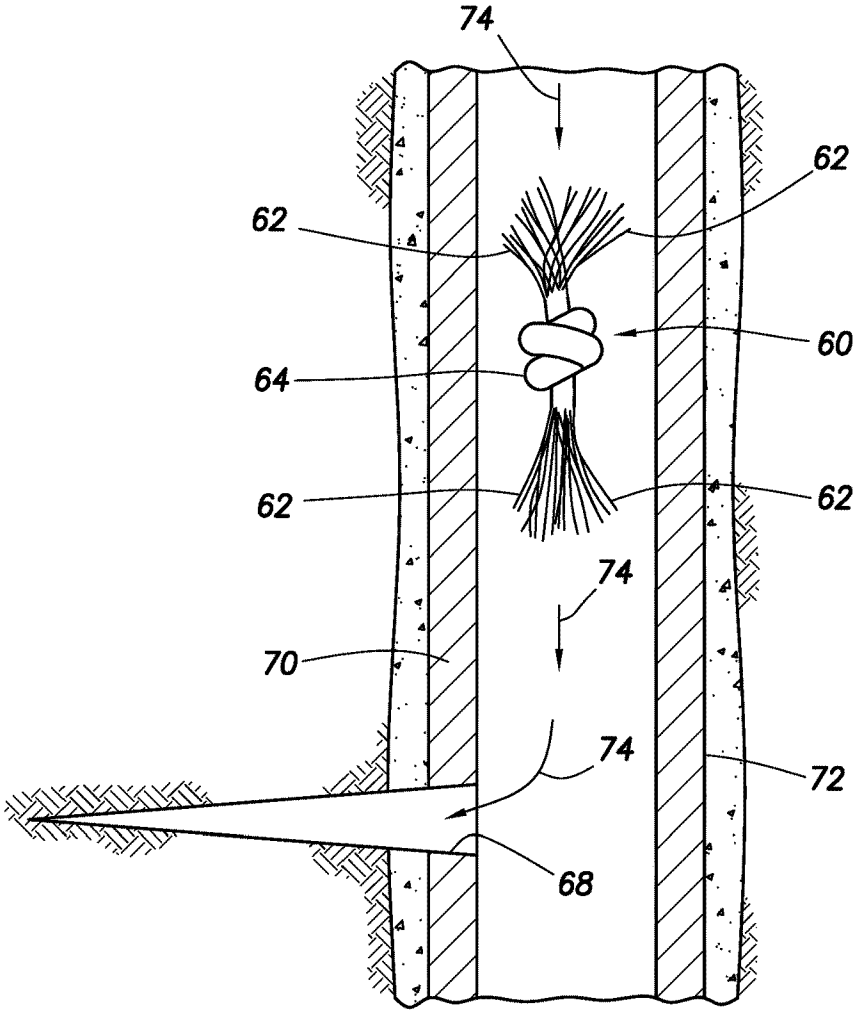

Referring additionally now to FIGS. 6A & B, an example of a use of the device 60 of FIG. 4 to seal off an opening 68 in a well is representatively illustrated. In this example, the opening 68 is a perforation formed through a sidewall 70 of a tubular string 72 (such as, a casing, liner, tubing, etc.). However, in other examples the opening 68 could be another type of opening, and may be formed in another type of structure.

The device 60 is deployed into the tubular string 72 and is conveyed through the tubular string by fluid flow 74. The fibers 62 of the device 60 enhance fluid drag on the device, so that the device is influenced to displace with the flow 74.

Since the flow 74 (or a portion thereof) exits the tubular string 72 via the opening 68, the device 60 will be influenced by the fluid drag to also exit the tubular string via the opening 68. As depicted in FIG. 6B, one set of the fibers 62 first enters the opening 68, and the body 64 follows. However, the body 64 is appropriately dimensioned, so that it does not pass through the opening 68, but instead is lodged or wedged into the opening. In some examples, the body 64 may be received only partially in the opening 68, and in other examples the body may be entirely received in the opening.

The body 64 may completely or only partially block the flow 74 through the opening 68. If the body 64 only partially blocks the flow 74, any remaining fibers 62 exposed to the flow in the tubular string 72 can be carried by that flow into any gaps between the body and the opening 68, so that a combination of the body and the fibers completely blocks flow through the opening.

In another example, the device 60 may partially block flow through the opening 68, and another material (such as, calcium carbonate, PLA or PGA particles) may be deployed and conveyed by the flow 74 into any gaps between the device and the opening, so that a combination of the device and the material completely blocks flow through the opening.

The device 60 may permanently prevent flow through the opening 68, or the device may degrade to eventually permit flow through the opening. If the device 60 degrades, it may be self-degrading, or it may be degraded in response to any of a variety of different stimuli. Any technique or means for degrading the device 60 (and any other material used in conjunction with the device to block flow through the opening 68) may be used in keeping with the scope of this disclosure.

In other examples, the device 60 may be mechanically removed from the opening 68. For example, if the body 64 only partially enters the opening 68, a mill or other cutting device may be used to cut the body from the opening.

Figure 7:
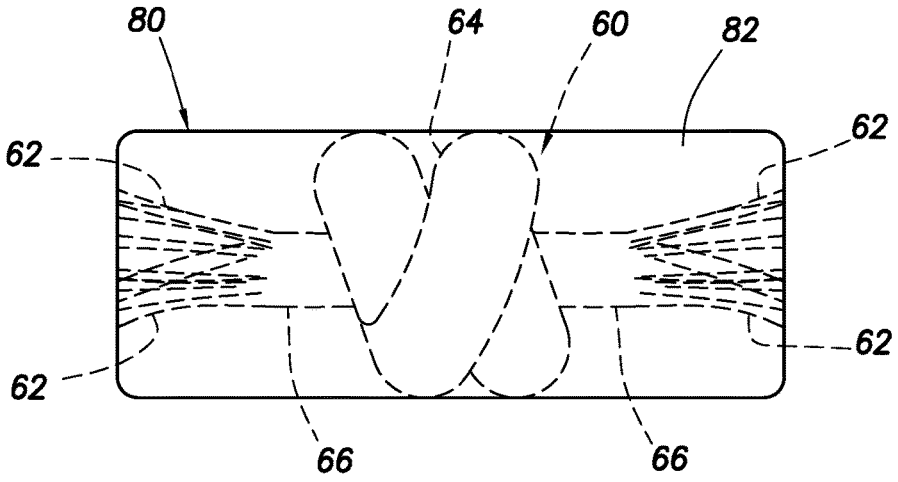
FIGS. 7-9 are representative elevational views of examples of the flow conveyed device with a retainer.
Figure 8:
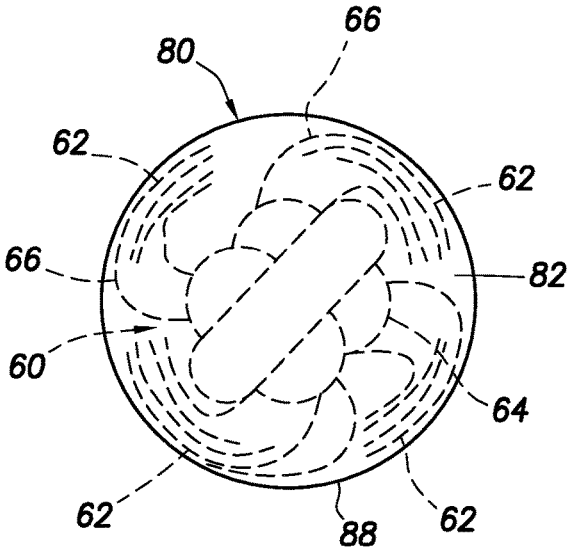
Figure 9:
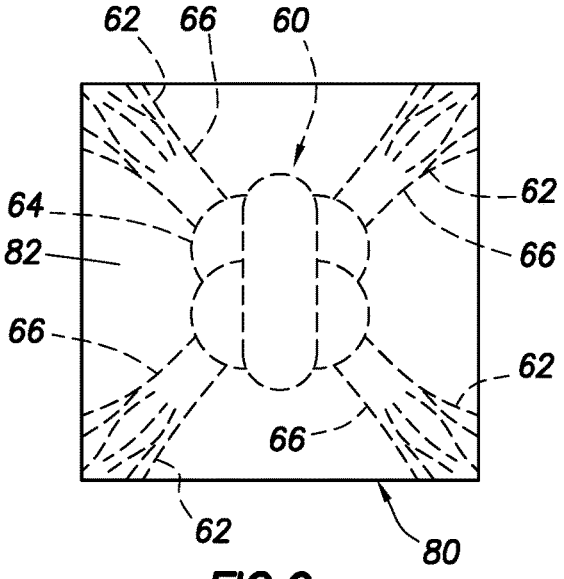

Referring additionally now to FIGS. 7-9, additional examples of the device 60 are representatively illustrated. In these examples, the device 60 is surrounded by, encapsulated in, molded in, or otherwise retained by, a retainer 80.

The retainer 80 aids in deployment of the device 60, particularly in situations where multiple devices are to be deployed simultaneously. In such situations, the retainer 80 for each device 60 prevents the fibers 62 and/or lines 66 from becoming entangled with the fibers and/or lines of other devices.

The retainer 80 could in some examples completely enclose the device 60. In other examples, the retainer 80 could be in the form of a binder that holds the fibers 62 and/or lines 66 together, so that they do not become entangled with those of other devices.

In some examples, the retainer 80 could have a cavity therein, with the device 60 (or only the fibers 62 and/or lines 66) being contained in the cavity. In other examples, the retainer 80 could be molded about the device 60 (or only the fibers 62 and/or lines 66).

During or after deployment of the device 60 into the well, the retainer 80 dissolves, melts, disperses or otherwise degrades, so that the device is capable of sealing off an opening 68 in the well, as described above. For example, the retainer 80 can be made of a material 82 that degrades in a wellbore environment.

The retainer material 82 may degrade after deployment into the well, but before arrival of the device 60 at the opening 68 to be plugged. In other examples, the retainer material 82 may degrade at or after arrival of the device 60 at the opening 68 to be plugged. If the device 60 also comprises a degradable material, then preferably the retainer material 82 degrades prior to the device material.

The material 82 could, in some examples, melt at elevated wellbore temperatures. The material 82 could be chosen to have a melting point that is between a temperature at the earth's surface and a temperature at the opening 68, so that the material melts during transport from the surface to the downhole location of the opening.

The material 82 could, in some examples, dissolve when exposed to wellbore fluid. The material 82 could be chosen so that the material begins dissolving as soon as it is deployed into the wellbore 14 and contacts a certain fluid (such as, water, brine, hydrocarbon fluid, etc.) therein. In other examples, the fluid that initiates dissolving of the material 82 could have a certain pH range that causes the material to dissolve.

Note that it is not necessary for the material 82 to melt or dissolve in the well. Various other stimuli (such as, passage of time, elevated pressure, flow, turbulence, etc.) could cause the material 82 to disperse, degrade or otherwise cease to retain the device 60. The material 82 could degrade in response to any one, or a combination, of: passage of a predetermined period of time in the well, exposure to a predetermined temperature in the well, exposure to a predetermined fluid in the well, exposure to radiation in the well and exposure to a predetermined chemical composition in the well. Thus, the scope of this disclosure is not limited to any particular stimulus or technique for dispersing or degrading the material 82, or to any particular type of material.

In some examples, the material 82 can remain on the device 60, at least partially, when the device engages the opening 68. For example, the material 82 could continue to cover the body 64 (at least partially) when the body engages and seals off the opening 68. In such examples, the material 82 could advantageously comprise a relatively soft, viscous and/or resilient material, so that sealing between the device 60 and the opening 68 is enhanced.

Suitable relatively low melting point substances that may be used for the material 82 can include wax (e.g., paraffin wax, vegetable wax), ethylene-vinyl acetate copolymer (e.g., ELVAX™ available from DuPont), atactic polypropylene, and eutectic alloys. Suitable relatively soft substances that may be used for the material 82 can include a soft silicone composition or a viscous liquid or gel.

Suitable dissolvable materials can include PLA, PGA, anhydrous boron compounds (such as anhydrous boric oxide and anhydrous sodium borate), polyvinyl alcohol, polyethylene oxide, salts and carbonates. The dissolution rate of a water-soluble polymer (e.g., polyvinyl alcohol, polyethylene oxide) can be increased by incorporating a water-soluble plasticizer (e.g., glycerin), or a rapidly-dissolving salt (e.g., sodium chloride, potassium chloride), or both a plasticizer and a salt.

In FIG. 7, the retainer 80 is in a cylindrical form. The device 60 is encapsulated in, or molded in, the retainer material 82. The fibers 62 and lines 66 are, thus, prevented from becoming entwined with the fibers and lines of any other devices 60.

In FIG. 8, the retainer 80 is in a spherical form. In addition, the device 60 is compacted, and its compacted shape is retained by the retainer material 82. A shape of the retainer 80 can be chosen as appropriate for a particular device 60 shape, in compacted or un-compacted form.

In FIG. 9, the retainer 80 is in a cubic form. Thus, any type of shape (polyhedron, spherical, cylindrical, etc.) may be used for the retainer 80, in keeping with the principles of this disclosure.

Figure 10:
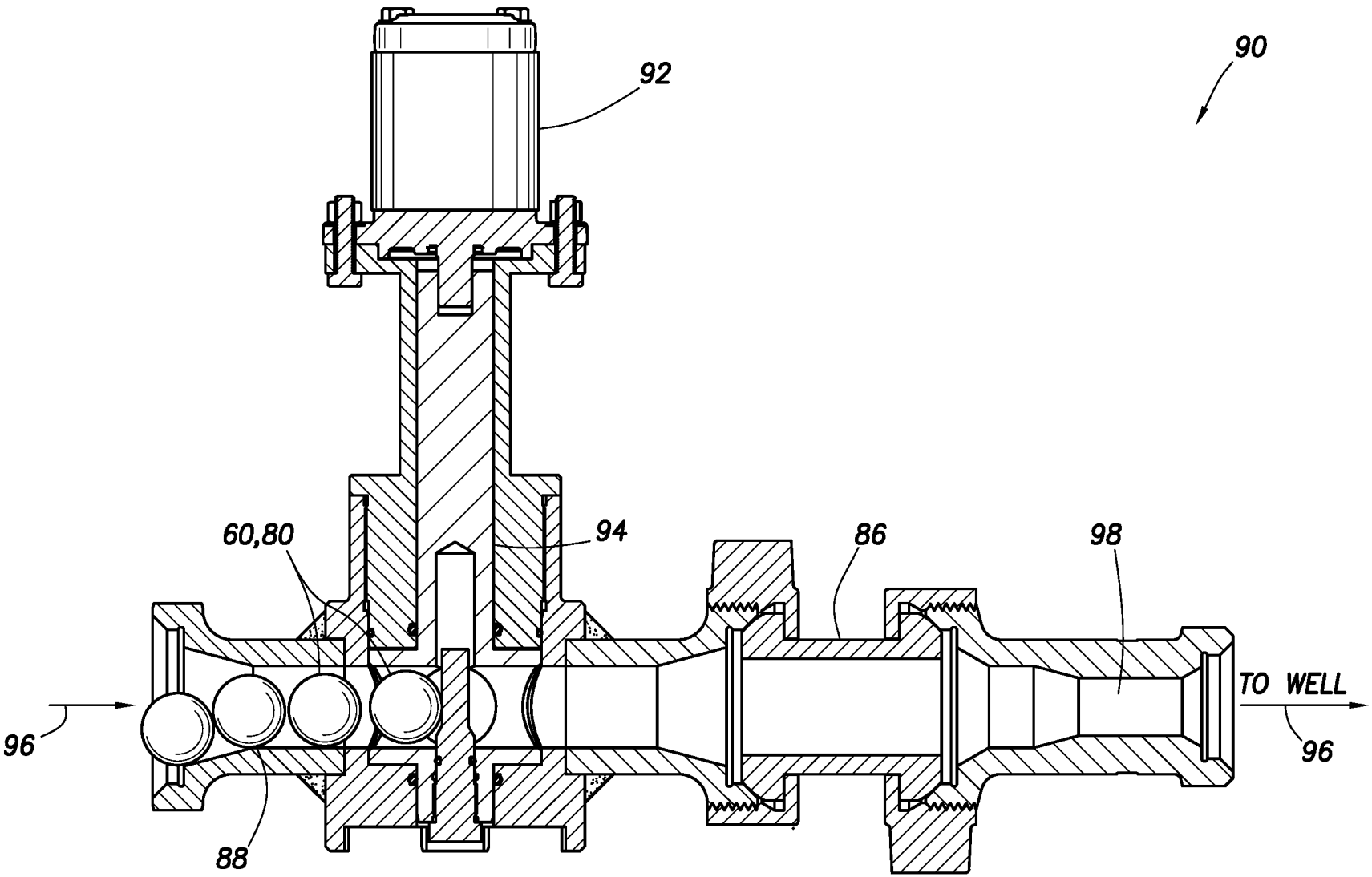
FIG. 10 is a representative cross-sectional view of an example of a deployment apparatus and method that can embody the principles of this disclosure.

Referring additionally now to FIG. 10, an example of a deployment apparatus 90 and an associated method are representatively illustrated. The apparatus 90 and method may be used with the system 10 and method described above, or they may be used with other systems and methods.

When used with the system 10, the apparatus 90 can be connected between the pump 34 and the casing valve 32 (see FIG. 1). Alternatively, the apparatus 90 can be "teed" into a pipe associated with the pump 34 and casing valve 32, or into a pipe associated with the pump 36 (for example, if the devices 60 are to be deployed via the tubular string 12). However configured, an output of the apparatus 90 is connected to the well, although the apparatus itself may be positioned a distance away from the well.

The apparatus 90 is used in this example to deploy the devices 60 into the well. The devices 60 may or may not be retained by the retainer 80 when they are deployed. However, in the FIG. 10 example, the devices 60 are depicted with the retainers 80 in the spherical shape of FIG. 8, for convenience of deployment. The retainer material 82 can be at least partially dispersed during the deployment, so that the devices 60 are more readily conveyed by the flow 74.

In certain situations, it can be advantageous to provide a certain spacing between the devices 60 during deployment, for example, in order to efficiently plug casing perforations. One reason for this is that the devices 60 will tend to first plug perforations that are receiving highest rates of flow.

In addition, if the devices 60 are deployed downhole too close together, some of them can become trapped between perforations, thereby wasting some of the devices. The excess "wasted" devices 60 might later interfere with other well operations.

To mitigate such problems, the devices 60 can be deployed with a selected spacing. The spacing may be, for example, on the order of the length of the perforation interval. The apparatus 90 is desirably capable of deploying the devices 60 with any selected spacing between the devices.

Each device 60 in this example has the retainer 80 in the form of a dissolvable coating material with a frangible coating 88 thereon, to impart a desired geometric shape (spherical in this example), and to allow for convenient deployment. The dissolvable retainer material 82 could be detrimental to the operation of the device 60 if it increases a drag coefficient of the device. A high coefficient of drag can cause the devices 60 to be swept to a lower end of the perforation interval, instead of sealing uppermost perforations.

The frangible coating 88 is used to prevent the dissolvable coating from dissolving during a queue time prior to deployment. Using the apparatus 90, the frangible coating 88 can be desirably broken, opened or otherwise damaged during the deployment process, so that the dissolvable coating is then exposed to fluids that can cause the coating to dissolve.

Examples of suitable frangible coatings include cementitious materials (e.g., plaster of Paris) and various waxes (e.g., paraffin wax, carnauba wax, vegetable wax, machinable wax). The frangible nature of a wax coating can be optimized for particular conditions by blending a less brittle wax (e.g., paraffin wax) with a more brittle wax (e.g., carnauba wax) in a certain ratio selected for the particular conditions.

As depicted in FIG. 10, the apparatus 90 includes a rotary actuator 92 (such as, a hydraulic or electric servo motor, with or without a rotary encoder). The actuator 92 rotates a sequential release structure 94 that receives each device 60 in turn from a queue of the devices, and then releases each device one at a time into a conduit 86 that is connected to the tubular string 72 (or the casing 16 or tubing 20 of FIG. 1).

Note that it is not necessary for the actuator 92 to be a rotary actuator, since other types of actuators (such as, a linear actuator) may be used in other examples. In addition, it is not necessary for only a single device 60 to be deployed at a time. In other examples, the release structure 94 could be configured to release multiple devices at a time. Thus, the scope of this disclosure is not limited to any particular details of the apparatus 90 or the associated method as described herein or depicted in the drawings.

In the FIG. 10 example, a rate of deployment of the devices 60 is determined by an actuation speed of the actuator 92. As a speed of rotation of the structure 94 increases, a rate of release of the devices 60 from the structure accordingly increases. Thus, the deployment rate can be conveniently adjusted by adjusting an operational speed of the actuator 92. This adjustment could be automatic, in response to well conditions, stimulation treatment parameters, flow rate variations, etc.

As depicted in FIG. 10, a liquid flow 96 enters the apparatus 90 from the left and exits on the right (for example, at about 1 barrel per minute). Note that the flow 96 is allowed to pass through the apparatus 90 at any position of the release structure 94 (the release structure is configured to permit flow through the structure at any of its positions).

When the release structure 94 rotates, one or more of the devices 60 received in the structure rotates with the structure. When a device 60 is on a downstream side of the release structure 94, the flow 96 though the apparatus 90 carries the device to the right (as depicted in FIG. 10) and into a restriction 98.

The restriction 98 in this example is smaller than the diameter of the device 60. The flow 96 causes the device 60 to be forced through the restriction 98, and the frangible coating 88 is thereby damaged, opened or fractured to allow the inner dissolvable material 82 of the retainer 80 to dissolve.

Other ways of opening, breaking or damaging a frangible coating may be used in keeping with the principles of this disclosure. For example, cutters or abrasive structures could contact an outside surface of a device 60 to penetrate, break, abrade or otherwise damage the frangible coating 88. Thus, this disclosure is not limited to any particular technique for damaging, breaking, penetrating or otherwise compromising a frangible coating.

Figure 11:
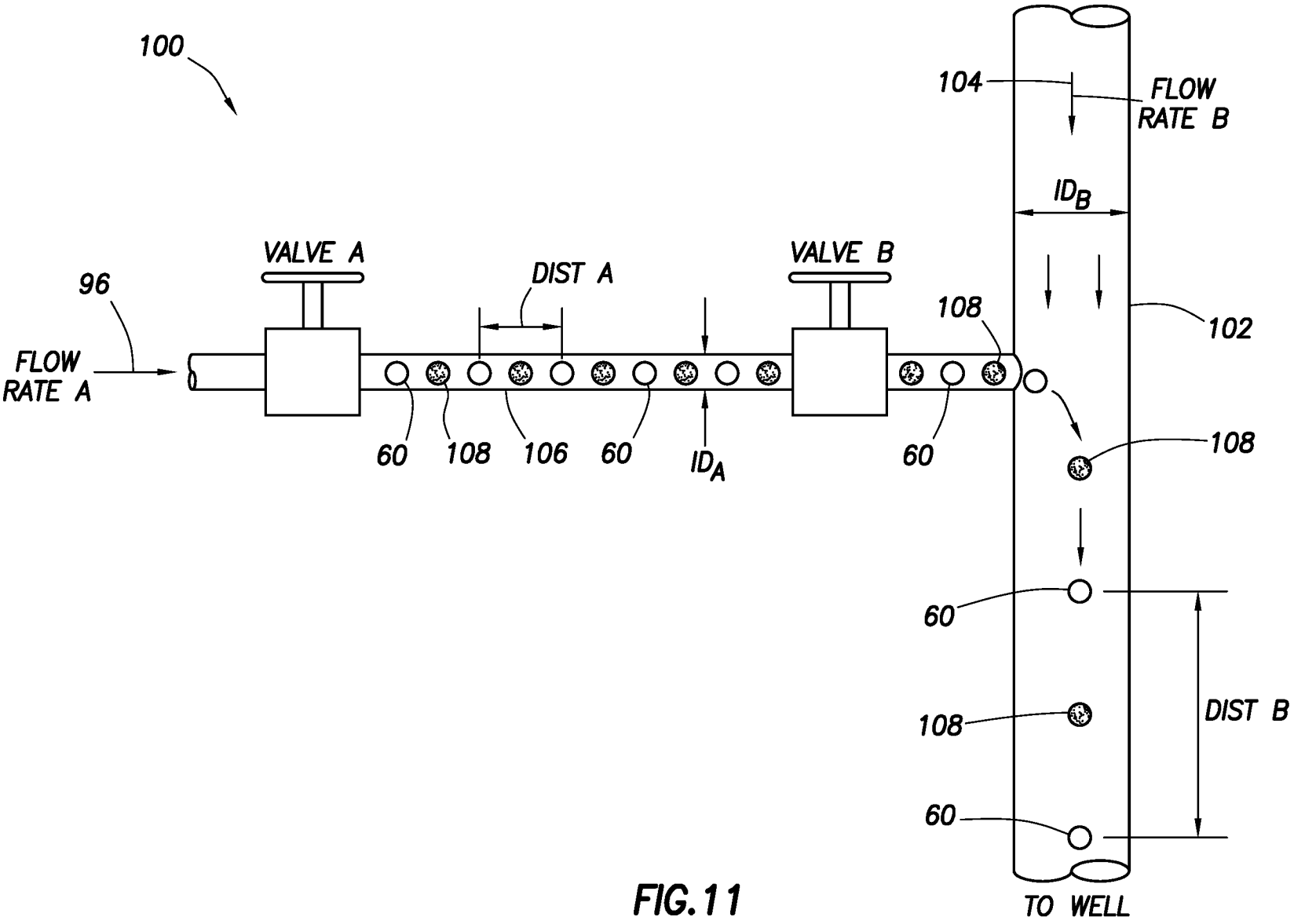
FIG. 11 is a representative schematic view of another example of a deployment apparatus and method that can embody the principles of this disclosure.

Referring additionally now to FIG. 11, another example of a deployment apparatus 100 and an associated method are representatively illustrated. The apparatus 100 and method may be used with the system 10 and method described above, or they may be used with other systems and methods.

In the FIG. 11 example, the devices 60 are deployed using two flow rates. Flow rate A through two valves (valves A & B) is combined with Flow rate B through a pipe 102 depicted as being vertical in FIG. 11 (the pipe may be horizontal or have any other orientation in actual practice).

The pipe 102 may be associated with the pump 34 and casing valve 32, or the pipe may be associated with the pump 36 if the devices 60 are to be deployed via the tubular string 12. In some examples, a separate pump (not shown) may be used to supply the flow 96 through the valves A & B.

Valve A is not absolutely necessary, but may be used to control a queue of the devices 60. When valve B is open the flow 96 causes the devices 60 to enter the vertical pipe 102. Flow 104 through the vertical pipe 102 in this example is substantially greater than the flow 96 through the valves A & B (that is, flow rate B>>flow rate A), although in other examples the flows may be substantially equal or otherwise related.

A spacing (dist. B) between the devices 60 when they are deployed into the well can be calculated as follows: dist. B=dist. A*($ID_A^2/ID_B^2$)*(flow rate B/flow rate A), where dist. A is a spacing between the devices 60 prior to entering the pipe 102, $ID_A$ is an inner diameter of a pipe 106 connected to the pipe 102, and ID, is an inner diameter of the pipe 102. This assumes circular pipes 102, 104. Where corresponding passages are non-circular, the term $ID_A^2/ID_B^2$ can be replaced by an appropriate ratio of passage areas.

The spacing between the plugging devices 60 in the well (dist. B) can be automatically controlled by varying one or both of the flow rates A,B. For example, the spacing can be increased by increasing the flow rate B or decreasing the flow rate A. The flow rate(s) A,B can be automatically adjusted in response to changes in well conditions, stimulation treatment parameters, flow rate variations, etc.

In some examples, flow rate A can have a practical minimum of about ½ barrel per minute. In some circumstances, the desired deployment spacing (dist. B) may be greater than what can be produced using a convenient spacing dist. A of the devices 60 and the flow rate A in the pipe 106.

The deployment spacing B may be increased by adding spacers 108 between the devices 60 in the pipe 106. The spacers 108 effectively increase the distance A between the devices 60 in the pipe 106 (and, thus, increase the value of dist. A in the equation above).

The spacers 108 may be dissolvable or otherwise dispersible, so that they dissolve or degrade when they are in the pipe 102 or thereafter. In some examples, the spacers 108 may be geometrically the same as, or similar to, the devices 60.

Note that the apparatus 100 may be used in combination with the restriction 98 of FIG. 10 (for example, with the restriction 98 connected downstream of the valve B but upstream of the pipe 102). In this manner, a frangible or other protective coating on the devices 60 and/or spacers 108 can be opened, broken or otherwise damaged prior to the devices and spacers entering the pipe 102.

Figure 12:
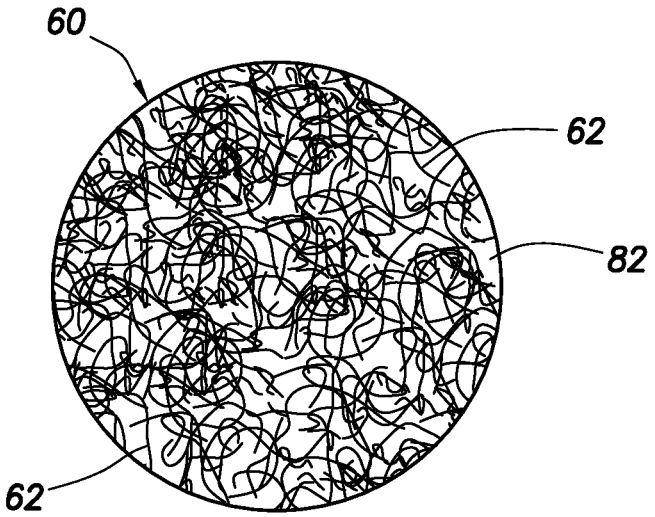
FIGS. 12 & 13 are representative cross-sectional views of additional examples of the flow conveyed device.
Figure 13:
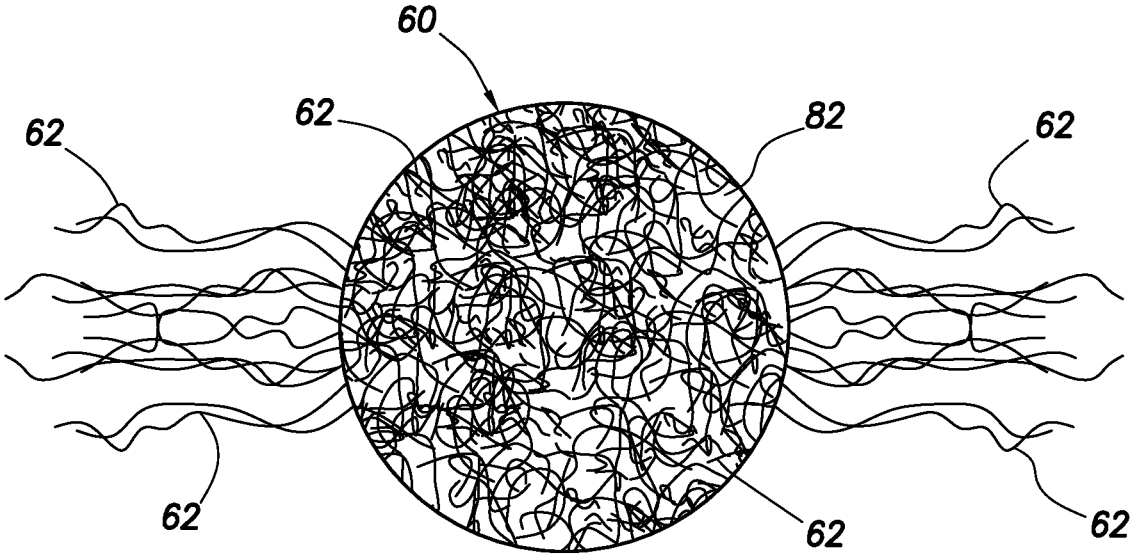

Referring additionally now to FIG. 12, a cross-sectional view of another example of the device 60 is representatively illustrated. The device 60 may be used in any of the systems and methods described herein, or may be used in other systems and methods.

In this example, the body of the device 60 is made up of filaments or fibers 62 formed in the shape of a ball or sphere. Of course, other shapes may be used, if desired.

The filaments or fibers 62 may make up all, or substantially all, of the device 60. The fibers 62 may be randomly oriented, or they may be arranged in various orientations as desired.

In the FIG. 12 example, the fibers 62 are retained by the dissolvable, degradable or dispersible material 82. In addition, a frangible coating may be provided on the device 60, for example, in order to delay dissolving of the material 82 until the device has been deployed into a well (as in the example of FIG. 10).

The device 60 of FIG. 12 can be used in a diversion fracturing operation (in which perforations receiving the most fluid are plugged to divert fluid flow to other perforations), in a re-completion operation (e.g., as in the FIGS. 2A-D example), or in a multiple zone perforate and fracture operation (e.g., as in the FIGS. 3A-D example).

One advantage of the FIG. 12 device 60 is that it is capable of sealing on irregularly shaped openings, perforations, leak paths or other passageways. The device 60 can also tend to "stick" or adhere to an opening, for example, due to engagement between the fibers 62 and structure surrounding (and in) the opening. In addition, there is an ability to selectively seal openings.

The fibers 62 could, in some examples, comprise wool fibers. The device 60 may be reinforced (e.g., using the material 82 or another material) or may be made entirely of fibrous material with a substantial portion of the fibers 62 randomly oriented.

The fibers 62 could, in some examples, comprise metal wool, or crumpled and/or compressed wire. Wool may be retained with wax or other material (such as the material 82) to form a ball, sphere, cylinder or other shape.

In the FIG. 12 example, the material 82 can comprise a wax (or eutectic metal or other material) that melts at a selected predetermined temperature. A wax device 60 may be reinforced with fibers 62, so that the fibers and the wax (material 82) act together to block a perforation or other passageway.

The selected melting point can be slightly less than a static wellbore temperature. The wellbore temperature during fracturing is typically depressed due to relatively low temperature fluids entering wellbore. After fracturing, wellbore temperature will typically increase, thereby melting the wax and releasing the reinforcement fibers 62.

Figure 14:
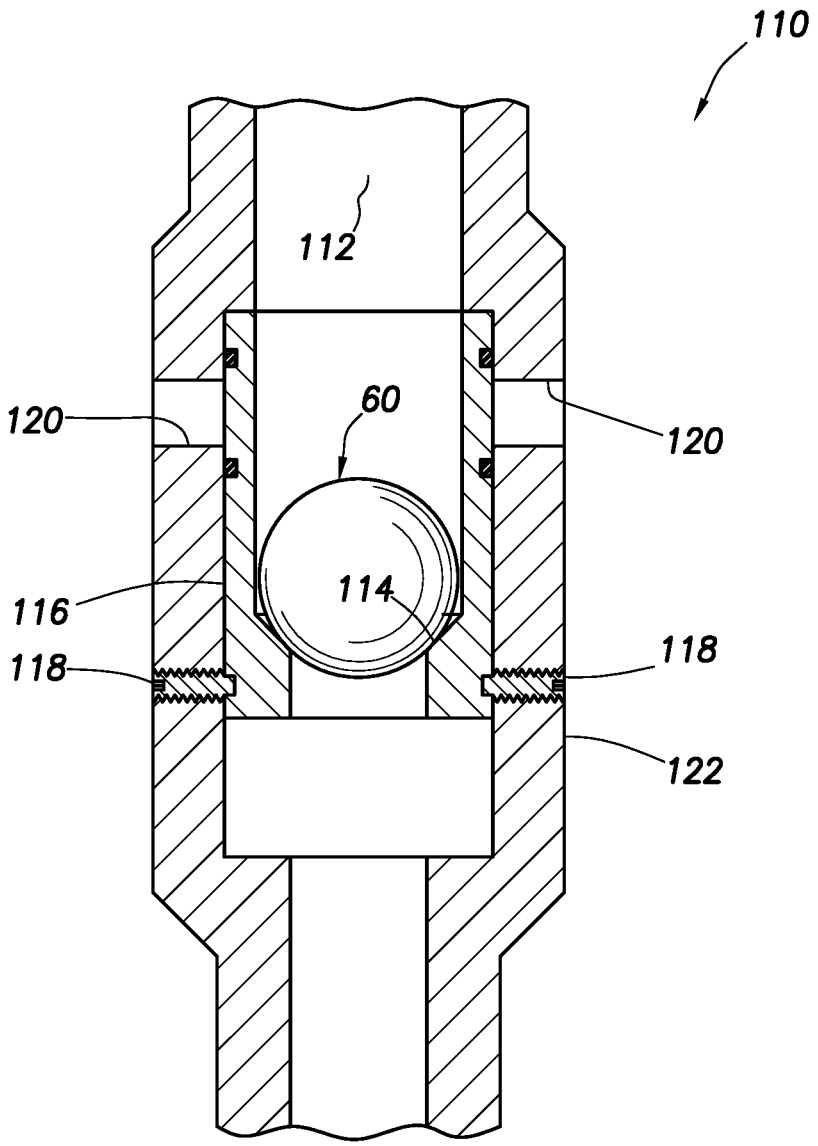
FIG. 14 is a representative cross-sectional view of a well tool that may be operated using the flow conveyed device.

This type of device 60 in the shape of a ball or other shapes may be used to operate downhole tools in a similar fashion. In FIG. 14, a well tool 110 is depicted with a passageway 112 extending longitudinally through the well tool. The well tool 110 could, for example, be connected in the casing 16 of FIG. 1, or it could be connected in another tubular string (such as a production tubing string, the tubular string 12, etc.).

The device 60 is depicted in FIG. 14 as being sealingly engaged with a seat 114 formed in a sliding sleeve 116 of the well tool 110. When the device 60 is so engaged in the well tool 110 (for example, after the well tool is deployed into a well and appropriately positioned), a pressure differential may be produced across the device and the sliding sleeve 116, in order to shear frangible members 118 and displace the sleeve downward (as viewed in FIG. 14), thereby allowing flow between the passageway 112 and an exterior of the well tool 110 via openings 120 formed through an outer housing 122.

The material 82 of the device 60 can then dissolve, disperse or otherwise degrade to thereby permit flow through the passageway 112. Of course, other types of well tools (such as, packer setting tools, frac plugs, testing tools, etc.) may be operated or actuated using the device 60 in keeping with the scope of this disclosure.

A drag coefficient of the device 60 in any of the examples described herein may be modified appropriately to produce a desired result. For example, in a diversion fracturing operation, it is typically desirable to block perforations at a certain location in a wellbore. The location is usually at the perforations taking the most fluid.

Natural fractures in an earth formation penetrated by the wellbore make it so that certain perforations receive a larger portion of fracturing fluids. For these situations and others, the device 60 shape, size, density and other characteristics can be selected, so that the device tends to be conveyed by flow to a certain corresponding section of the wellbore.

For example, devices 60 with a larger coefficient of drag (Cd) may tend to seat more toward a toe of a generally horizontal or lateral wellbore. Devices 60 with a smaller Cd may tend to seat more toward a heel of the wellbore. For example, if the wellbore 14 depicted in FIG. 2B is horizontal or highly deviated, the heel would be at an upper end of the illustrated wellbore, and the toe would be at the lower end of the illustrated wellbore (e.g., the direction of the fluid flow 44 is from the heel to the toe).

Smaller devices 60 with long fibers 62 floating freely (see the example of FIG. 13) may have a strong tendency to seat at or near the heel. A diameter of the device 60 and the free fiber 62 length can be appropriately selected, so that the device is more suited to stopping and sealingly engaging perforations anywhere along the length of the wellbore.

Acid treating operations can benefit from use of the device 60 examples described herein. Pumping friction causes hydraulic pressure at the heel to be considerably higher than at the toe. This means that the fluid volume pumped into a formation at the heel will be considerably higher than at the toe. Turbulent fluid flow increases this effect. Gelling additives might reduce an onset of turbulence and decrease the magnitude of the pressure drop along the length of the wellbore.

Higher initial pressure at the heel allows zones to be acidized and then plugged starting at the heel, and then progressively down along the wellbore. This mitigates waste of acid from attempting to acidize all of the zones at the same time.

The free fibers 62 of the FIGS. 4-6B & 13 examples greatly increase the ability of the device 60 to engage the first open perforation (or other leak path) it encounters. Thus, the devices 60 with low Cd and long fibers 62 can be used to plug from upper perforations to lower perforations, while turbulent acid with high frictional pressure drop is used so that the acid treats the unplugged perforations nearest the top of the wellbore with acid first.

In examples of the device 60 where a wax material (such as the material 82) is used, the fibers 62 (including the body 64, lines 66, knots, etc.) may be treated with a treatment fluid that repels wax (e.g., during a molding process). This may be useful for releasing the wax from the fibrous material after fracturing or otherwise compromising the retainer 80 and/or a frangible coating thereon.

Suitable release agents are water-wetting surfactants (e.g., alkyl ether sulfates, high hydrophilic-lipophilic balance (HLB) nonionic surfactants, betaines, alkyarylsulfonates, alkyldiphenyl ether sulfonates, alkyl sulfates). The release fluid may also comprise a binder to maintain the knot or body 64 in a shape suitable for molding. One example of a binder is a polyvinyl acetate emulsion.

Broken-up or fractured devices 60 can have lower Cd. Broken-up or fractured devices 60 can have smaller cross-sections and can pass through the annulus 30 between tubing 20 and casing 16 more readily.

The restriction 98 (see FIG. 10) may be connected in any line or pipe that the devices 60 are pumped through, in order to cause the devices to fracture as they pass through the restriction. This may be used to break up and separate devices 60 into wax and non-wax parts. The restriction 98 may also be used for rupturing a frangible coating covering a soluble wax material 82 to allow water or other well fluids to dissolve the wax.

Fibers 62 may extend outwardly from the device 60, whether or not the body 64 or other main structure of the device also comprises fibers. For example, a ball (or other shape) made of any material could have fibers 62 attached to and extending outwardly therefrom. Such a device 60 will be better able to find and cling to openings, holes, perforations or other leak paths near the heel of the wellbore, as compared to the ball (or other shape) without the fibers 62.

For any of the device 60 examples described herein, the fibers 62 may not dissolve, disperse or otherwise degrade in the well. In such situations, the devices 60 (or at least the fibers 62) may be removed from the well by swabbing, scraping, circulating, milling or other mechanical methods.

In situations where it is desired for the fibers 62 to dissolve, disperse or otherwise degrade in the well, nylon is a suitable acid soluble material for the fibers. Nylon 6 and nylon 66 are acid soluble and suitable for use in the device 60. At relatively low well temperatures, nylon 6 may be preferred over nylon 66, because nylon 6 dissolves faster or more readily.

Self-degrading fiber devices 60 can be prepared from poly-lactic acid (PLA), poly-glycolic acid (PGA), or a combination of PLA and PGA fibers 62. Such fibers 62 may be used in any of the device 60 examples described herein.

Fibers 62 can be continuous monofilament or multifilament, or chopped fiber. Chopped fibers 62 can be carded and twisted into yarn that can be used to prepare fibrous flow conveyed devices 60.

The PLA and/or PGA fibers 62 may be coated with a protective material, such as calcium stearate, to slow its reaction with water and thereby delay degradation of the device 60. Different combinations of PLA and PGA materials may be used to achieve corresponding different degradation times or other characteristics.

PLA resin can be spun into fiber of 1-15 denier, for example. Smaller diameter fibers 62 will degrade faster. Fiber denier of less than 5 may be most desirable. PLA resin is commercially available with a range of melting points (e.g., 60 to 185° C.). Fibers 62 spun from lower melting point PLA resin can degrade faster.

PLA bi-component fiber has a core of high-melting point PLA resin and a sheath of low-melting point PLA resin (e.g., 60° C. melting point sheath on a 130° C. melting point core). The low-melting point resin can hydrolyze more rapidly and generate acid that will accelerate degradation of the high-melting point core. This may enable the preparation of a plugging device 60 that will have higher strength in a wellbore environment, yet still degrade in a reasonable time. In various examples, a melting point of the resin can decrease in a radially outward direction in the fiber.

Figure 15:
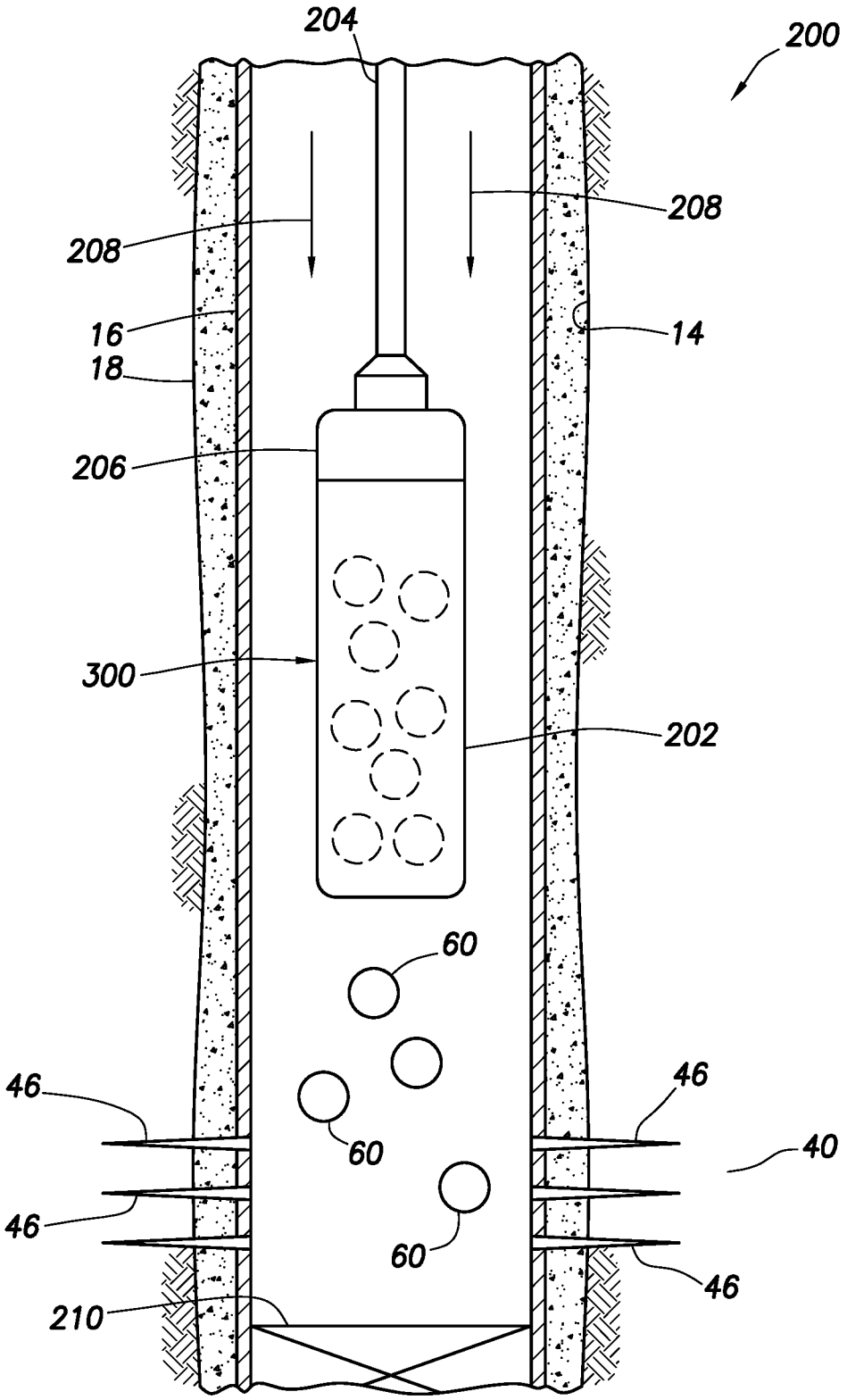
FIG. 15 is a representative partially cross-sectional view of a plugging device dispensing system that can embody the principles of this disclosure.

Referring additionally now to FIG. 15, a system 200 and associated method for dispensing the plugging devices 60 into the wellbore 14 is representatively illustrated. In this system 200, the plugging devices 60 are not discharged into the wellbore 14 at the surface and conveyed to a desired plugging location (such as perforations 38, 46*a-c*, 46 in the examples of FIGS. 2A-3D or the opening 68 in the example of FIGS. 6A & B) by fluid flow 44, 74, 96, 104. Instead, the plugging devices 60 are contained in a container 202, the container is conveyed by a conveyance 204 to a desired downhole location, and the plugging devices are released from the container at the downhole location.

A variety of different containers 202 for the plugging devices 60 are described below and depicted in FIGS. 16A-42B. However, it should be clearly understood that the scope of this disclosure is not limited to any particular type or configuration of the container 202.

An actuator 206 may be provided for releasing or forcibly discharging the plugging devices 60 from the container 202 when desired. The container 202 and the actuator 206 may be combined into a dispenser tool 300 for dispensing the plugging devices 60 in the well at a downhole location. A variety of different actuators 206 are described below and depicted in the drawings, however, it is not necessary for an actuator to be provided, or for any particular type or configuration of actuator to be provided.

The conveyance 204 could be any type suitable for transporting the container 202 to the desired downhole location. Examples of conveyances include wireline, slickline, coiled tubing, jointed tubing, autonomous or wired tractor, etc.

In some examples, the container 202 could be displaced by fluid flow 208 through the wellbore 14. The fluid flow 208 could be any of the fluid flows 44, 74, 96, 104 described above. The fluid flow 208 could comprise a treatment fluid, such as a stimulation fluid (for example, a fracturing and/or acidizing fluid), an inhibitor (for example, to inhibit formation of paraffins, asphaltenes, scale, etc.) and/or a remediation treatment (for example, to remediate damage due to scale, clays, polymer, etc., buildup in the well).

In the FIG. 15 example, the plugging devices 60 are released from the container 202 above a packer, bridge plug, wiper plug or other type of plug 210 previously set in the wellbore 14. In other examples, the plugging devices 60 could be released above a previously plugged valve, such as the valve 110 example of FIG. 14.

Note that it is not necessary in keeping with the scope of this disclosure for the plugging devices 60 to be released into the wellbore 14 above any packer, plug 210 or other flow blockage in the wellbore.

As depicted in FIG. 15, the plugging devices 60 will be conveyed by the flow 208 into sealing engagement with the perforations 46 above the plug 210. In other examples, the plugging devices 60 could block flow through other types of openings (e.g., openings in tubulars other than casing 16, flow passages in well tools such as the valve 110, etc.). Thus, the scope of this disclosure is not limited to use of the container 202 to release the plugging devices 60 for plugging the perforations 46.

The plugging devices 60 depicted in FIG. 15 are similar to those of the FIG. 12 example, and are spherically shaped. These plugging devices 60 are also depicted in the other examples of the system 200 and container 202 of FIGS. 16A-42B for convenience. However, any of the plugging devices 60 described herein may be used with any of the system 200 and container 202 examples, and the scope of this disclosure is not limited to use of any particular configuration, type or shape of the plugging devices.

Although only release of the plugging devices 60 from the container 202 is described herein and depicted in the drawings, other plugging substances, devices or materials may also be released downhole from the container 208 (or another container) into the wellbore 14 in other examples. A material (such as, calcium carbonate, PLA or PGA particles) may be released from the container 208 and conveyed by the flow 208 into any gaps between the devices 60 and the openings to be plugged, so that a combination of the devices and the materials completely blocks flow through the openings.

Referring additionally now to FIGS. 16A-18B, an example of the dispensing tool 300 is representatively illustrated in various stages of actuation. The dispensing tool 300 may be used in the system 200 and method of FIG. 15, or it may be used with other systems or methods in keeping with the scope of this disclosure.

Figure 16A:
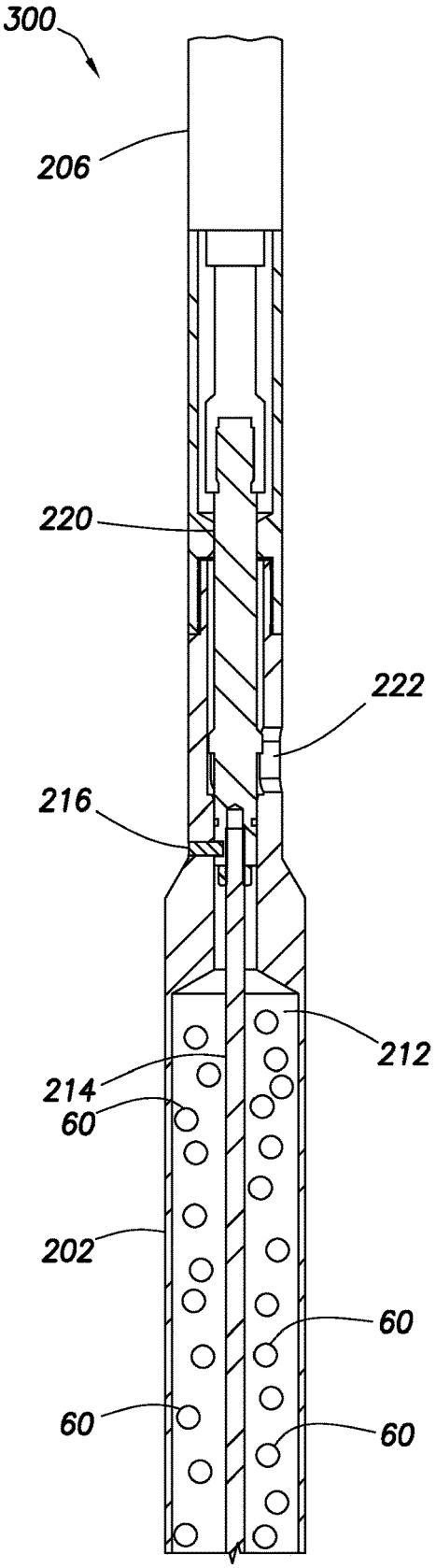
FIGS. 16A-42B are representative views of examples of dispensing tools that may be used with the dispensing system of FIG. 15.
Figure 16B:
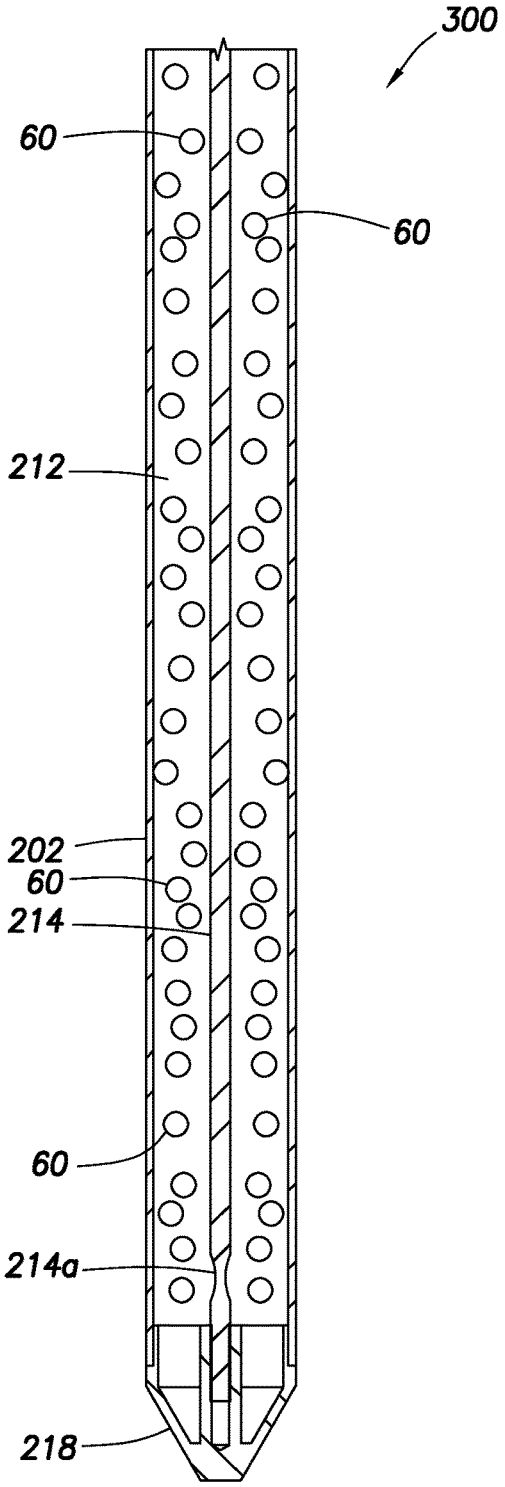

In this example, the tool 300 is actuated using a linear actuator 206 connected at an upper end of the container 202. A portion of the actuator 206 is depicted in FIGS. 16A & B, but is not depicted in FIGS. 17A-18B for convenience.

Any linear actuator 206 having sufficient force and stroke length can be used. Suitable examples include standard wireline plug setting tools (such as, those operated using an ignited propellant (e.g., the common setting tool marketed by Baker Oil Tools of Houston, Tex. USA), an electric actuator, or an electro-hydraulic actuator, etc.), hydraulic coiled tubing plug setting tools, or any hydraulic actuator (for example, using differential pressure or hydrostatic pressure to generate a force, etc.).

The plugging devices 60 are contained inside a chamber 212 of the container 202. A rod 214 is retained by a shear pin 216. The rod 214 connects an end closure 218 to a mandrel 220. The mandrel 220 is connected to the linear actuator 206.

Figure 17A:
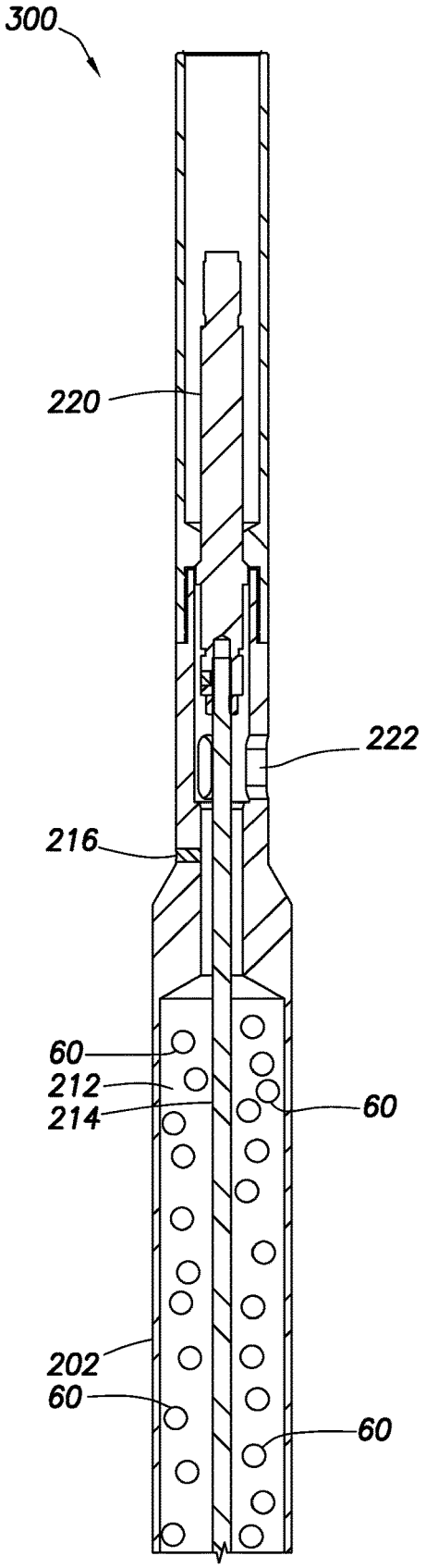
Figure 17B:
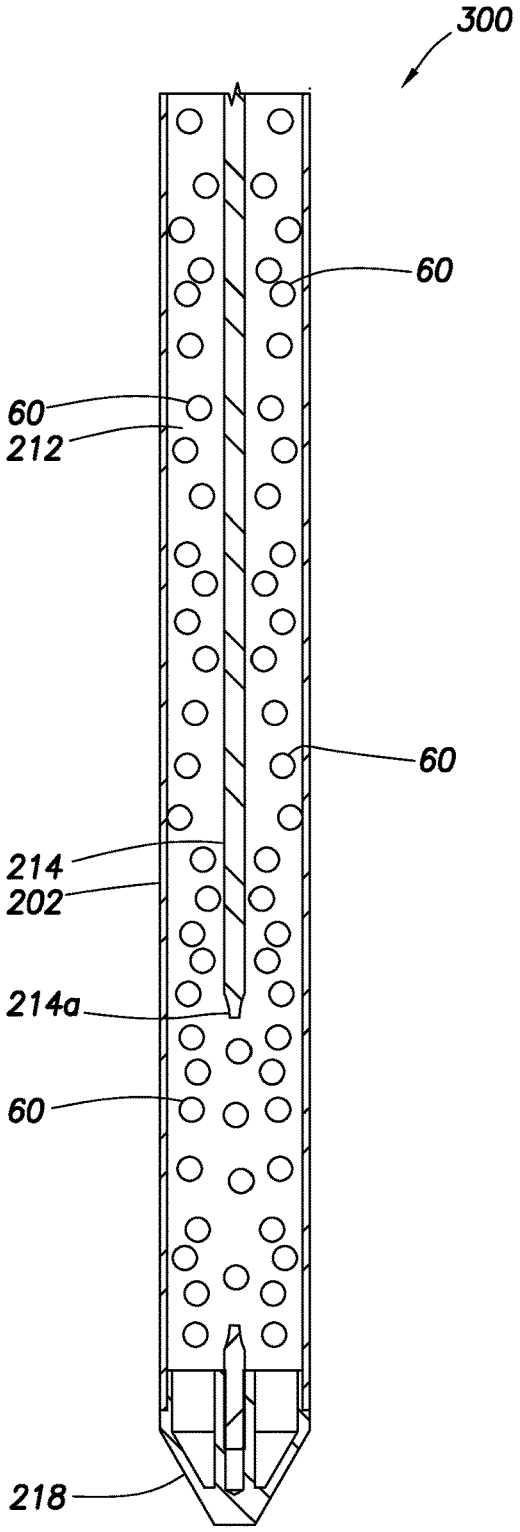

When the actuator 206 is operated as depicted in FIGS. 17A & B, the shear pin 216 is sheared, and the rod 214 experiences a tensile load. When sufficient tensile load is exerted on the rod 214 by the actuator 206, a reduced cross-section portion 214*a* of the rod is parted, thereby releasing the end closure 218 from the chamber 212.

Figure 18A:
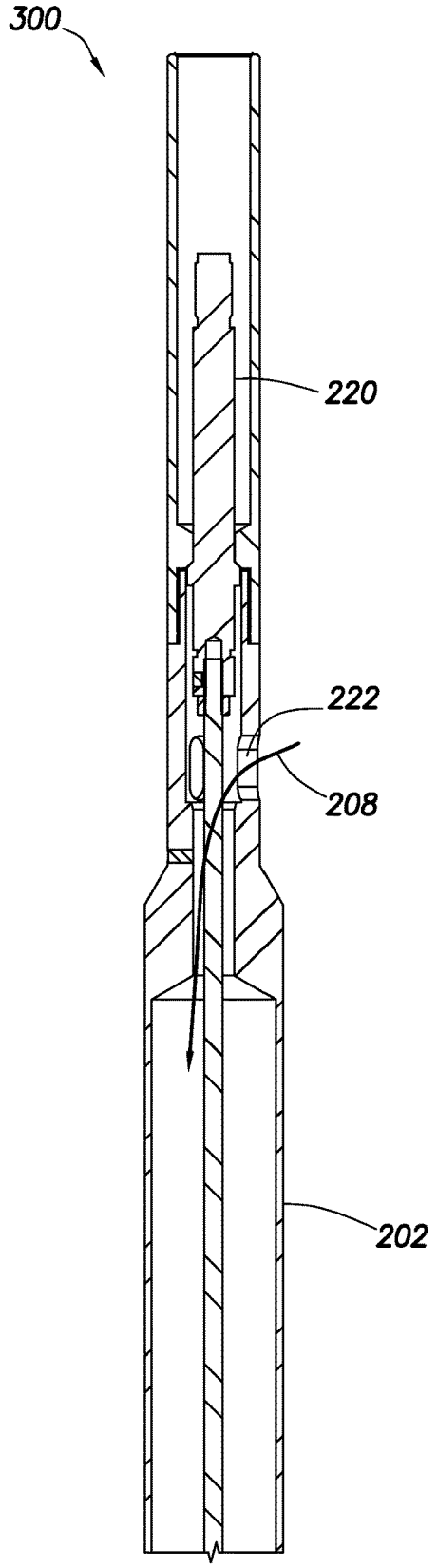
Figure 18B:
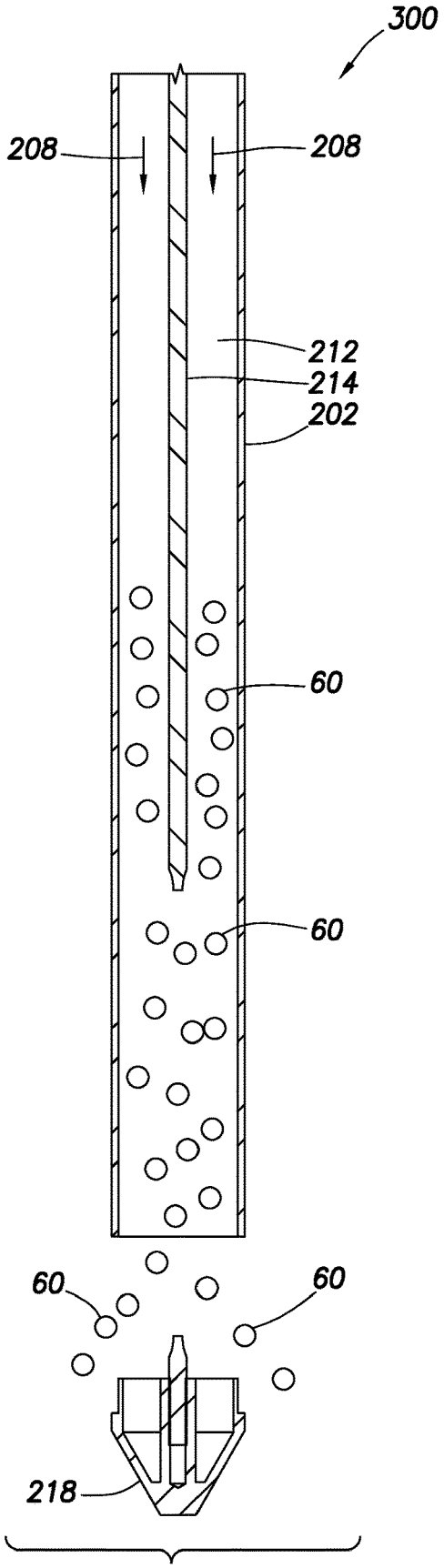

As depicted in FIGS. 18A & B, the end closure 218 can separate from the container 202 and thereby allow the plugging devices 60 to be released from the chamber 212. The end closure 218 can be made of a frangible or dissolvable material, so that it does not interfere with subsequent well operations.

Additionally, when the mandrel 220 is displaced upward by the actuator 206, a flow path 222 at a top of the container 202 is opened. The fluid flow 208 can enter the flow path 222, and assist in separating the end closure 218 from the container 202 and displacing the plugging devices 60 from the chamber 212. Alternatively, the tool 300 can be displaced upward in the wellbore 14, to thereby create a differential pressure from the top of the chamber 212 to the bottom of the chamber.

The plugging devices 60 and any fluid and/or other material in the chamber 212 will be ejected from the container 202. A rate at which the chamber 212 contents are ejected is dependent on the flow rate and other properties of the fluid flow 208, or on the rate of displacement of the tool 30 through the wellbore 14. Thus, these rates can be conveniently varied to thereby achieve a desired spacing of the plugging devices 60 along the wellbore 14.

Referring additionally now to FIGS. 19A-21B, another example of the dispensing tool 300 is representatively illustrated in various stages of actuation. This example is similar in many respects to the FIGS. 16A-18B example. However, instead of the rod 214 parting in response to tension applied by the actuator 206, the end closure 218 breaks and thereby allows the plugging devices 60 to be released from the chamber 212.

Figure 19A:
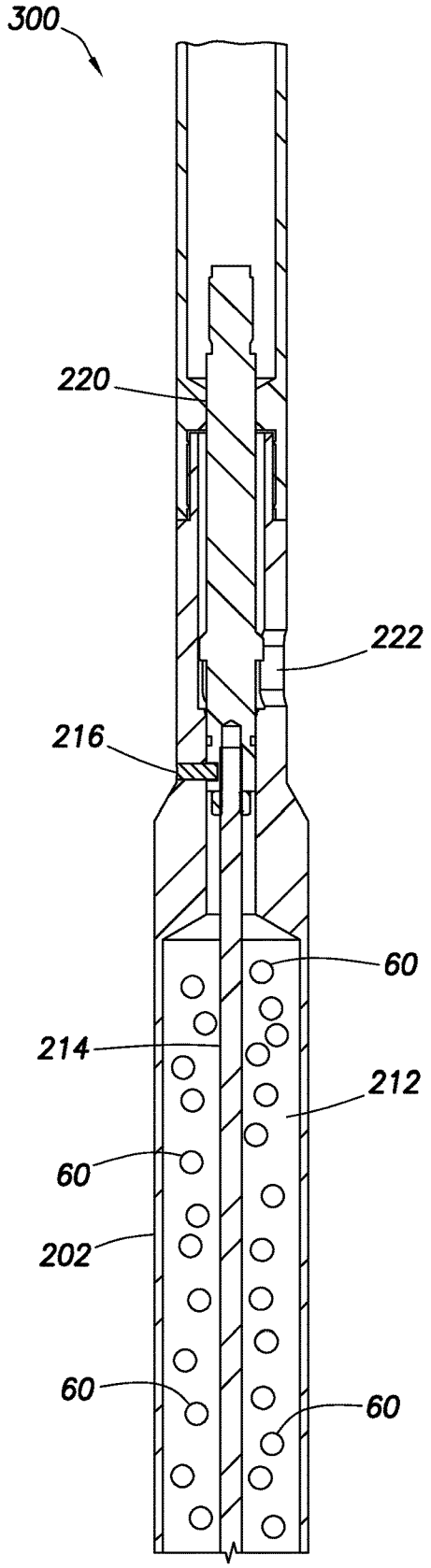
Figure 19B:
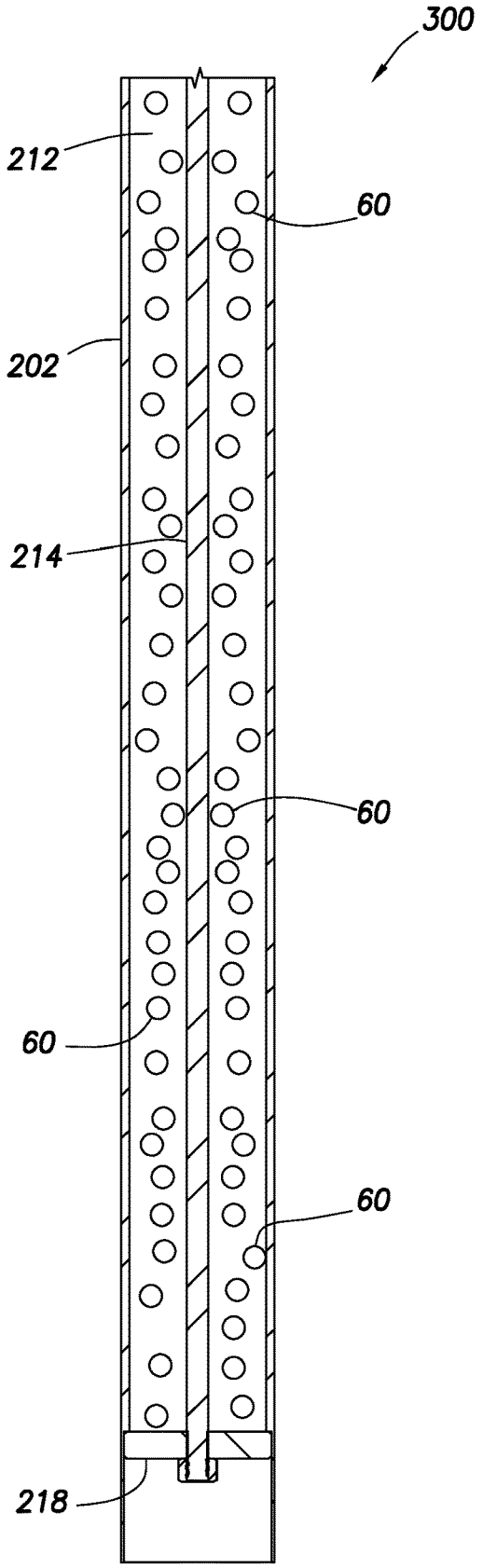

In FIGS. 19A & B, the tool 300 is in a run-in configuration. The end closure 218, which is made of a frangible material, closes off a lower end of the chamber 212.

Figure 20A:
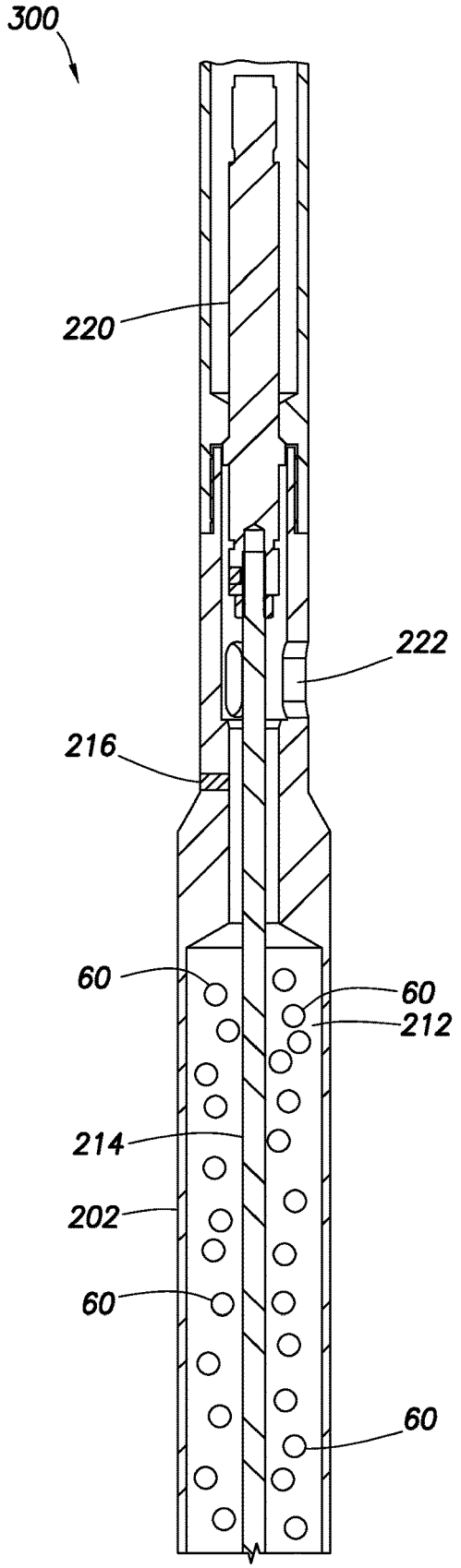
Figure 20B:
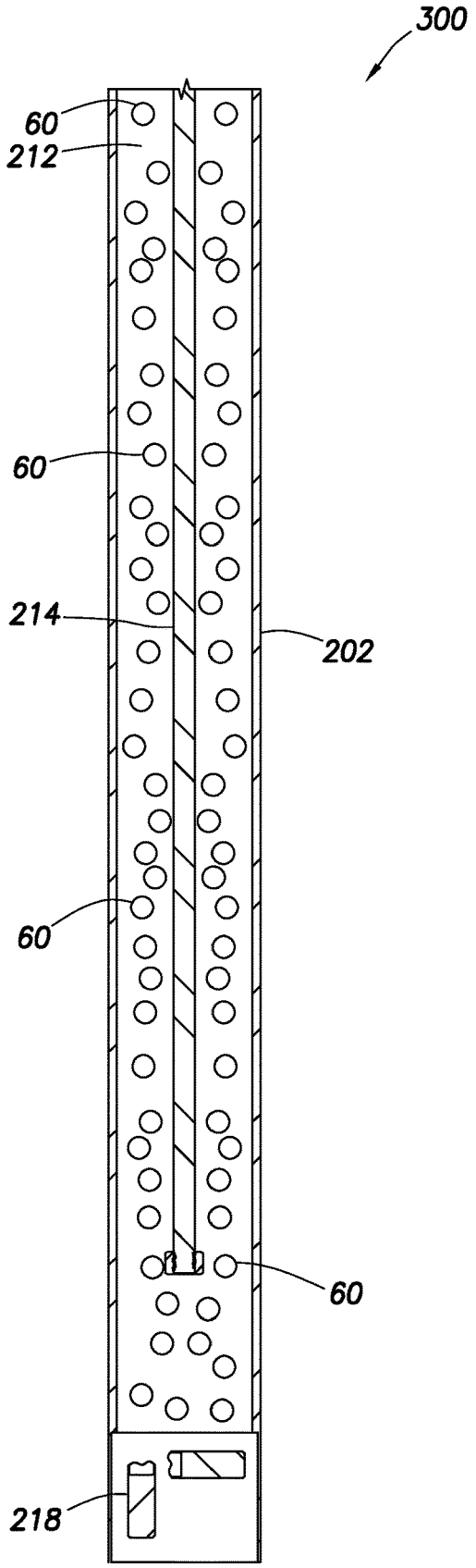

In FIGS. 20A & B, the actuator 206 has displaced the mandrel 220 and rod 214 upward. This upward displacement of the rod 214 causes the end closure 218 to break.

Figure 21A:
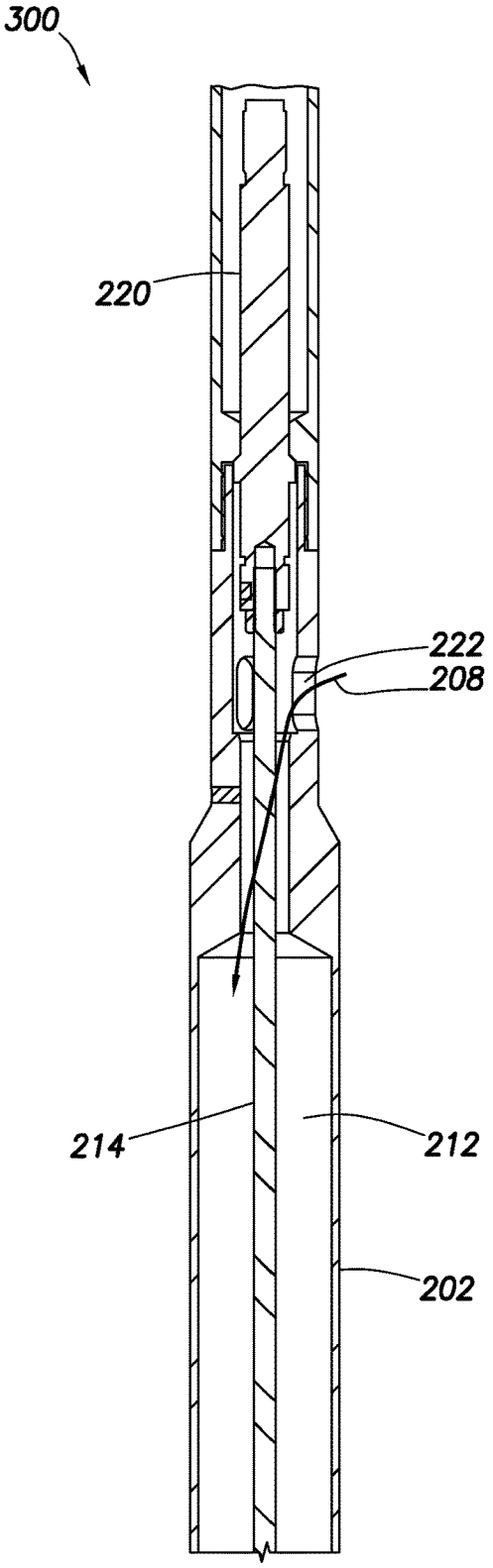
Figure 21B:
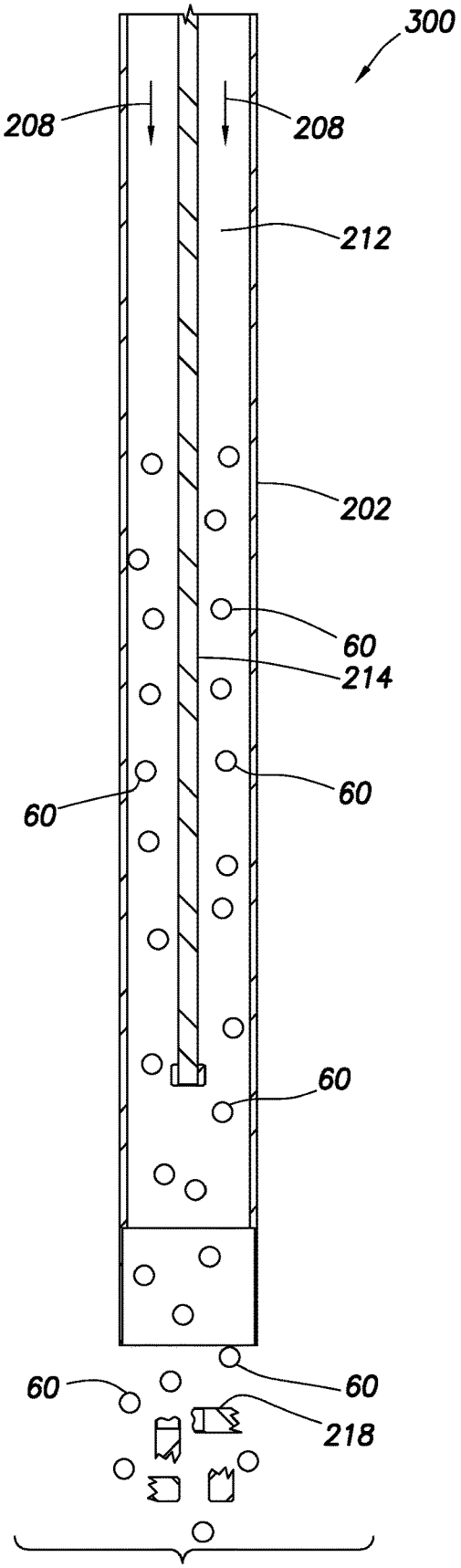

In FIGS. 21A & B, fluid flow 208 into the open flow path 222 (or upward displacement of the tool 300 in the wellbore 14) acts to discharge the plugging devices 60, and any fluid or other material, from the container 202.

Referring additionally now to FIGS. 22A-23B, another example of the tool 30 is representatively illustrated. In this example, the plugging devices 60 are initially contained in a separate cartridge 224 that is reciprocably received in the container 202. The cartridge 224 can be "pre-loaded" with the plugging devices 60, thereby making it convenient to prepare the tool 300 for use in a well.

Figure 22A:
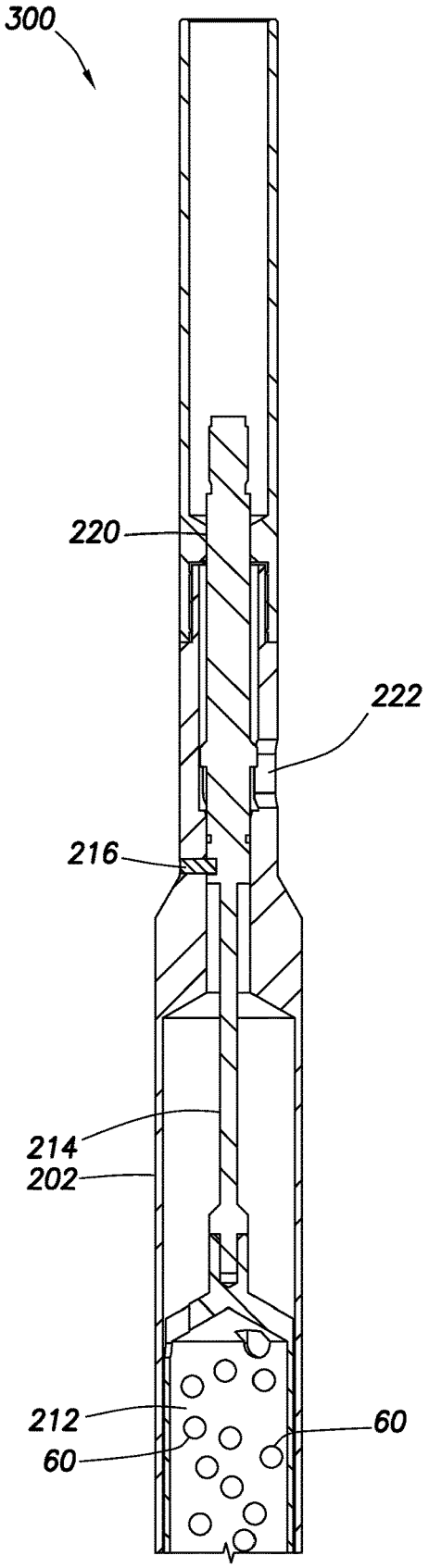
Figure 22B:
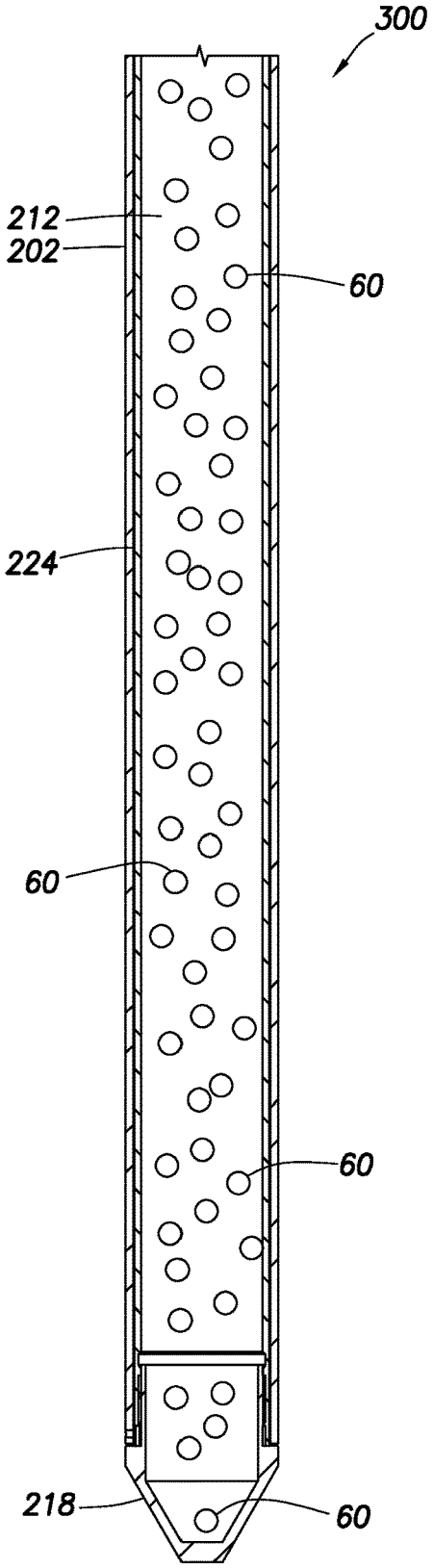

The rod 214 is connected to an upper end of the cartridge 224, and the end closure 218 closes off a lower end of the cartridge. In FIGS. 22A & B, the tool 300 is in a run-in configuration. The end closure 218 is secured to the cartridge 224 and is shouldered up against a lower end of the container 202.

Figure 23A:
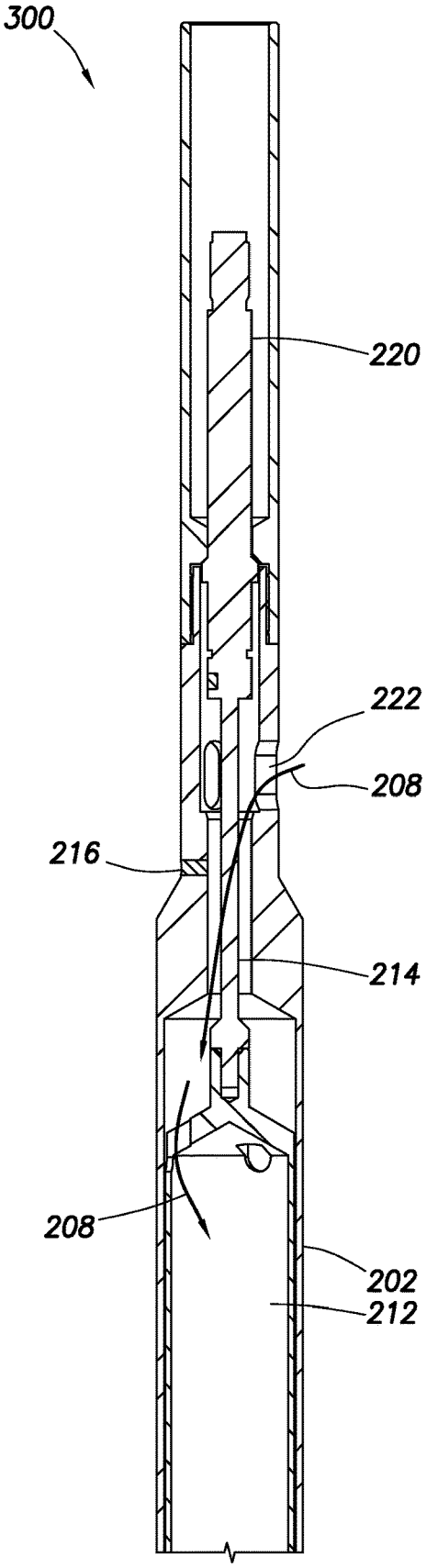
Figure 23B:
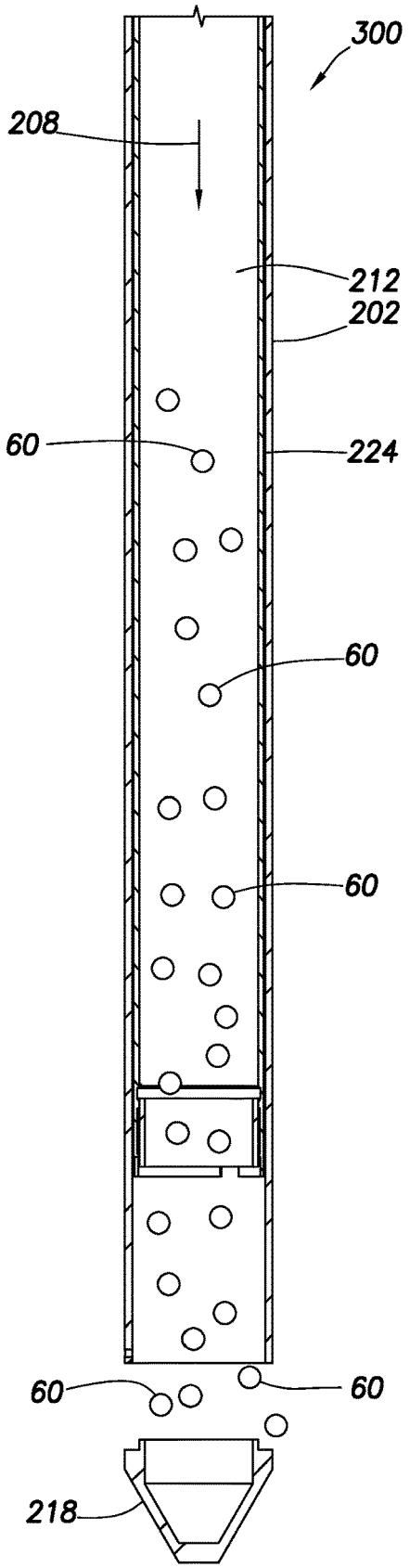

In FIGS. 23A & B, the actuator 206 has displaced the mandrel 220, rod 214 and cartridge 224 upward. The tensile force exerted by the actuator 206 has sheared the end closure 218 from the cartridge 224, thereby opening the lower end of the cartridge and container 202. The flow path 22 is also opened, so the fluid flow 208 (or upward displacement of the tool 300 in the wellbore 14) can displace the plugging devices 60, and any associated fluid and material, out of the container 202 and into the wellbore 14.

Referring additionally now to FIGS. 24A-25B, another example of the tool 300 is representatively illustrated. In this example, the end closure 218 is not necessarily frangible, but is instead flexible in a manner allowing the lower end of the container 202 to be opened in response to upward displacement of the rod 214 by the actuator 206.

Figure 24A:
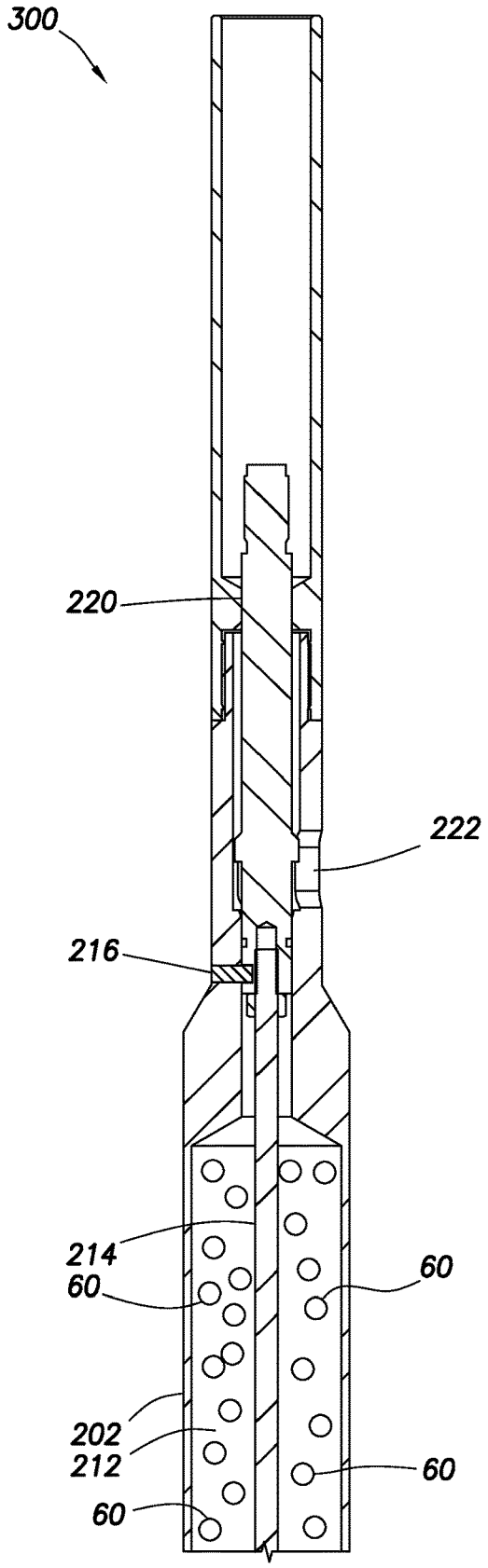
Figure 24B:
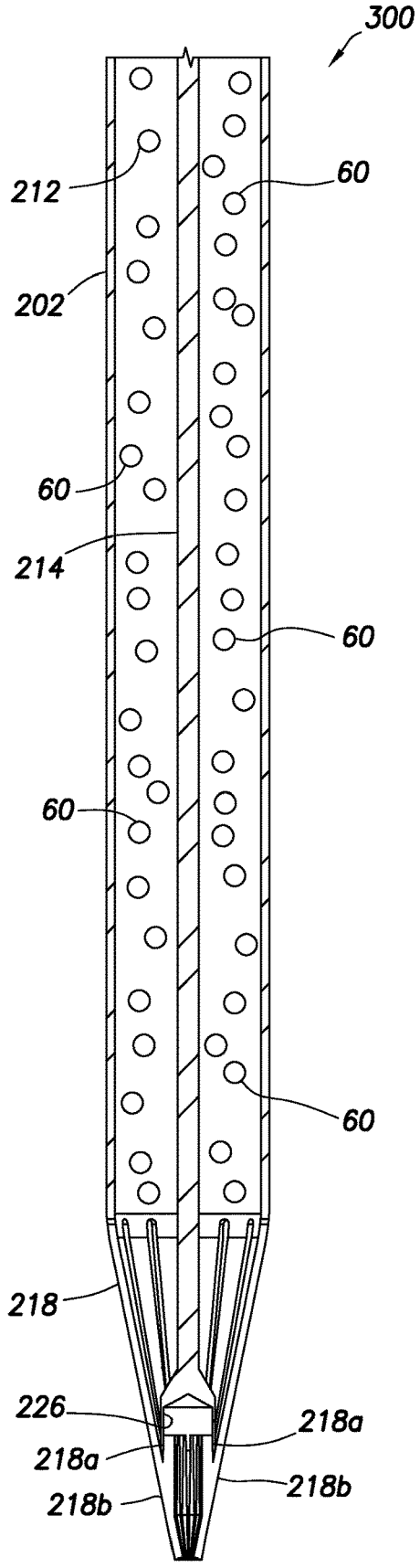

In FIGS. 24A & B, the tool 300 is in a run-in configuration. A radially enlarged recess 226 at a lower end of the rod 214 receives inwardly extending projections 218*a* of the end closure 218, which is separated into multiple elongated, resilient collets 218*b*. Thus, the collets 218*b* are maintained in an inwardly flexed condition by the rod 214.

Figure 25A:
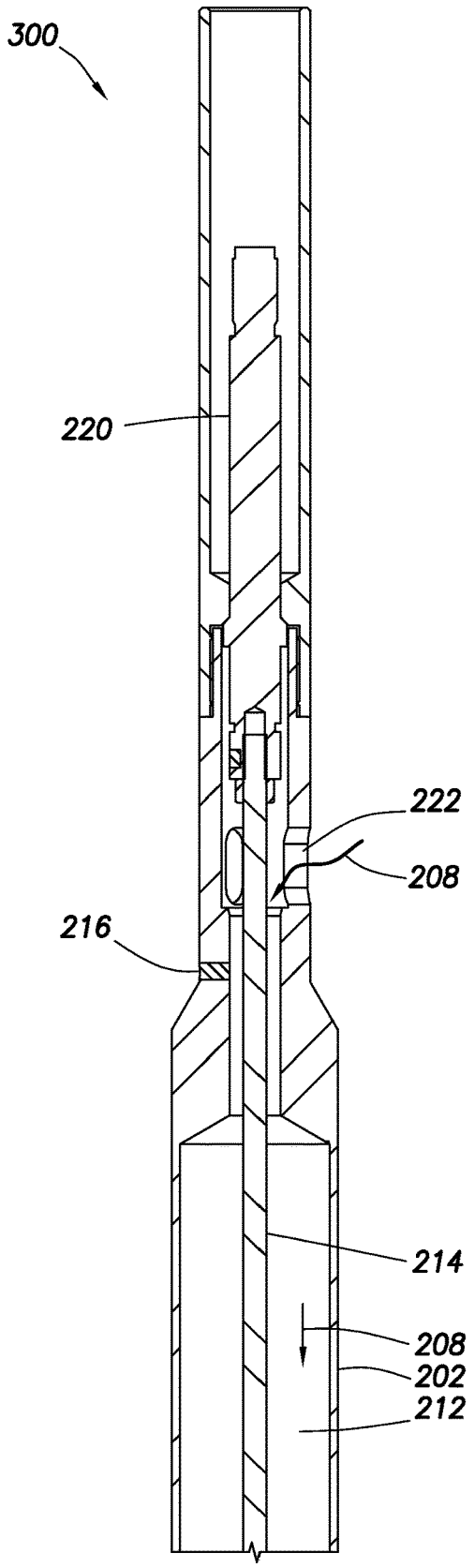
Figure 25B:
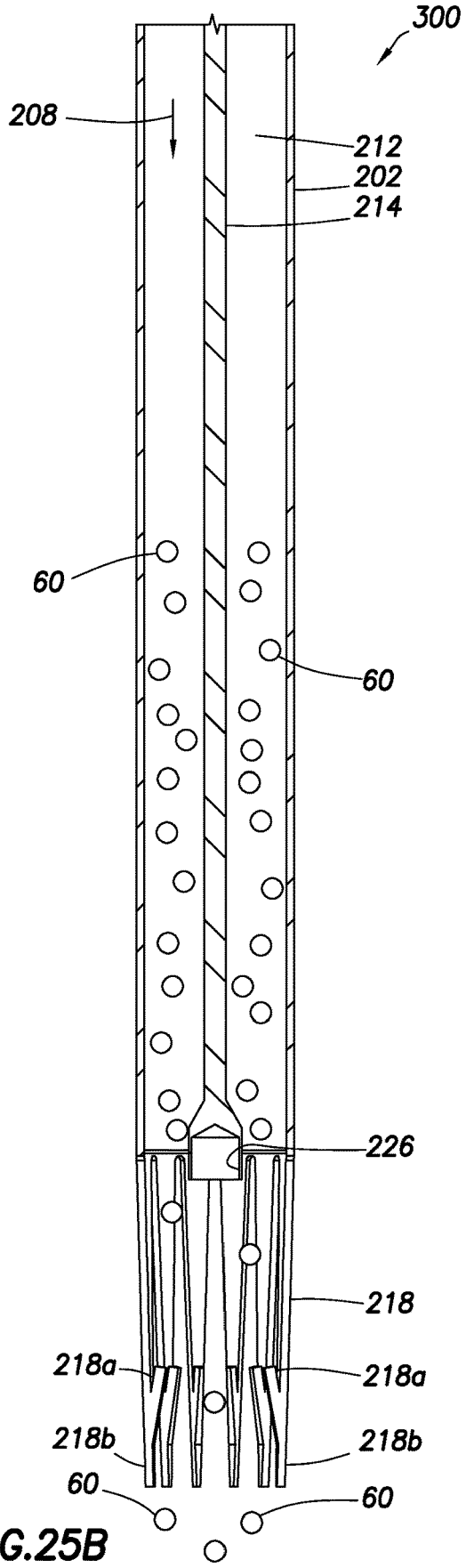
Figure 26A:
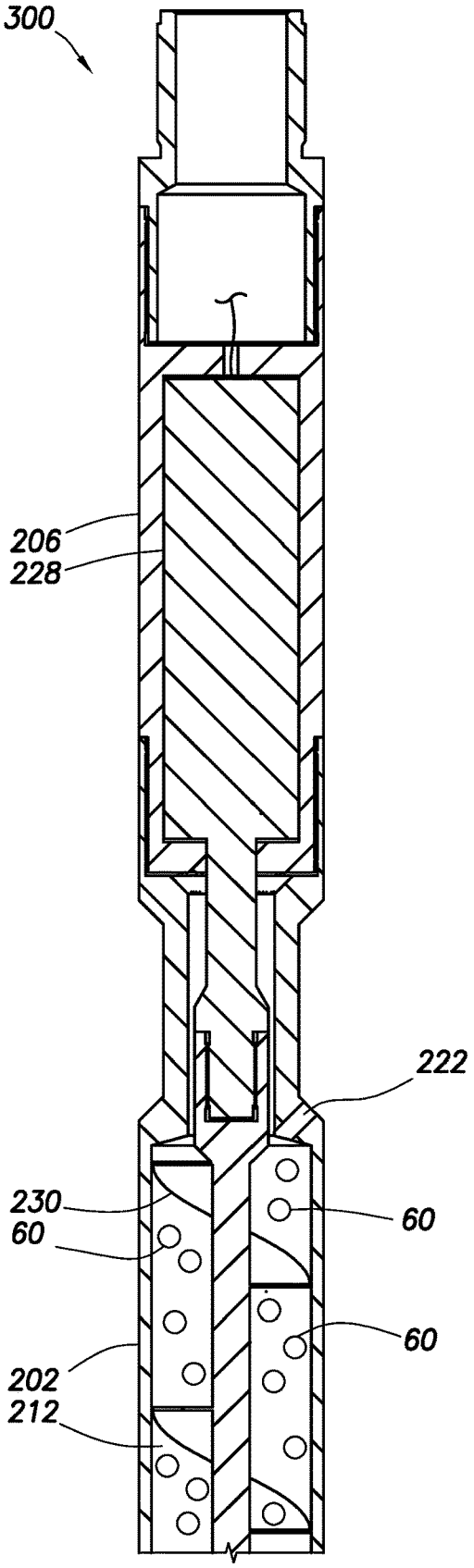
Figure 26B:
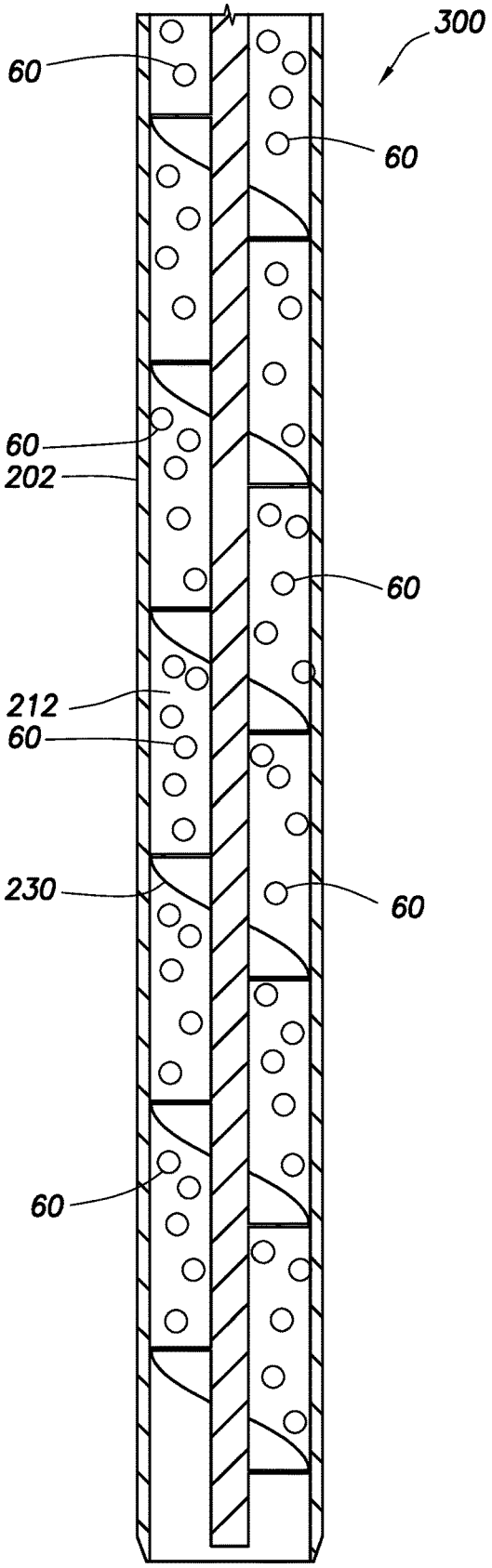
Figure 27A:
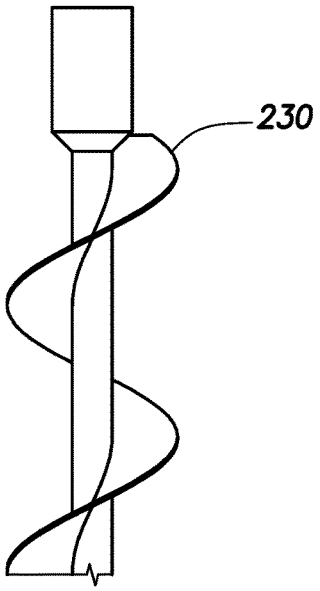
Figure 27B:
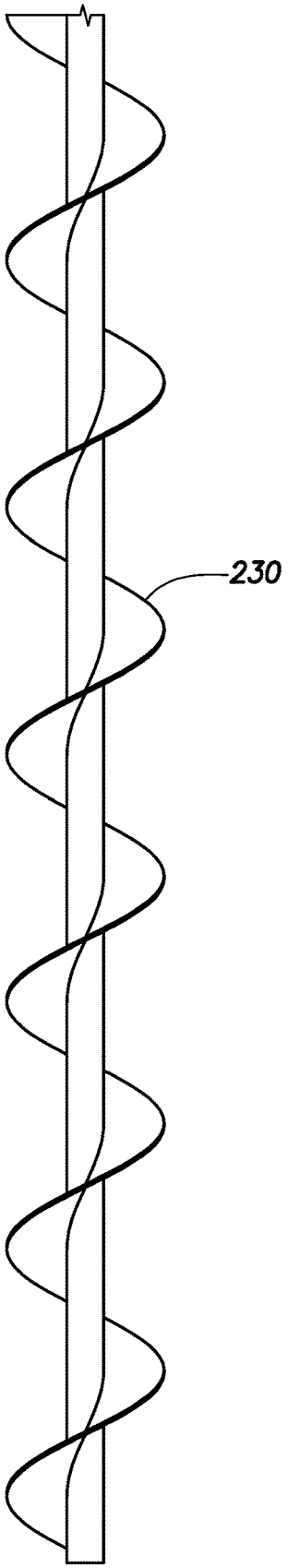

In FIGS. 25A & B, the rod 214 has been displaced upward by the actuator 206, thereby releasing the projections 218*a* from the recess 226, and allowing the collets 218*b* to flex outward. This opens the lower end of the container 202 and permits the fluid flow 208 via the now open flow path 222 (or upward displacement of the tool 300 in the wellbore 14) to displace the plugging devices 60, and any associated fluid and material, from the chamber 212 into the wellbore 14.

Referring additionally now to FIGS. 26A-27B, another example of the tool 300 is representatively illustrated. In this example, the actuator 206 is not a linear actuator, but instead is a rotary actuator including a motor 228.

The motor 228 rotates an auger 230 in the container 202. The plugging devices 60 are contained in the chamber 212, which extends helically between blades of the auger 230. The auger 230 is separately depicted in FIGS. 27A & B.

When the auger 230 is rotated by the motor 228, the plugging devices 60 are gradually discharged from the lower end of the container 202. A rate of discharge of the plugging devices 60 can be controlled by varying a rotational speed of the motor 228 and auger 230. The tool 300 can be displaced in the wellbore 14 at a selected velocity while rotating the auger 230 at a specific speed to thereby achieve a desired plugging device 60 spacing in the wellbore 14.

Suitable examples of motors or rotary actuators for use as the motor 228 include: a) a wireline or slickline operated electric motor or motor and drivetrain, b) a wireline or slickline operated electric or hydraulic rotary actuator, c) a mud motor (a turbine or positive displacement fluid motor) operated on coiled tubing or jointed pipe, d) a battery operated rotary source conveyed by any suitable means, and e) pipe rotation from surface with a drag block or other friction element downhole to provide relative rotary motion at the tool 300.

Referring additionally now to FIGS. 28A-30B, another example of the tool 300 is representatively illustrated. This example is similar in many respects to the FIGS. 26A-27B example, in that rotation of the auger 230 is used to discharge the plugging devices 60 from the container 202. However, the FIGS. 28A-30B example also includes a barrier 232 displaceable by the auger 230 rotation, to thereby positively discharge the plugging devices 60 from the chamber 212.

Figure 28A:
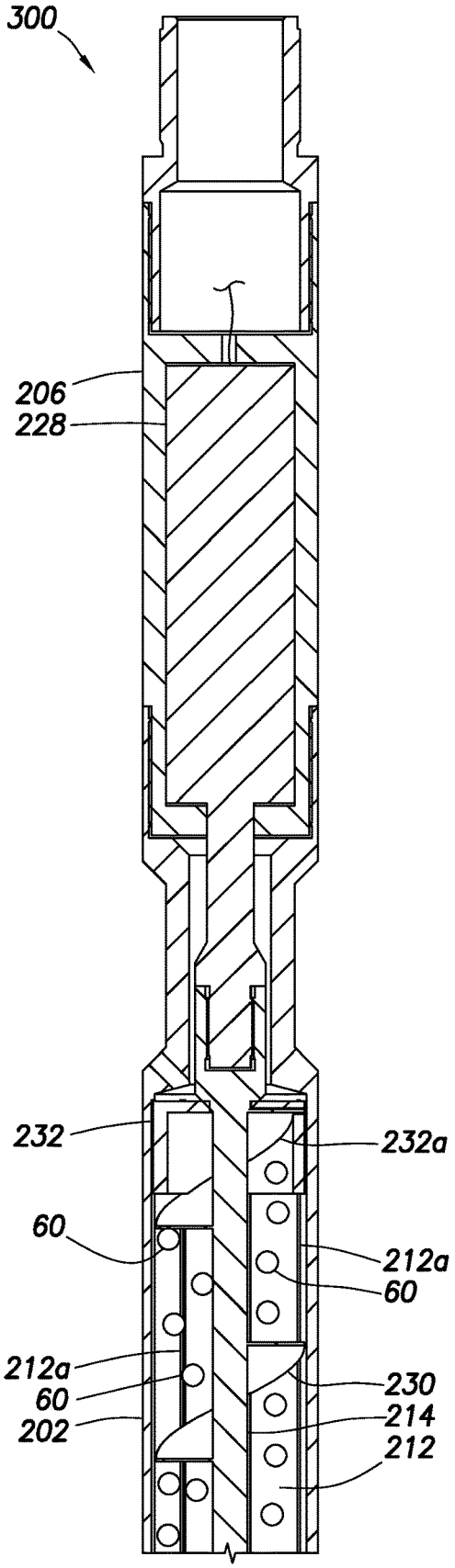
Figure 28B:
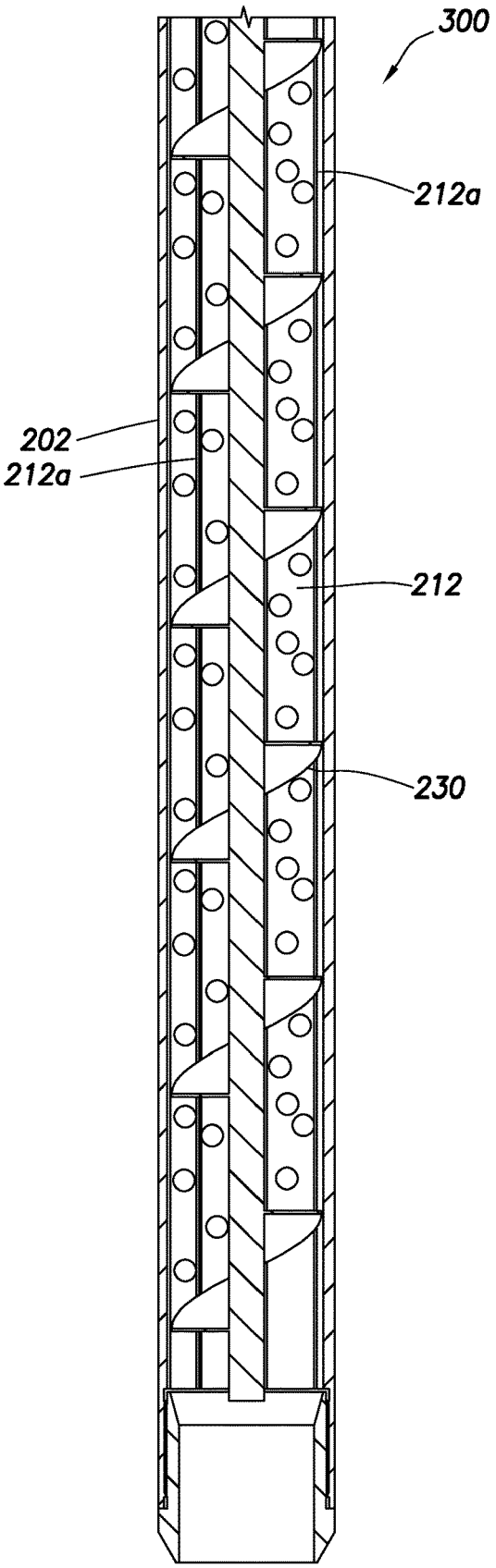

In FIGS. 28A & B, the tool 300 is in a run-in configuration. The barrier 232 is positioned at an upper end of the chamber 212, which is loaded with the plugging devices 60. The barrier 232 has a helical slot 232*a* formed therein for engagement with the blades of the auger 230.

Figure 29A:
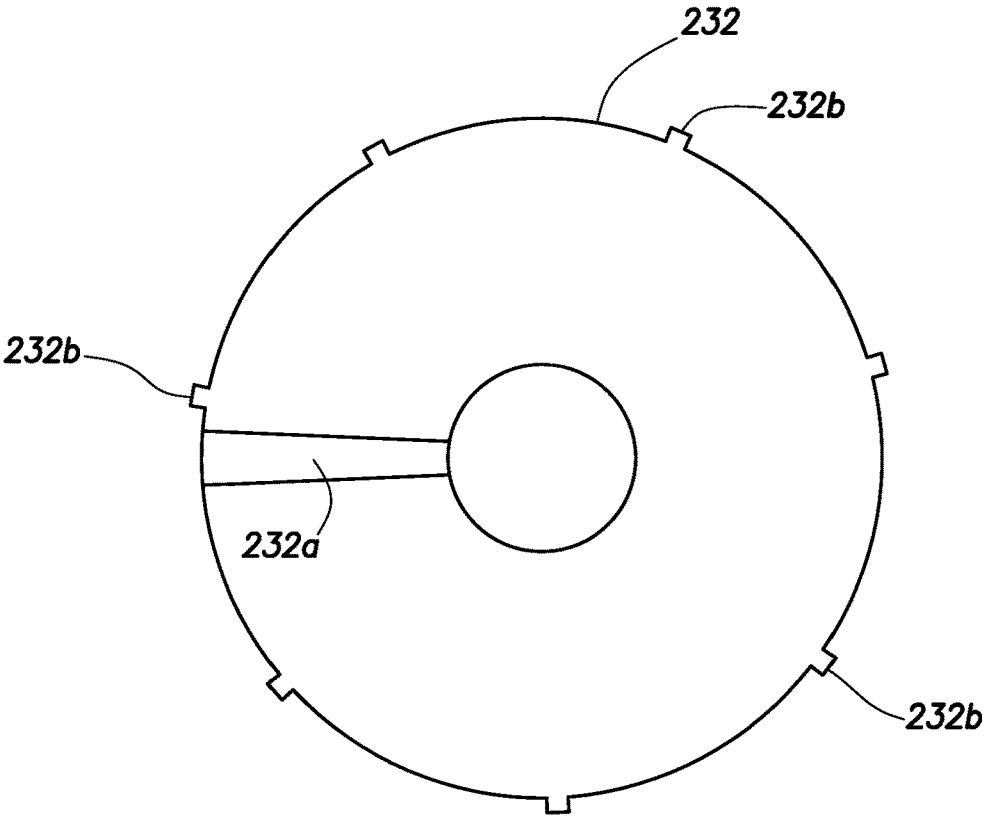
Figure 29B:
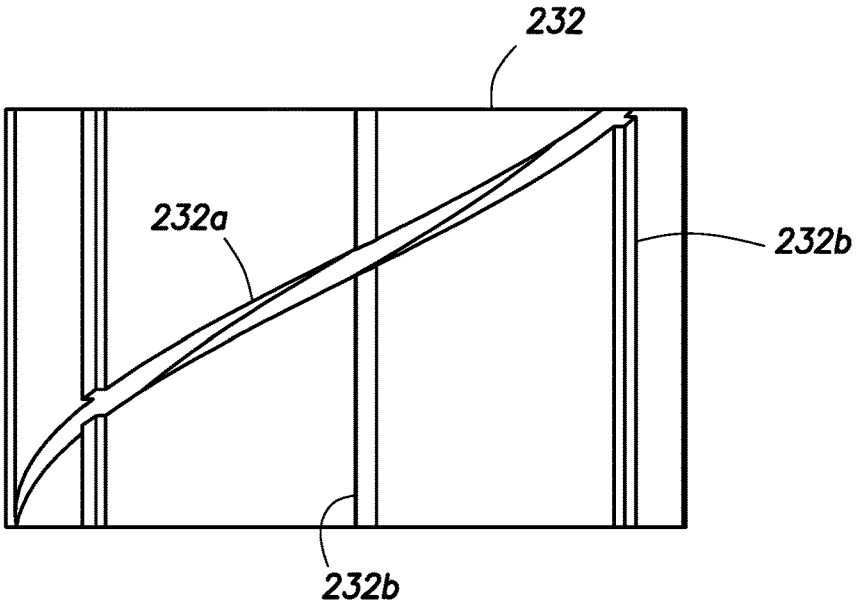

Top and side views of the barrier 232 are representatively illustrated in respective FIGS. 29A & B. In these views it may be seen that the barrier 232 also has splines 232*b* formed longitudinally thereon for sliding engagement with longitudinal grooves 212*a* formed in the chamber 212.

The engagement between the splines 232*b* and the grooves 212*a* prevents the barrier 232 from rotating with the auger 230, while also permitting the barrier to displace longitudinally in the chamber 212 due to rotation of the auger 230 and engagement between the auger blades and the helical slot 232*a*.

Figure 30A:
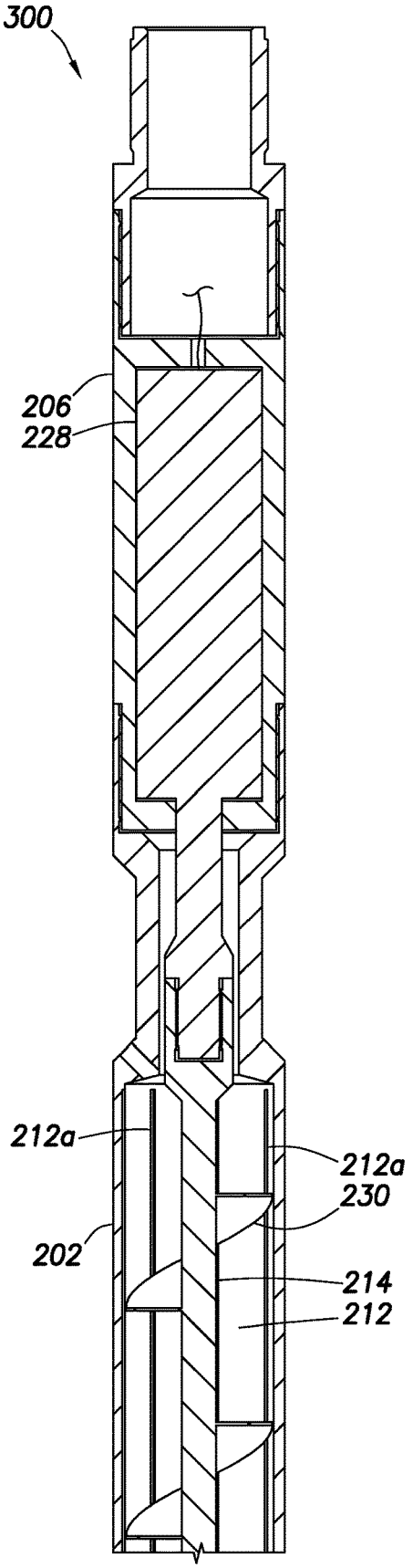
Figure 30B:
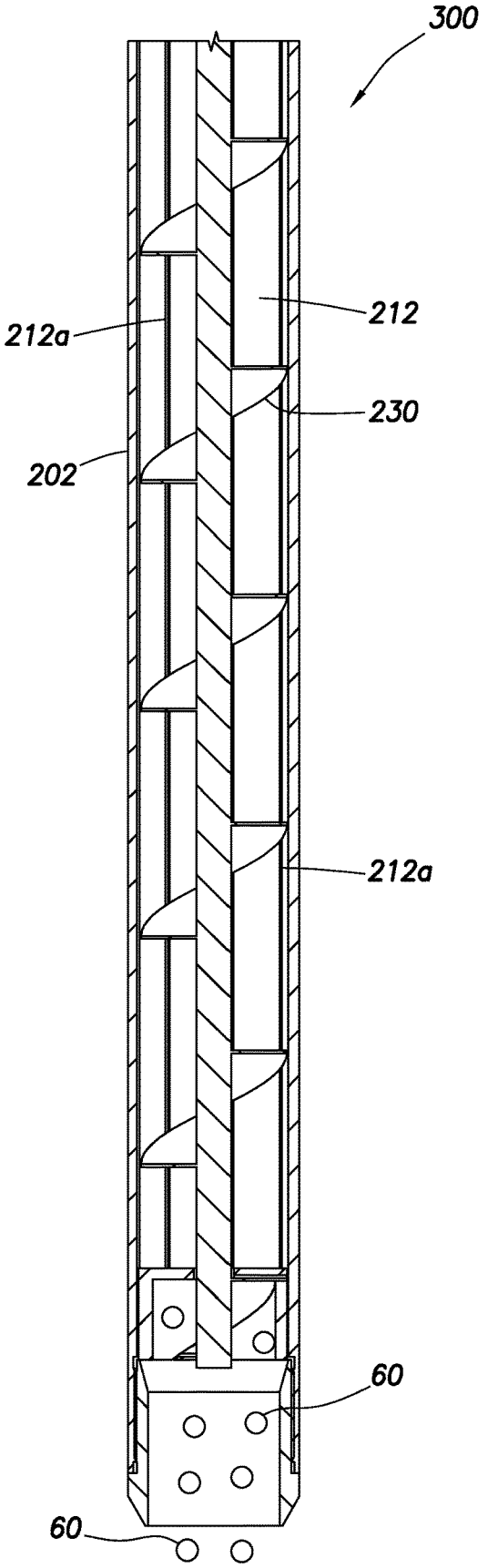

In FIGS. 30A & B, the auger 230 has been rotated by the motor 228 of the actuator 206, thereby displacing the barrier 232 longitudinally through the container 202 and discharging the plugging devices 60 from the chamber 212.

Referring additionally now to FIGS. 31A-32B, another example of the tool 300 is representatively illustrated. In this example, multiple barriers 232 are spaced longitudinally along the rod 214, which is externally threaded (see FIGS. 32A & B).

The externally threaded rod 214 is similar in some respects to the auger 230 of the FIGS. 26A-30B examples, in that rotation of the rod by the motor 228 causes longitudinal displacement of the barriers 232 through the chamber 212. The barriers 232 of the FIGS. 31A-32B example include the helical slot 232*a*, in that they are internally threaded. External splines 232*b* could be provided on the barriers 232 for engagement with longitudinal slots 212*a* in the chamber 212 (as in the FIGS. 28A-30B example), if desired, to prevent rotation of the barriers 232 with the threaded rod 214.

Figure 31A:
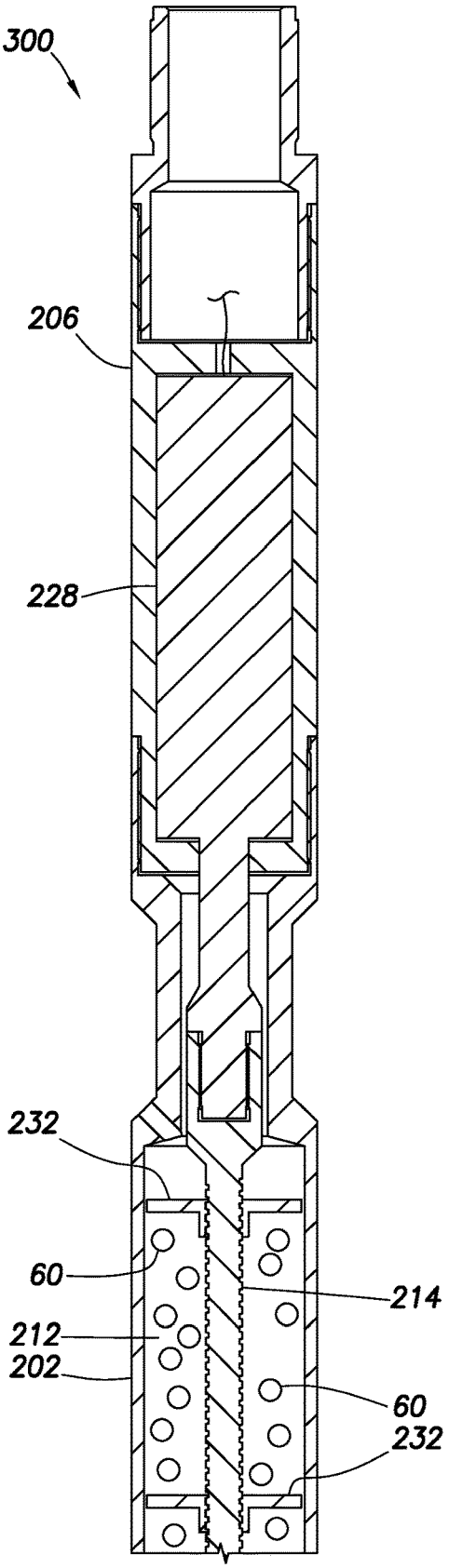
Figure 31B:
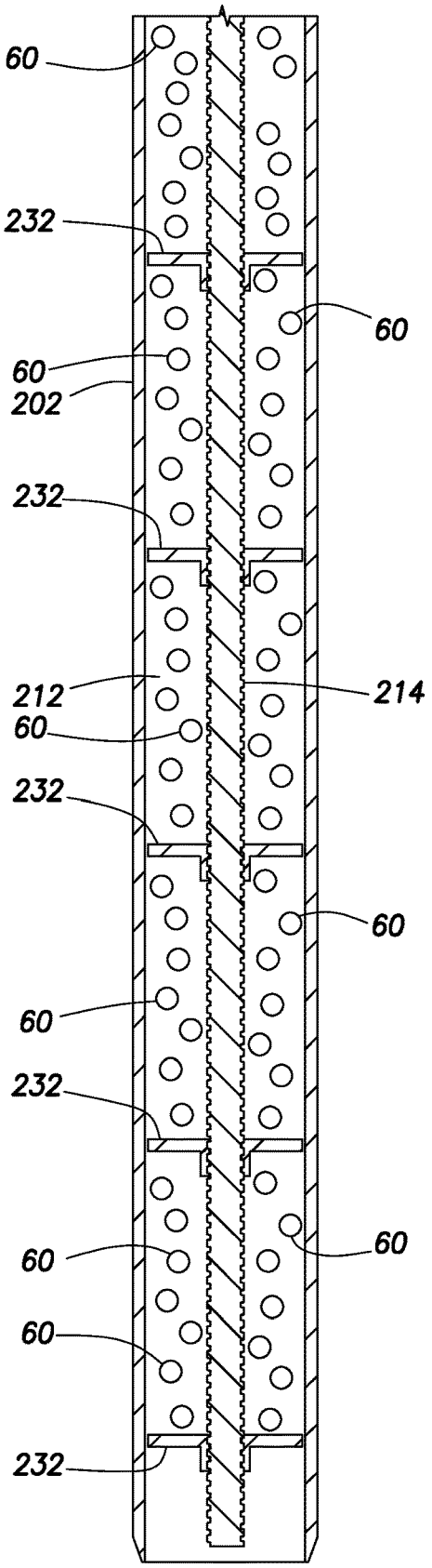
Figure 32A:
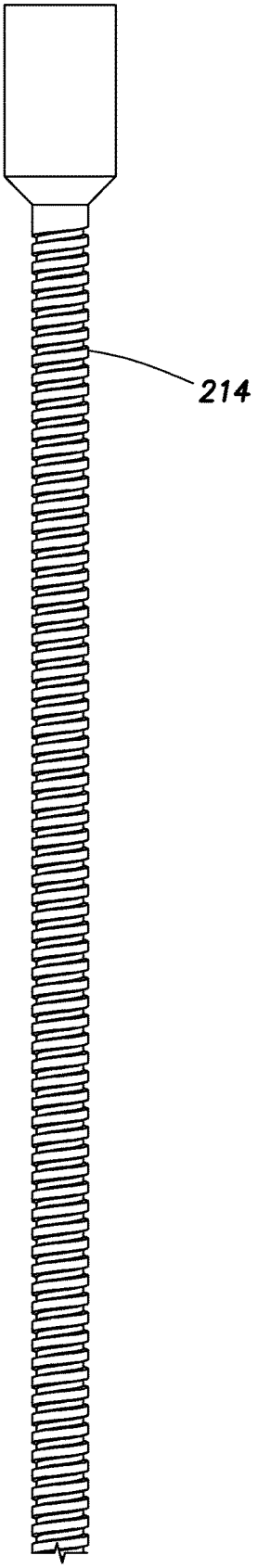
Figure 32B:
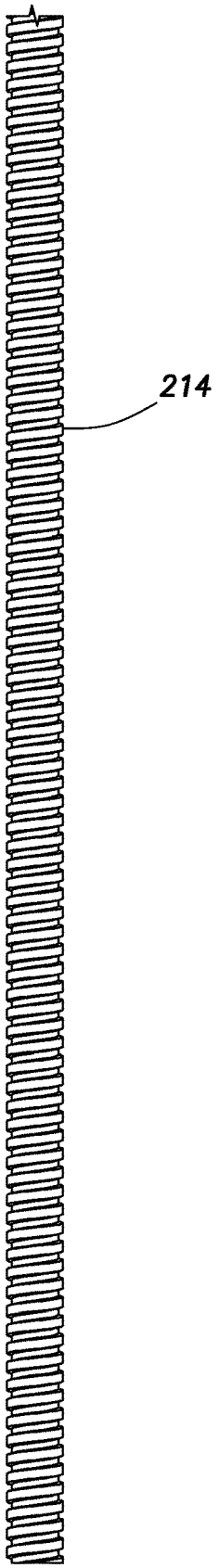

In FIGS. 31A & B, the tool 300 is depicted in a run-in configuration. When the motor 228 is operated to rotate the rod 214, the barriers 232 will gradually displace downwardly, thereby releasing the plugging devices 60 from the lower end of the container 202. The barriers 232 can also displace out of the chamber 212 and into the wellbore 14, and so the barriers can be made of a frangible or dissolvable material, so that they will not interfere with subsequent well operations.

Referring additionally now to FIGS. 33A-34B, another example of the tool 300 is representatively illustrated. In this example, the tool 300 includes the cartridge 224, similar to the FIGS. 22A-23B example, but the cartridge is rotated to release the plugging devices 60, instead of being displaced longitudinally.

Figure 33A:
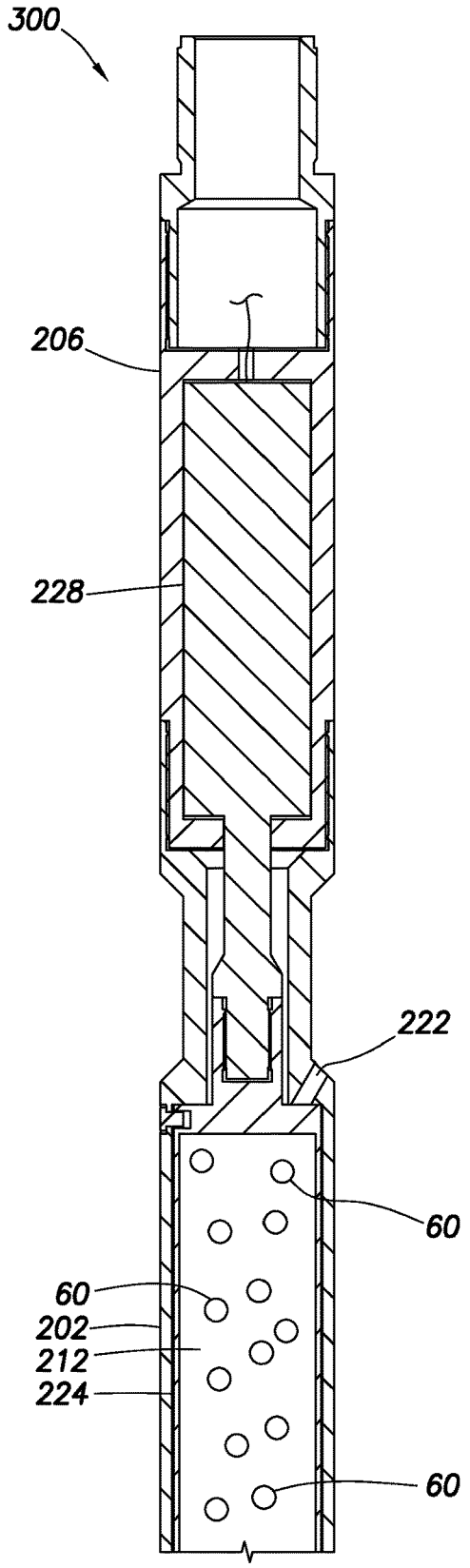
Figure 33B:
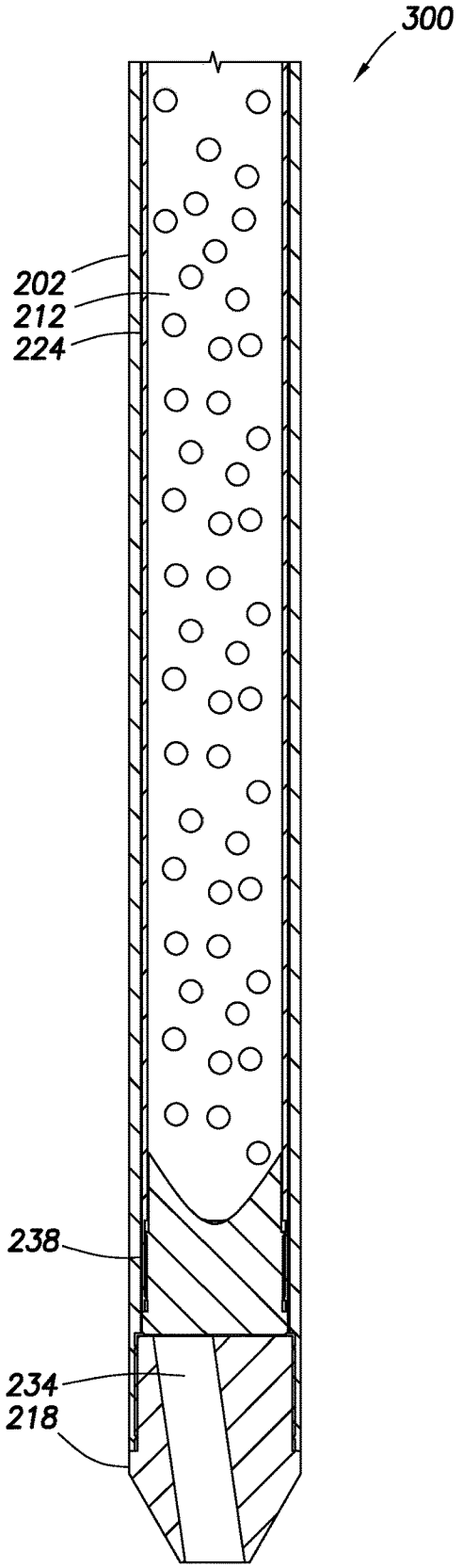

In FIGS. 33A & B, the tool 300 is depicted in a run-in configuration. The plugging devices 60 are received in the cartridge 224, which is rotatably received in the container 202, and is connected to the motor 228. A passage 234 extending longitudinally through the end closure 218 is blocked by an end closure 238 of the cartridge 224.

Figure 34A:
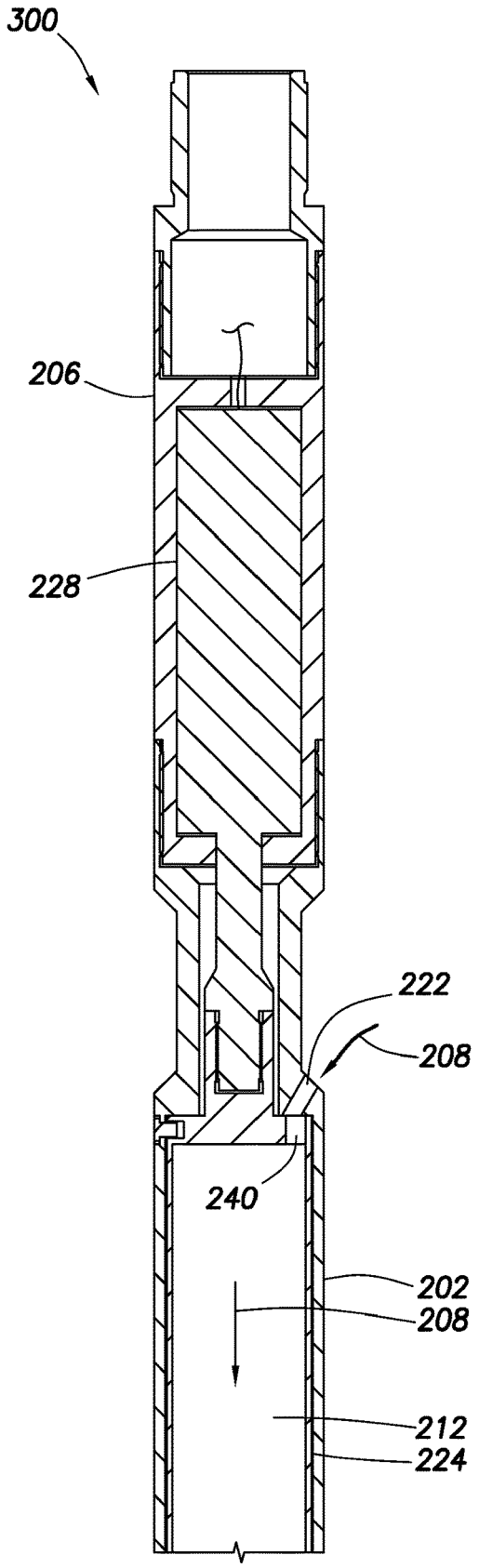
Figure 34B:
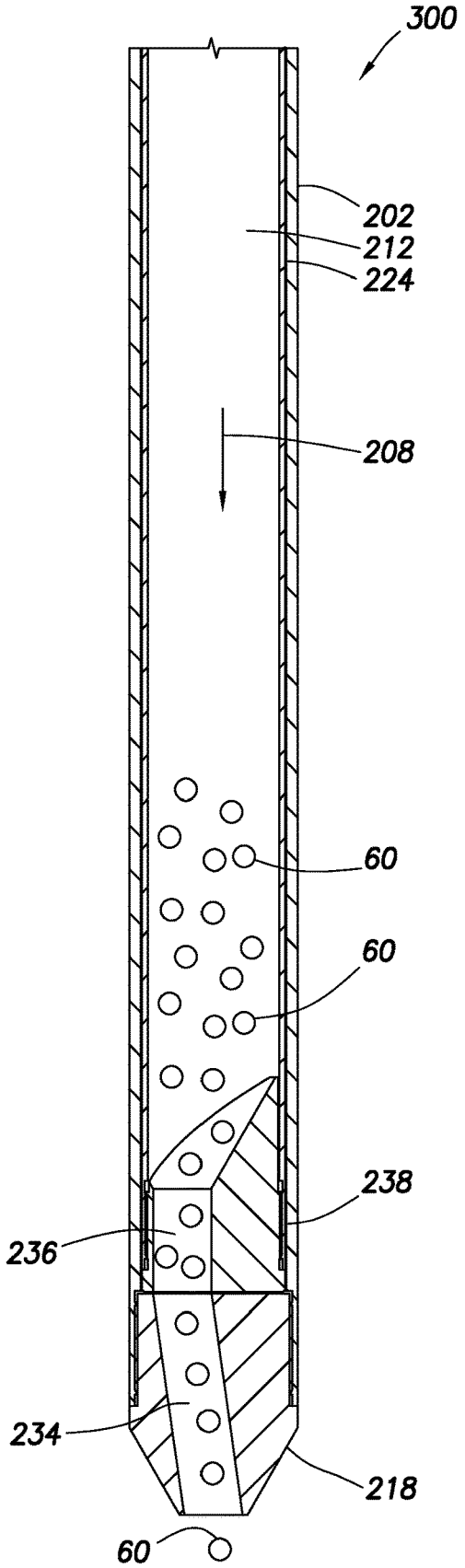

In FIGS. 34A & B, the tool 300 is depicted in an actuated configuration, in which the cartridge 224 has been rotated by the motor 228. As a result, a passage 236 in the cartridge end closure 238 is now aligned with the passage 234 in the container end closure 218.

Another passage 240 in an upper end closure of the cartridge 224 is now aligned with the flow path 222. The plugging devices 60 can now be released into the wellbore 14 by the fluid flow 208 (or by upward displacement of the tool 300 through the wellbore).

Figure 35A:
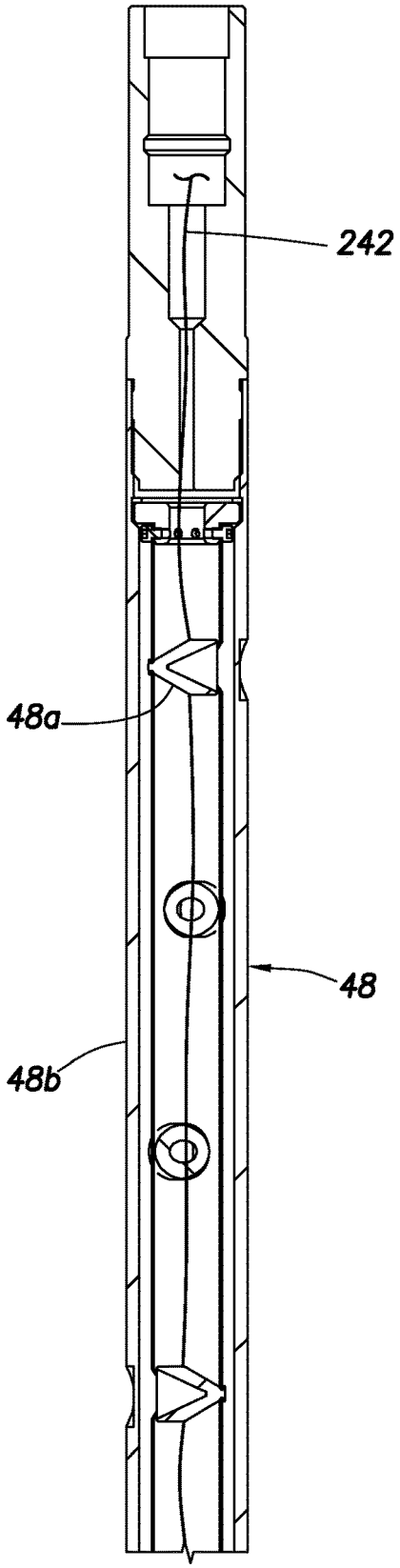
Figure 35B:
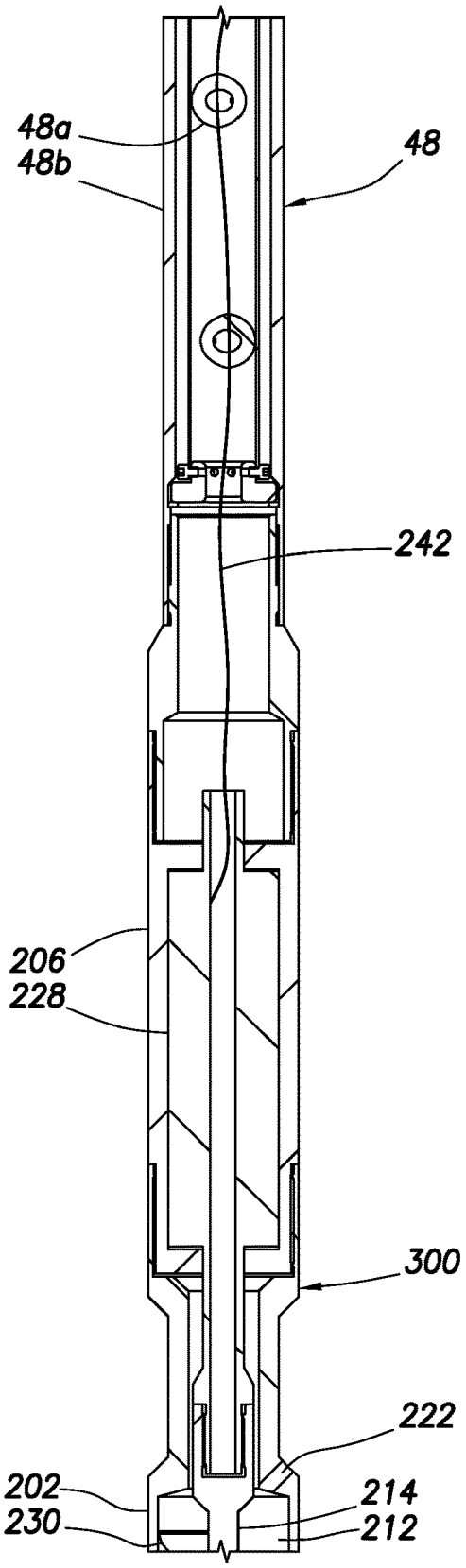
Figure 35C:
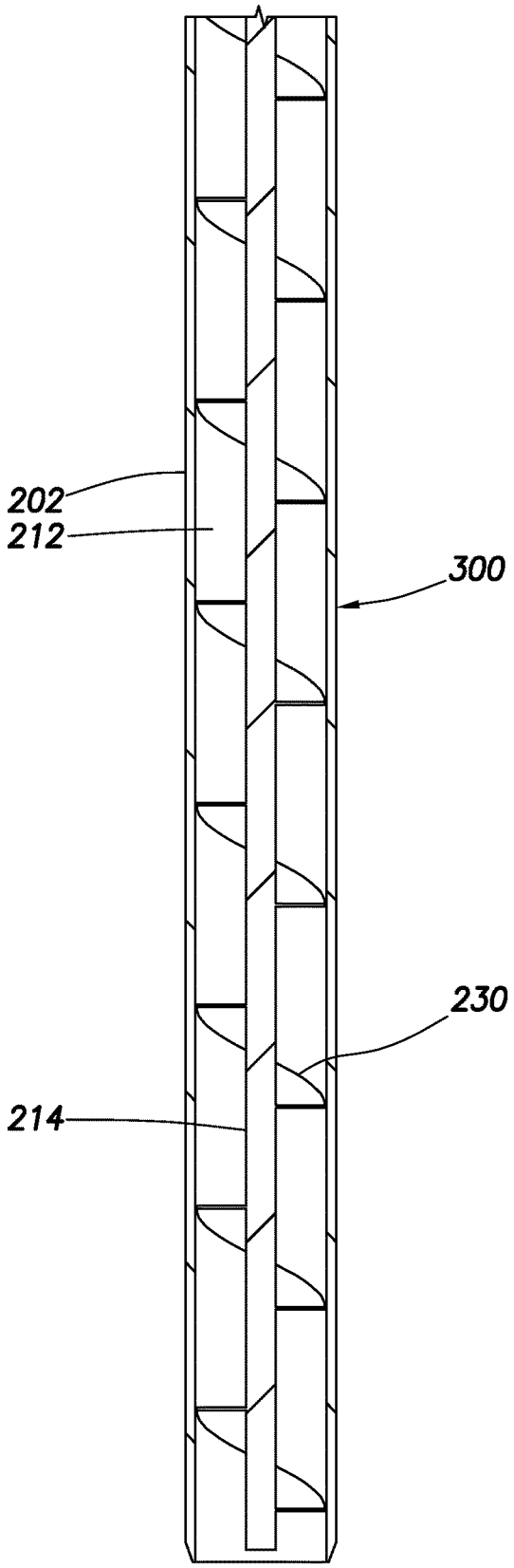

Referring additionally now to FIGS. 35A-C, the FIGS. 26A-27B example of the tool 300 is representatively illustrated as combined with a perforator 48. The perforator 48 is connected above the tool 300, with a line 242 for operating the motor 228 extending through the perforator. The line 242 may be an electrical, hydraulic, fiber optic or other type of line for transmitting power and/or control signals to the actuator 206 and motor 228.

The perforator 48 in this example is an explosive perforator of the type including shaped charges 48*a* within an outer tubular housing 48*b*. However, other types of perforators (such as, fluid jet perforators, etc.) may be used in other examples.

The perforator 48 is connected above the tool 300, in that the perforator is connected between the conveyance 204 (see FIG. 15) and the dispensing tool. However, other relative positions of the perforator 48, conveyance 204 and tool 300 may be used, in keeping with the scope of this disclosure.

Figure 36A:
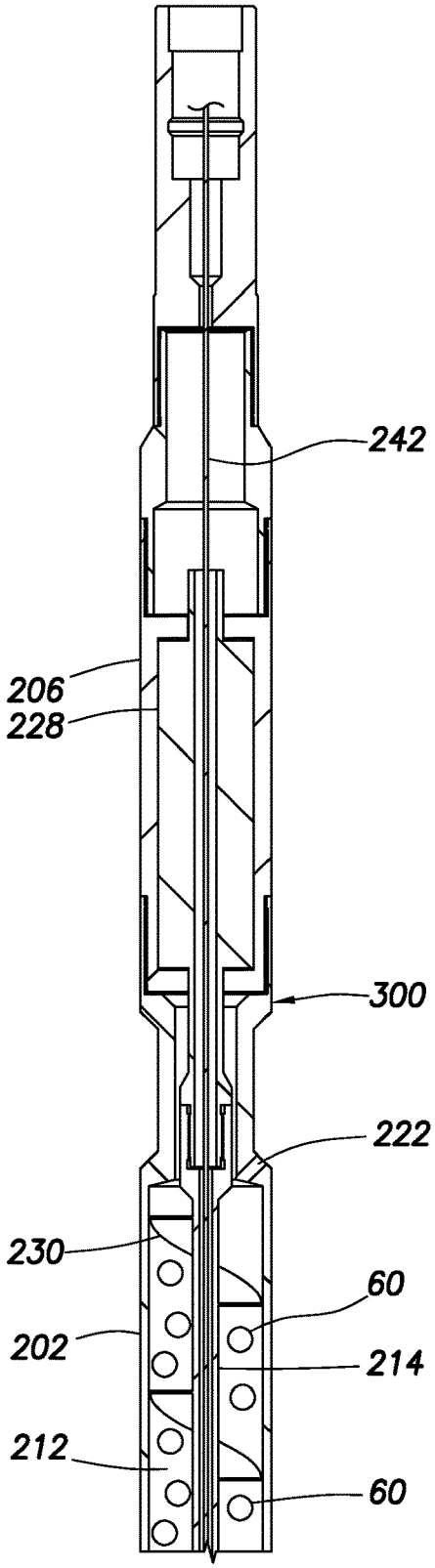
Figure 36B:
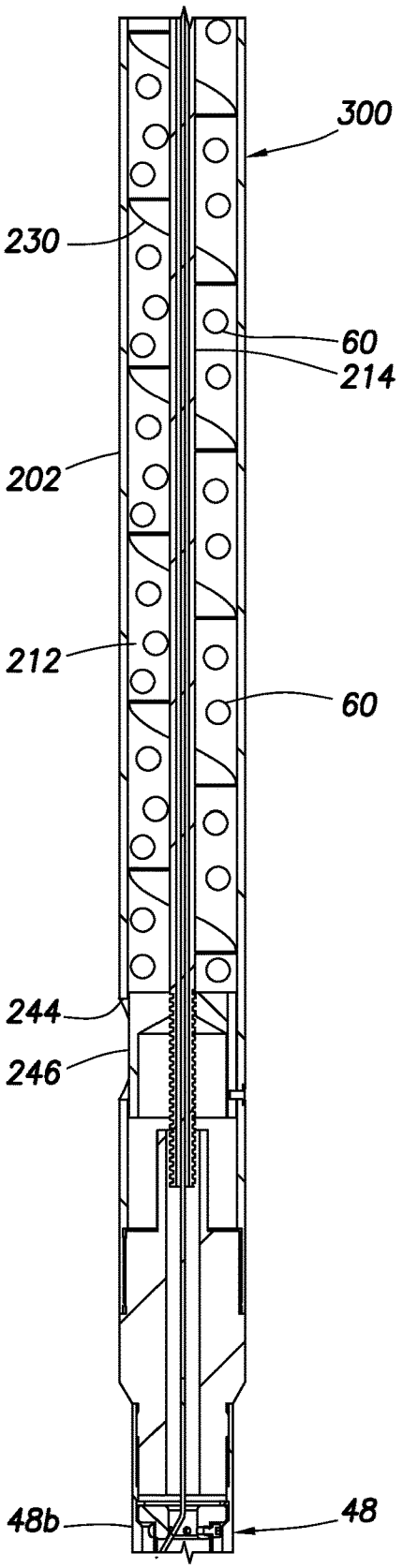
Figure 36C:
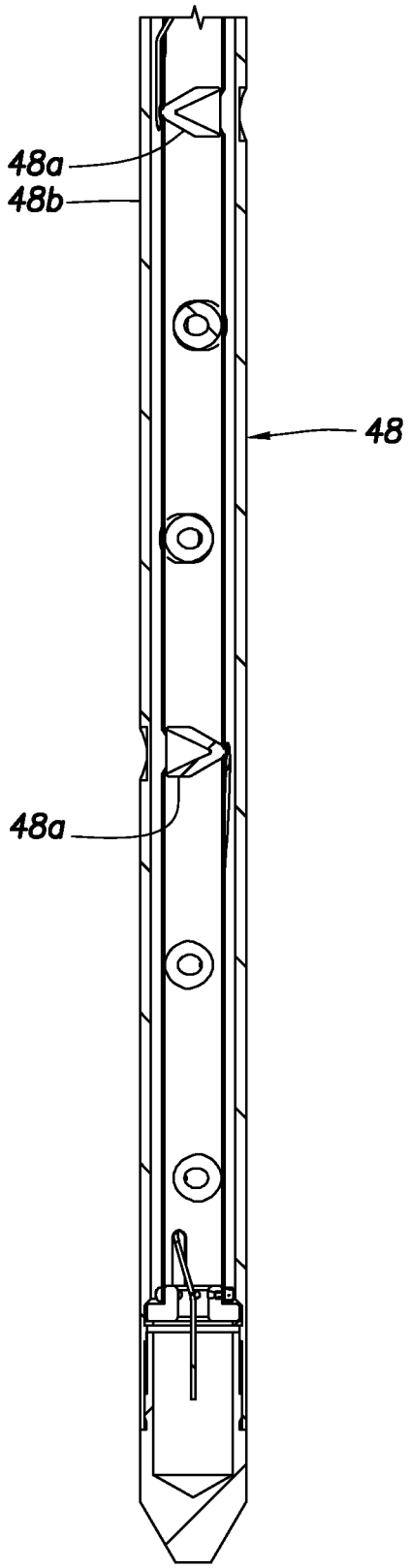

Referring additionally now to FIGS. 36A-C, another example of the combined perforator 48 and dispensing tool 300 is representatively illustrated. In this example, the tool 300 is connected above the perforator 48, so that the tool 300 will be connected between the conveyance 204 (see FIG. 15) and the perforator.

The line 242 in this example can include multiple lines, and different types of lines may be included (such as, electrical, hydraulic, fiber optic, detonating cord, etc.). At least one of the lines 242 can be used to operate the actuator 206, and another of the lines can be used to operate the perforator 48 (such as, to detonate a detonator or blasting cap of the perforator to set off the shaped charges 48*a*, etc.). For operation of the perforator 48, at least one of the lines 242 extends longitudinally through the dispensing tool 300, from the conveyance 204 to the perforator.

In this configuration, the dispensing tool 300 can dispense the plugging devices 60 into the wellbore 14 above perforations formed by the perforator 48, so that the fluid flow 208 can conveniently convey the plugging devices into sealing engagement with the perforations, such as, after a treatment operation has been performed. In other configurations in which the dispensing tool 300 is positioned below the perforator 48, the conveyance 204 can be used to raise the dispensing tool relative to perforations formed by the perforator (such as, after a treatment operation has been performed), in order to dispense the plugging devices 60 above the perforations. However, it is not necessary in keeping with the scope of this disclosure for the plugging devices 60 to be dispensed above, below, or in any other particular position relative to perforations.

Note that, since the dispensing tool 300 is positioned above the perforator 48, the dispensing tool is configured to discharge the plugging devices 60 laterally from the tool into the wellbore 14. Specifically, the tool 300 includes a side discharge port 244 that is initially blocked by a barrier 246, as depicted in FIG. 36B.

The barrier 246 is internally threaded and disposed on an externally threaded lower portion of the rod 214. When the rod 214 is rotated by the motor 228, the barrier 246 displaces downward in the container 202, until the port 244 is fully opened. Rotation of the rod 214 also operates the auger 230, so that the plugging devices 60 are discharged from the side port 244 after it is opened.

Referring additionally now to FIGS. 37A-38C, another example of the combined perforator 48 and dispensing tool 300 is representatively illustrated. In this example, the dispensing tool 300 is connected between two perforators 48. Accordingly, the tool 300 includes the side port 244 and barrier 246 for controlling release of the plugging devices 60 laterally from the chamber 212 into the wellbore 14.

Figure 37A:
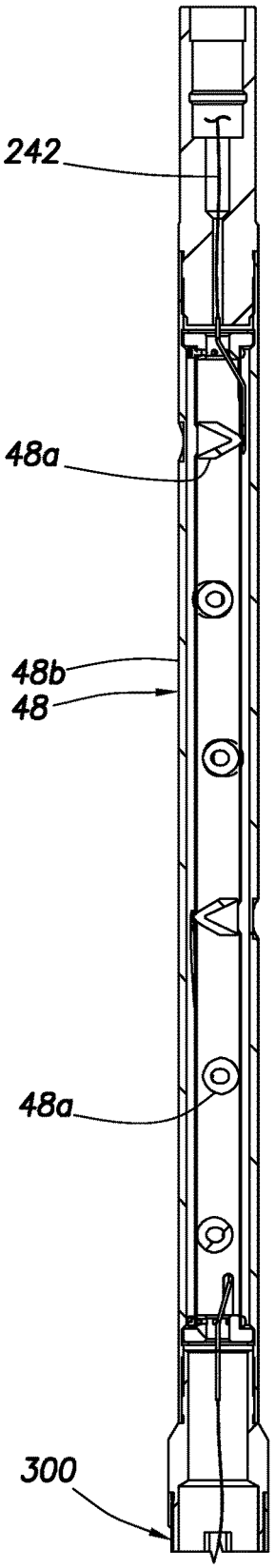
Figure 37B:
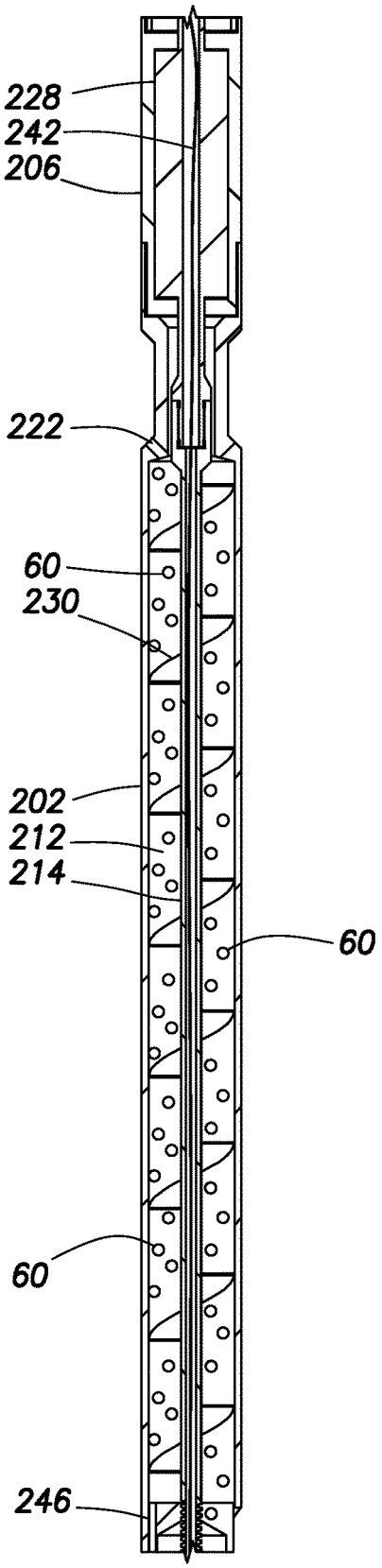
Figure 37C:
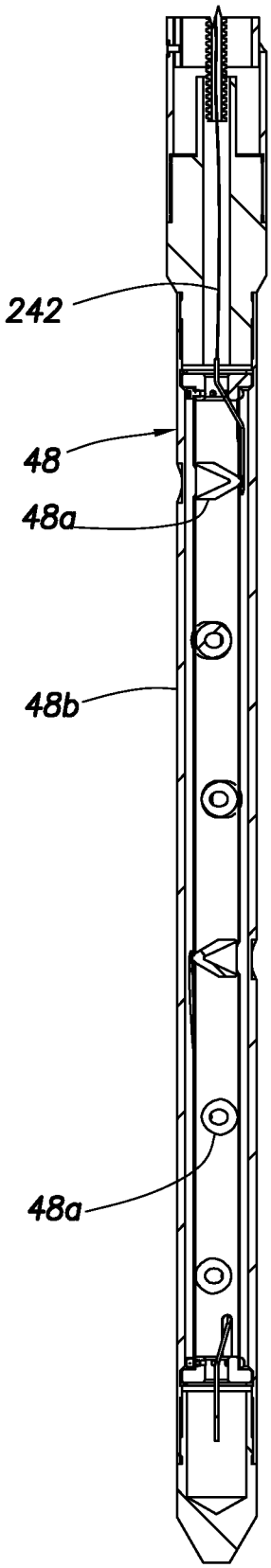
Figure 38A:
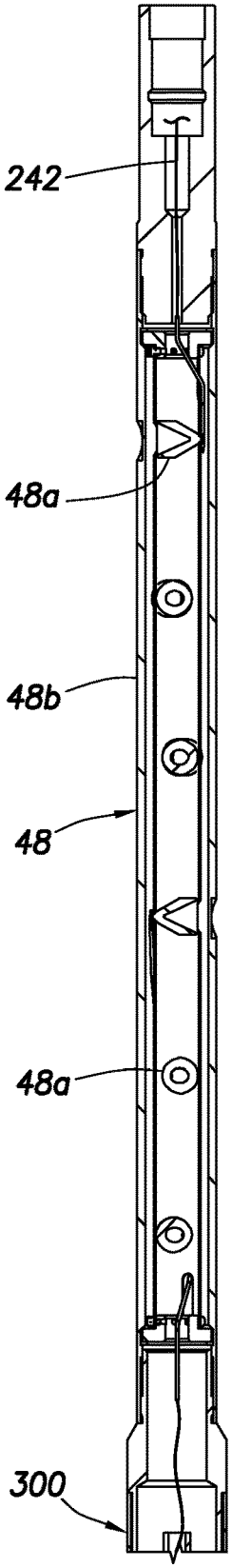
Figure 38B:
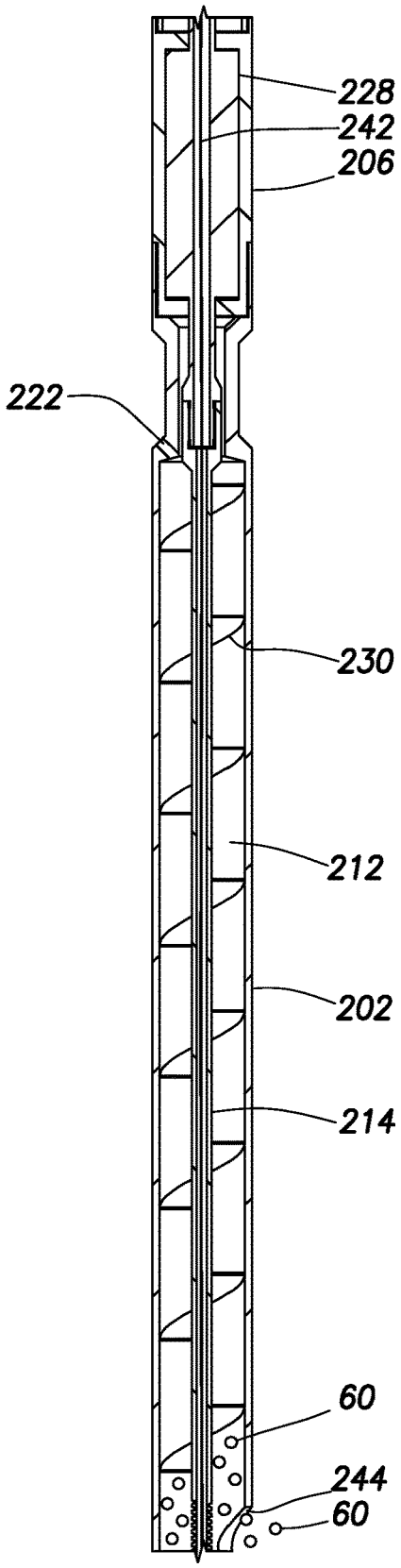
Figure 38C:
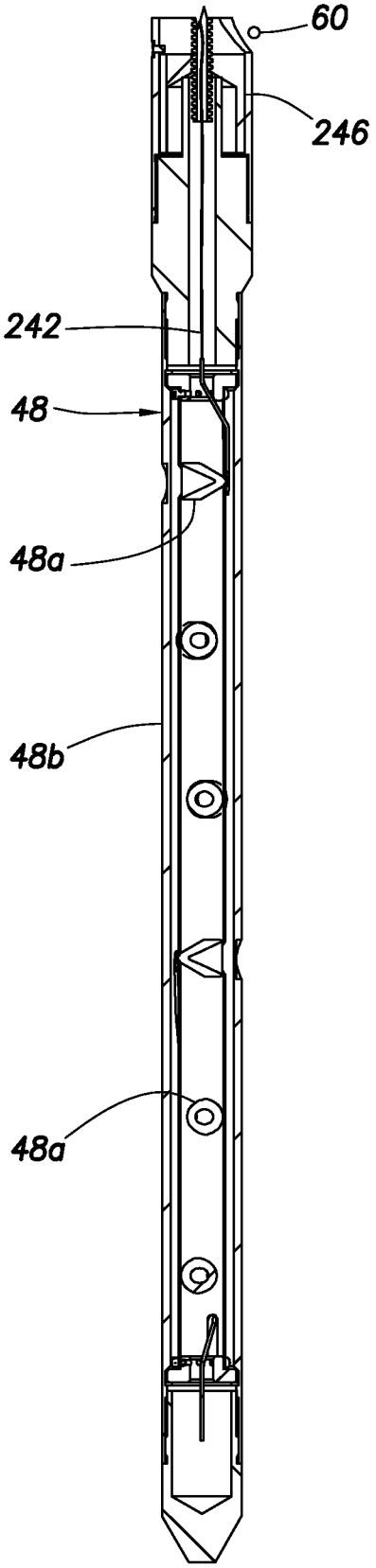

In FIGS. 37A-C, the dispensing tool 300 is depicted in a run-in configuration. In FIGS. 38A-C, the dispensing tool 300 is depicted in an actuated configuration, with the side port 244 open, so that the plugging devices 60 are released from the container 202.

Figure 39A:
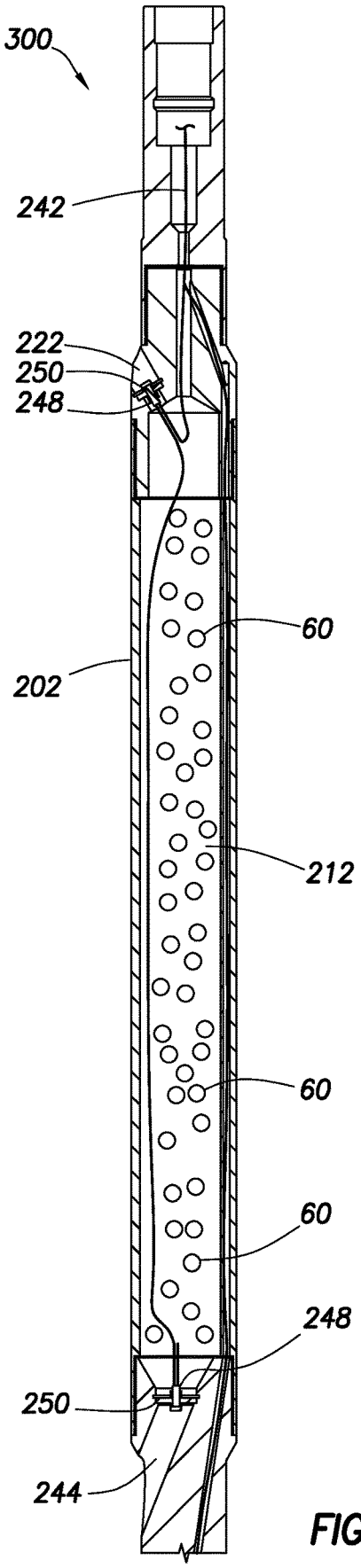
Figure 39B:
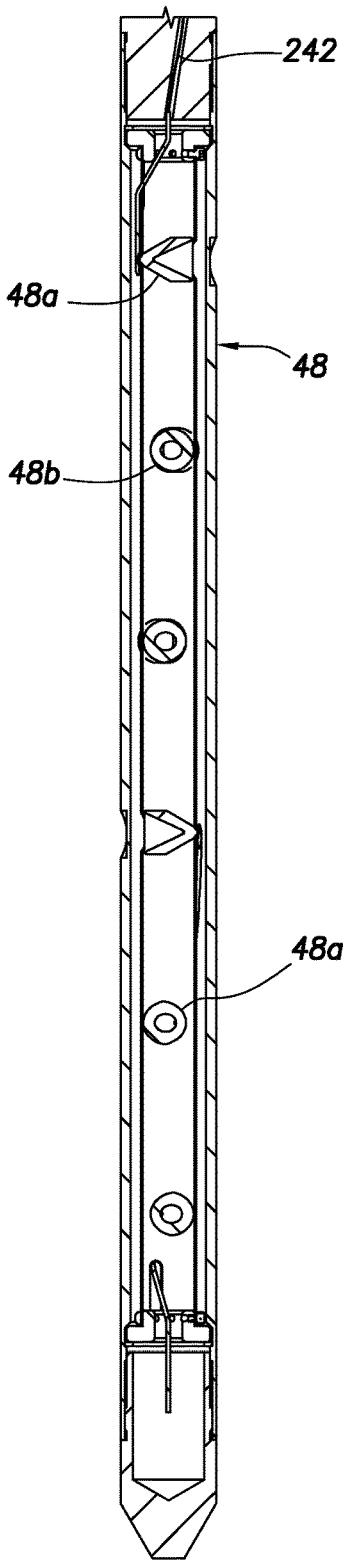

Referring additionally now to FIGS. 39A & B, another example of the dispensing tool 300 is representatively illustrated. In this example, the actuator for releasing the plugging devices 60 is in the form of detonators 248 and frangible disks 250 that initially block the flow path 222 and passage 244 at opposite ends of the chamber 212.

When an appropriate electrical signal is transmitted to the detonators 248 via the lines 242, the detonators detonate, thereby breaking the frangible disks 250. Fluid flow 208 can then pass into the chamber 212 via the flow path 222, and the plugging devices 60 can displace out of the chamber via the open passage 244.

In the FIGS. 39A & B example, the dispensing tool 300 is connected above a perforator 48, that is, between the conveyance 204 and the perforator. Thus, the passage 244 discharges the plugging devices 60 laterally into the wellbore 14. At least one of the lines 242 extends longitudinally through the dispensing tool 300 to the perforator 48 for actuation of the perforator.

Figure 40A:
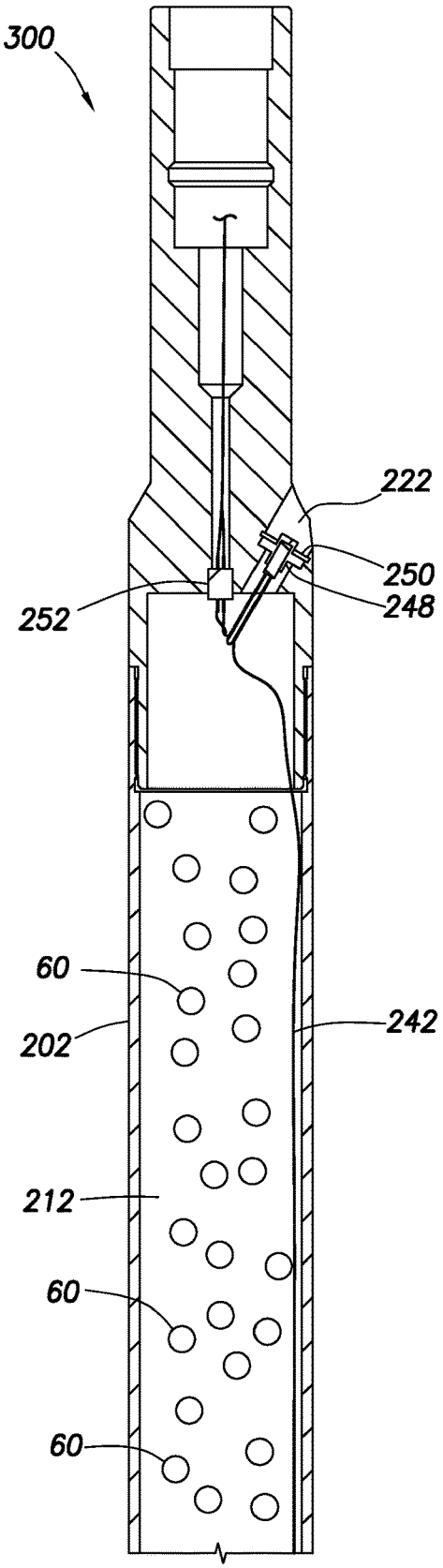
Figure 40B:
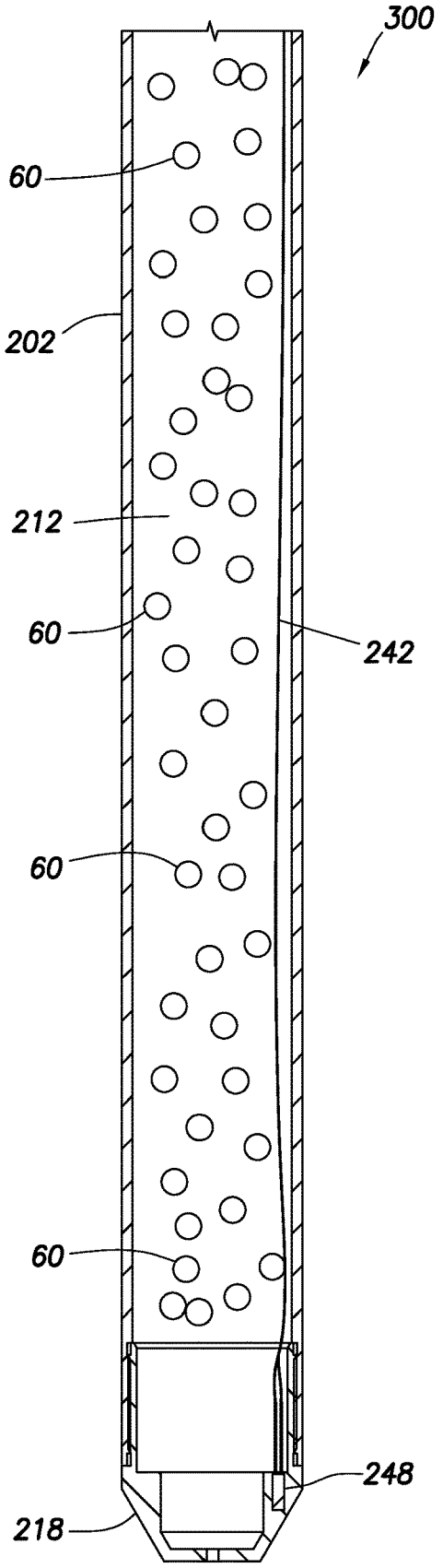

Referring additionally now to FIGS. 40A & B, another example of the dispensing tool 300 is representatively illustrated. This example is similar in some respects to the example of FIGS. 39A & B, in that detonators 248 are used to open opposite ends of the chamber 212 and release the plugging devices 60.

However, in the FIGS. 40A & B example, the lower detonator 248 is received in the frangible end closure 218. When the detonators 248 are detonated, the end closure 218 will break, thereby opening the lower end of the chamber 212, and the frangible disk 250 initially blocking the flow path 222 will break, thereby opening the flow path. The fluid flow 208 (or upward displacement of the tool 300 in the wellbore 14) can then displace the plugging devices 60, and any associated fluid and material in the chamber 212, into the wellbore via the open lower end of the chamber.

A sealed bulkhead 252 with electrical feed-throughs can be used to isolate the chamber 212 from the conveyance 204 or a perforator 48 connected above the dispensing tool 300. In various example configurations, the FIGS. 40A & B tool 300 could be positioned above, below or between one or more perforators 48.

Figure 41A:
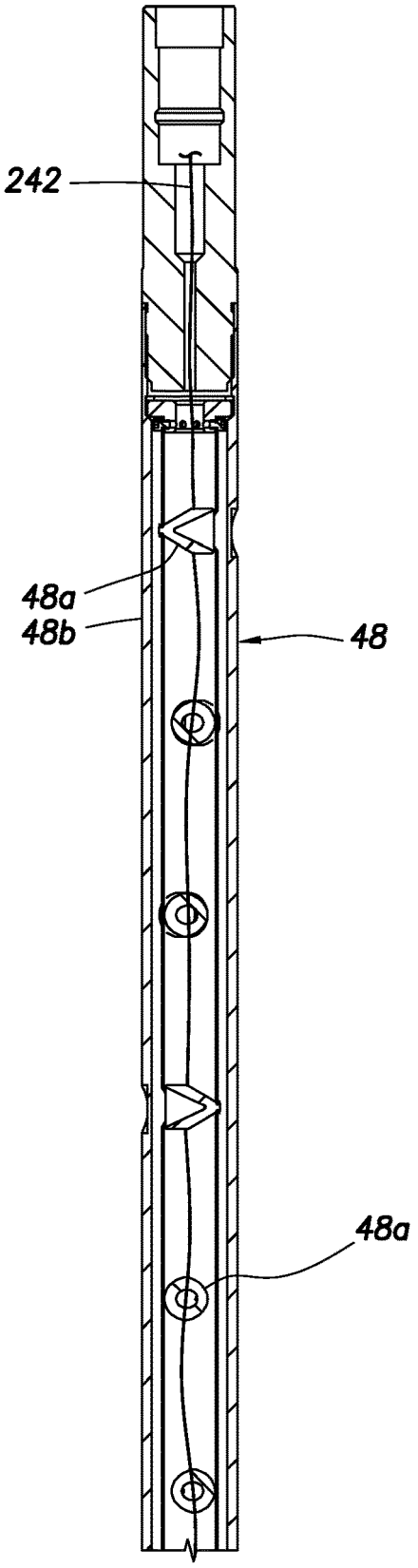
Figure 41B:
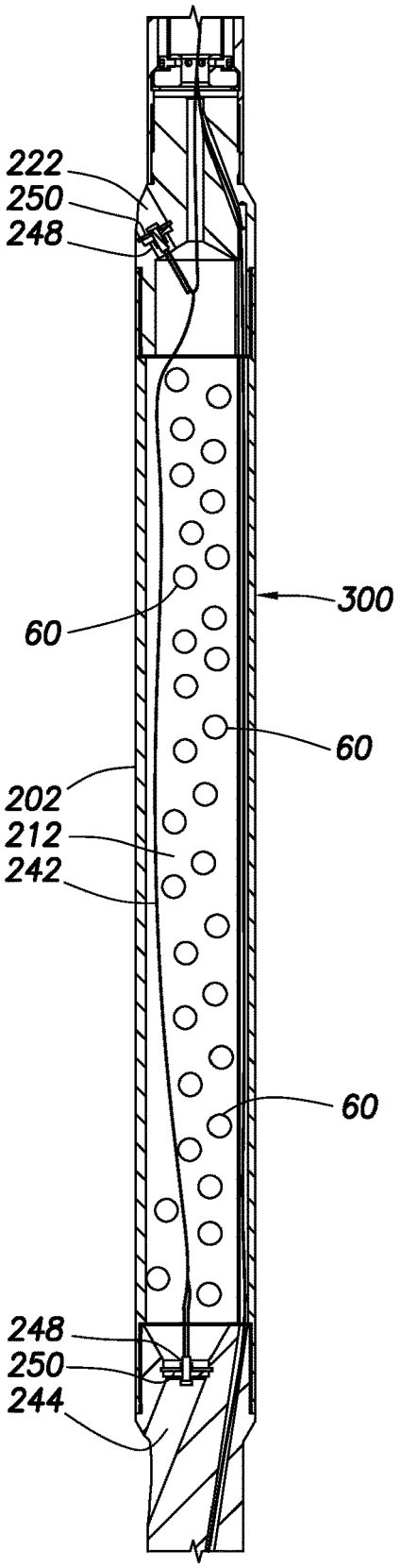
Figure 41C:
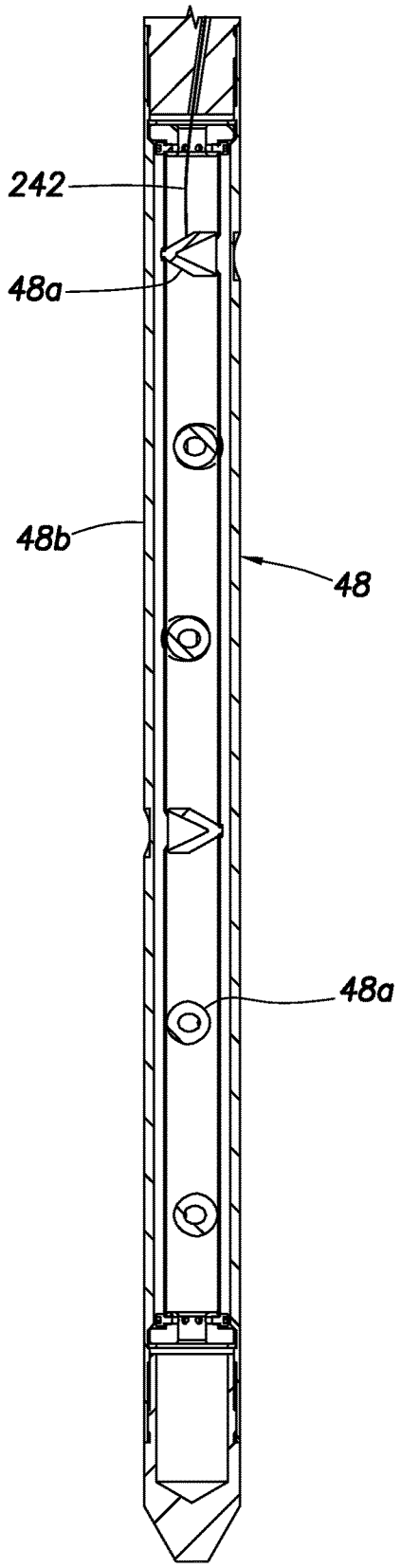

Referring additionally now to FIGS. 41A-C, another example of the dispensing tool 300 is representatively illustrated, connected between two perforators 48. The dispensing tool 300 in this example is similar, and operates similar to, the FIGS. 39A & B example.

Figure 42A:
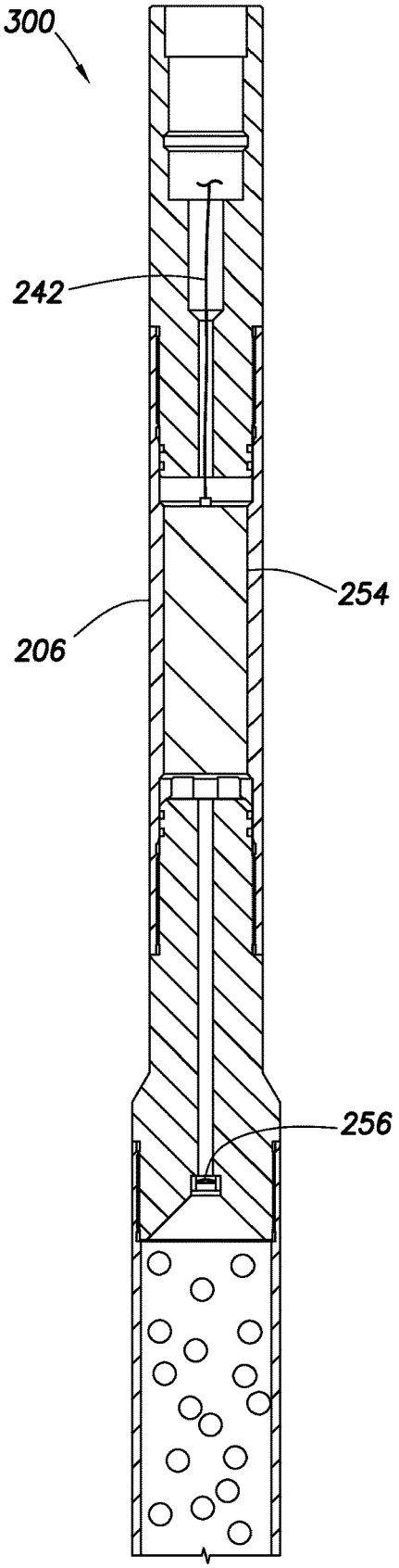
Figure 42B:
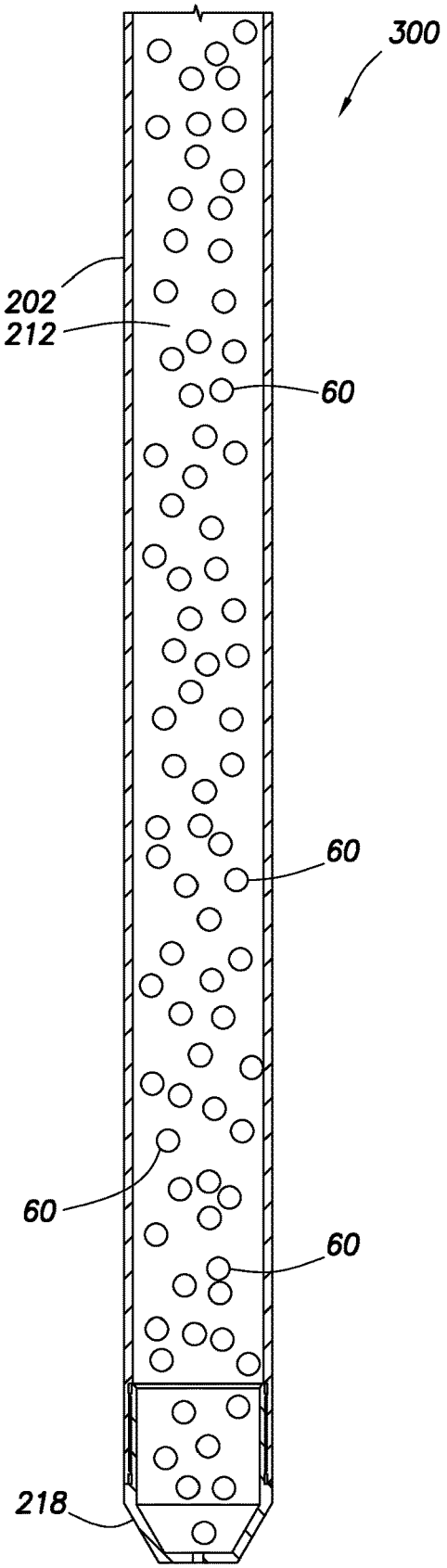

Referring additionally now to FIGS. 42A & B, yet another example of the dispensing tool 300 is representatively illustrated. In this example, a gas generation charge or propellant 254 is used to release and eject the plugging devices 60 into the wellbore 14.

To operate the tool 300, the propellant 254 is ignited via the lines 242, causing a buildup of pressure. When the pressure reaches a predetermined level, a rupture disk 256 ruptures, suddenly introducing relatively high pressure gas into the chamber 212. The sudden pressure increase in the chamber 212 causes the end closure 218 to break, thereby releasing the plugging devices 60 from the chamber into the wellbore 14.

The FIGS. 42A & B dispensing tool 300 example could be configured for connection above a perforator, or between perforators, by providing a laterally directed passage (such as the passage 244 described above) with a frangible closure. Any of the dispensing tool 300 examples described above could be positioned above or between perforators 48, or otherwise positioned relative to other well tools, in keeping with the scope of this disclosure.

Some advantages of the dispensing tool 300 and method examples described above can include (but are not limited to): a) the plugging devices 60 can be precisely placed at a desired location within the wellbore 14 for selective plugging of specific perforations 46, b) the plugging devices 60 do not have to be compatible with surface pumping equipment, c) a possibility of accidentally plugging surface pumping equipment is eliminated, d) very large plugging devices 60 can be deployed, making it possible to plug very large openings in the well, e) plugging devices 60 can be distributed in a specific desired spacing or density within the wellbore 14, f) no special or additional surface equipment is needed beyond that required for standard plugging and perforating operations, and g) there is no possibility of presetting a plug.

Figure 43:
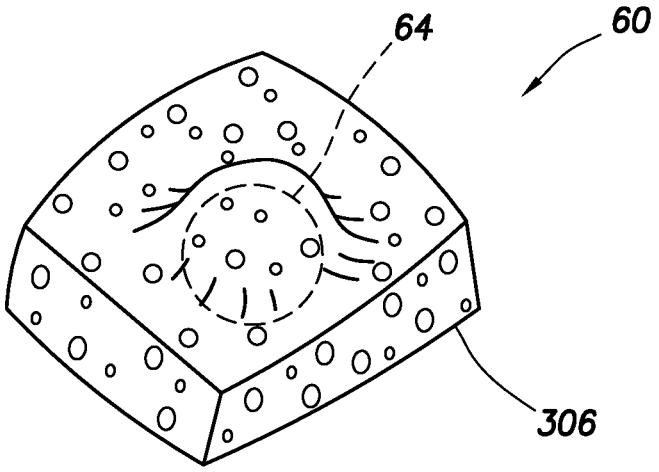
FIGS. 43 & 44 are representative views of additional plugging device embodiments having a relatively strong central member surrounded by a relatively low density material.
Figure 44:
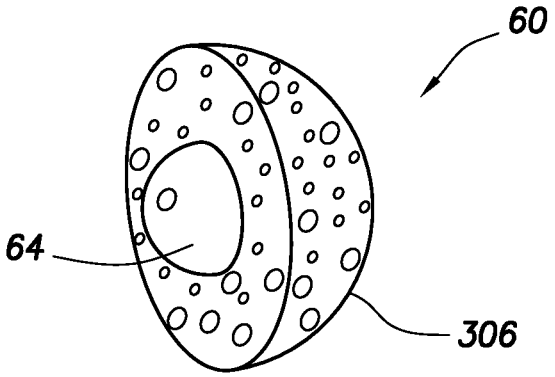

One use of the plugging devices 60 described herein is to block flow into or out of a perforation 46 during a fracturing operation. FIG. 43 depicts a plugging device 60 which is comprised of a central body 64 or member (such as a ball) which has enough strength to prevent extrusion through an opening 46 or 68 which is being blocked, and of an outer flexible, fluffy, or sponge-like material 306 which aids in directing the device 60 to a flow passage (such as perforation 46 or opening 68) and enhancing the ability of the device to seal an arbitrary shaped opening. FIG. 43 depicts a rectangular embodiment, and FIG. 44 depicts a spherical embodiment.

The central member or body 64 can be made of any degradable, self-degrading or non-degrading material (such as, any of the materials described herein) which has sufficient strength to prevent extrusion. The outer material 306 can comprise any suitable material (such as, open cell foam, fiber, fabric, sponge, etc.), whether degradable, self-degrading or non-degrading.

This device 60 can also be enclosed in a degradable retainer 80 or shell (such as, any of the retainers described herein), with or without a frangible coating 88 thereon. In one example, the device 60 can comprise a sponge-like, relatively low density outer material 306 compressed around a central, relatively high strength spherical body 64, until the retainer 80 dissolves, thereby allowing the foam-type or sponge-like material 306 to expand in a well.

Figure 45:
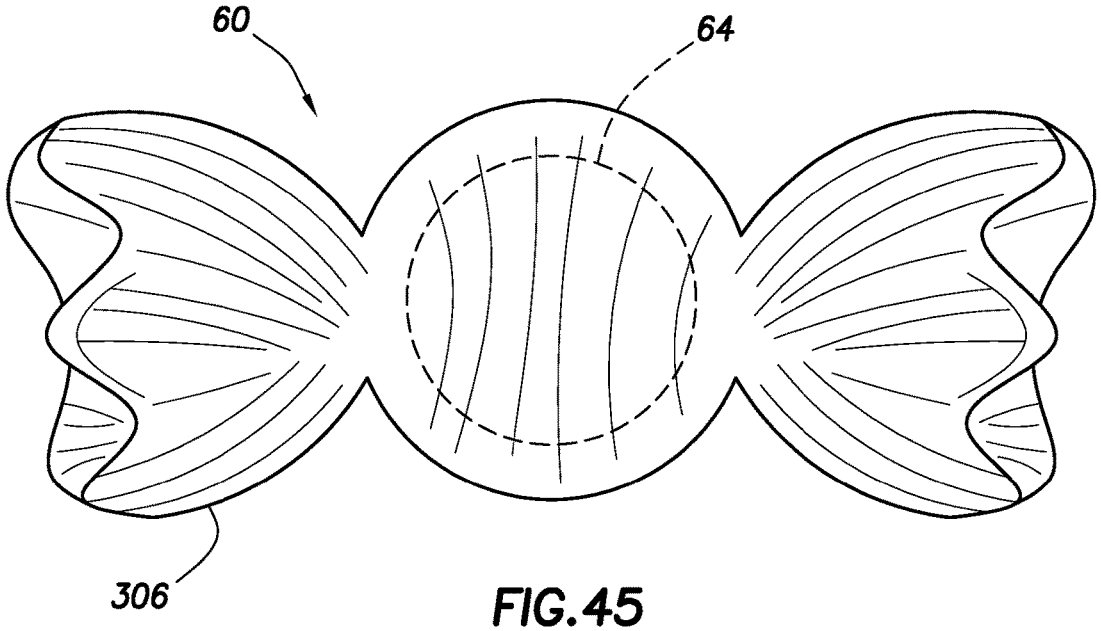
FIG. 45 is a representative view of another plugging device embodiment.

FIG. 45 depicts another embodiment in which a strong center member or body 64 is enclosed in a wrapper or bag of mesh, net, gauze or other fluffy or relatively low density outer material 306 that helps the device 60 find an opening 46, 68 through which fluid 74, 208 is flowing and assists in sealing the opening.

Figure 46:
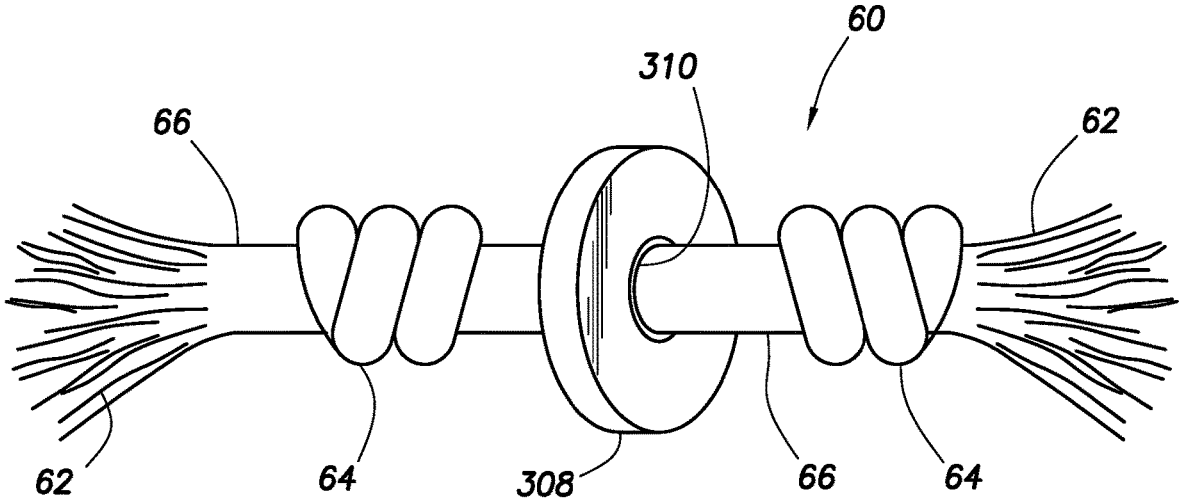
FIG. 46 is a representative view of yet another plugging device embodiment.

FIG. 46 depicts another embodiment of the device 60, which is comprised of a relatively strong disk-type or washer element 308 with a length of fibrous material (such as the line 66) extending through a hole 310 in the disk-type or washer element 308. Near one or more ends of the fibrous material line 66, a body 64 comprising a knot or other enlarged portion is present, which cannot pass through the hole 310 in the washer element 308.

The washer element 308 can comprise almost any shape or suitable material and the fibrous material line 66 can comprise any pliable or otherwise suitable material. In this example, the fibers 62 extending outwardly from each of the bodies 64 are very effective at "finding" an opening 46, 68 to be plugged and the body 64 "knots" are sized such that they can pass into or through the opening to be plugged.

One end of the knotted line 66 will follow flow and pass through the opening, causing the washer element 308 to be drawn up against the wall surrounding the opening 46, 68. The body 64 knot at the other end of the line 66 will plug the center hole 310 in the washer element 308 causing it to be tightly sealed by pressure against the wall surrounding the opening 46, 68.

The washer element 308 can be coated with elastomer or other suitable material to aid in sealing. Any or all portions of this device 60 can be made of degradable or self-degrading material, if desired. Any of these plugging devices 60 can be packaged as described above in a frangible outer shell, coating 88 and/or retainer 80.

Figure 47:
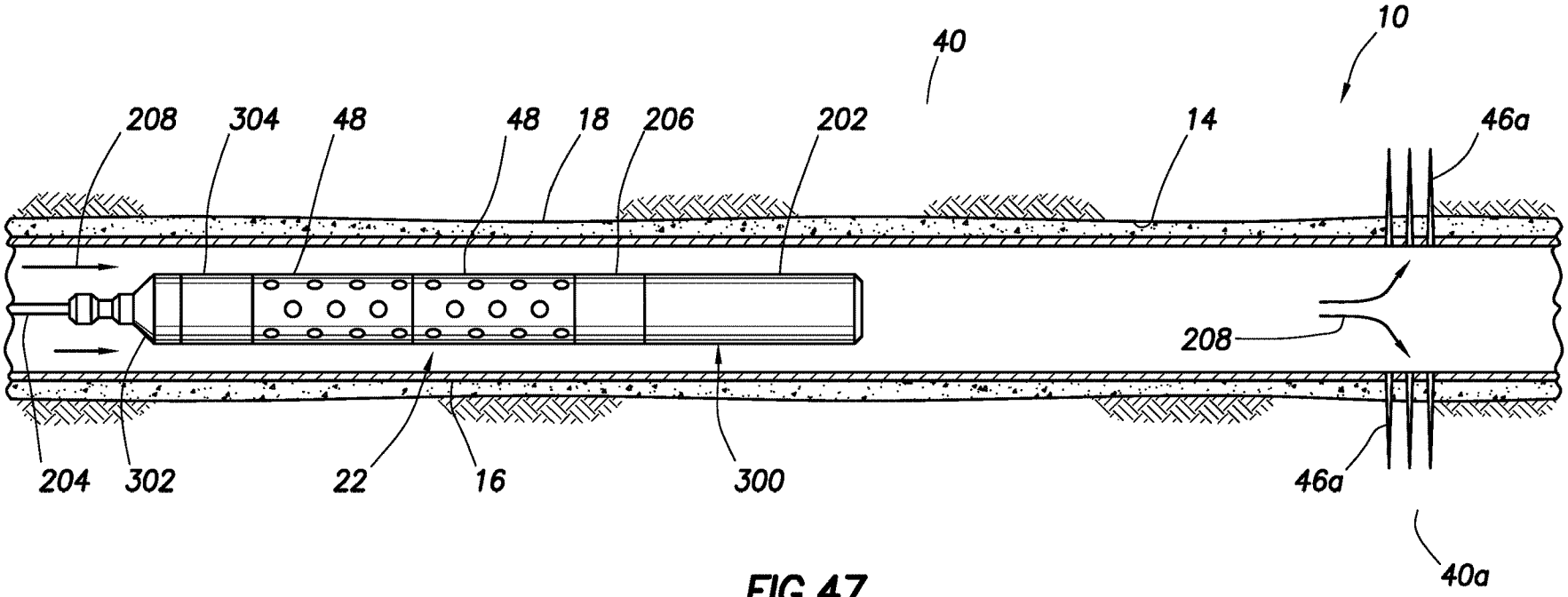
FIGS. 47-49 are representative partially cross-sectional views of another example of the system and method that can embody the principles of this disclosure.
Figure 48:
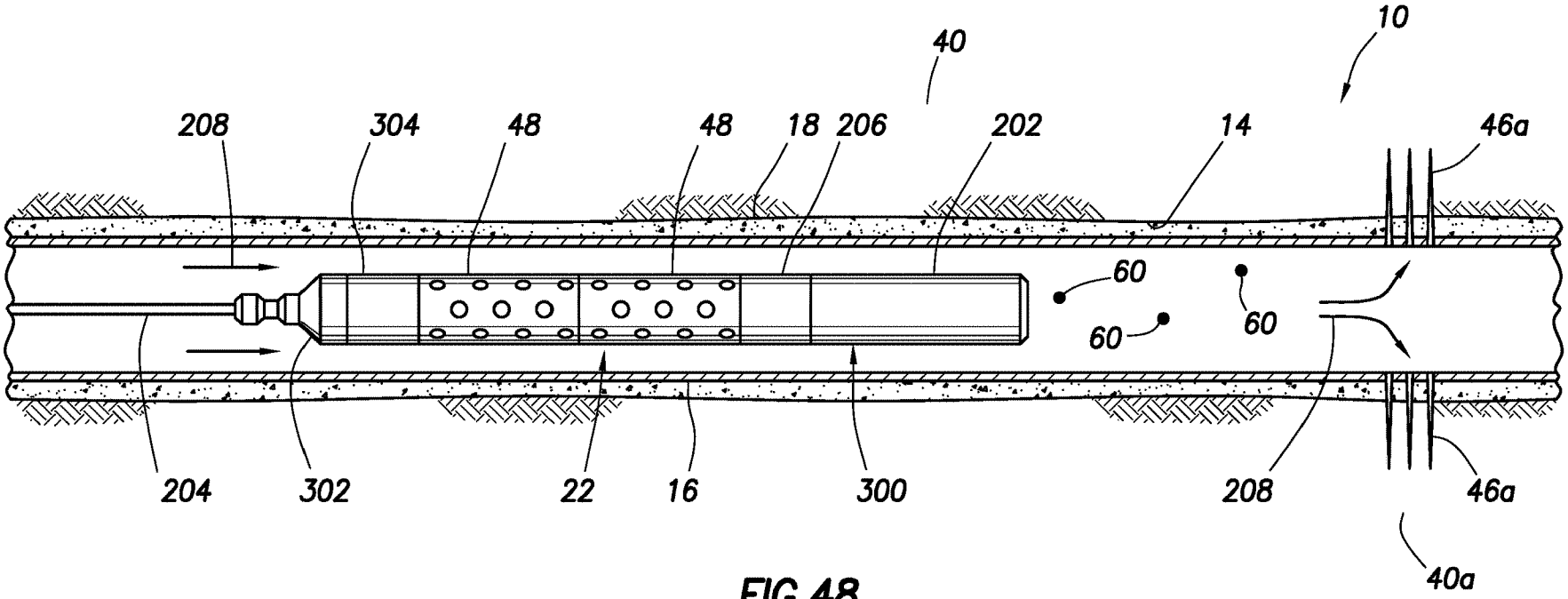
Figure 49:
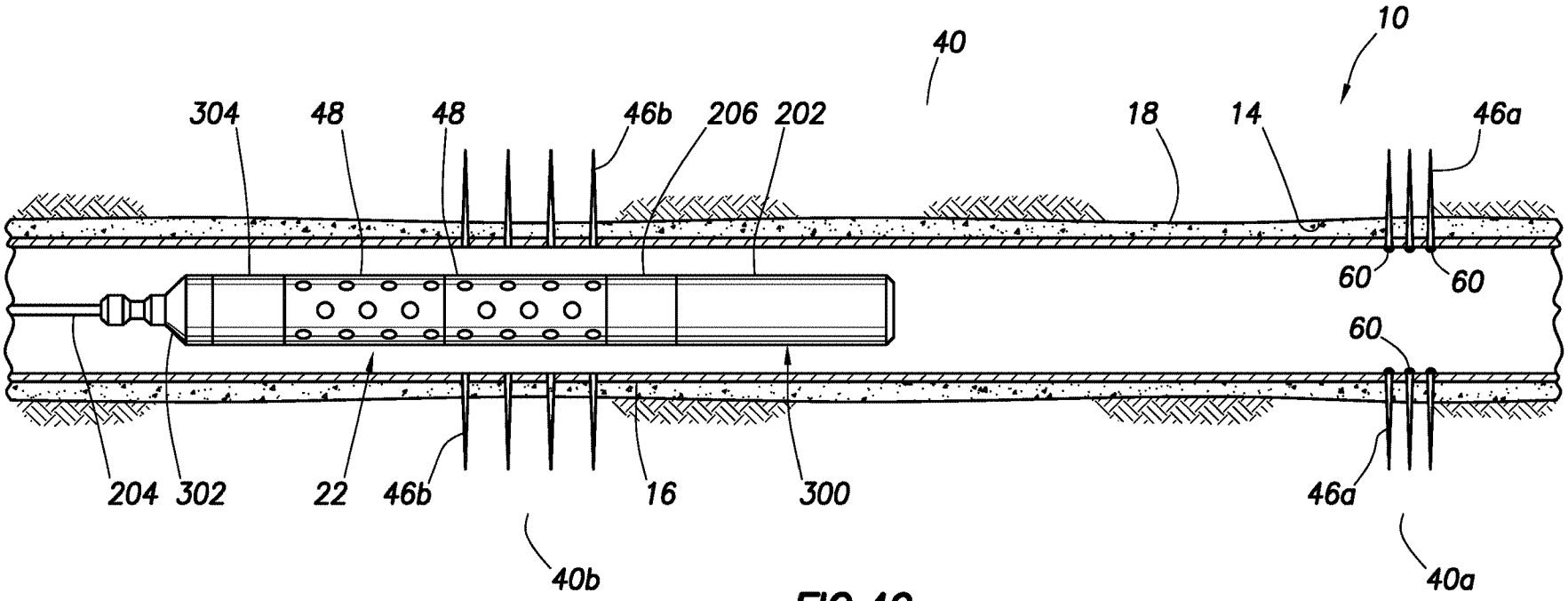

Referring additionally now to FIGS. 47-49, another example of the system 10 and method is representatively illustrated. In this example, multiple zones 40*a,b* are perforated, fractured and plugged (e.g., perforations 46*a,b* are plugged by plugging devices 60). Although only two zones 40*a,b* are depicted in FIGS. 47-49, any number of zones may be perforated, fractured and plugged in keeping with the principles of this disclosure, although a last zone perforated and fractured may not also be plugged.

In the FIGS. 47-49 example, the conveyance 204 may specifically comprise a wireline. A connector 302 is used to connect one or more perforators 48 to the wireline (conveyance 204). A firing head 304 may be provided, if desired, for controlling operation of the perforators 48.

Note that, in this example, the bottom hole assembly 22 remains in the wellbore 14 while one or more zones 40*a,b* are perforated and fractured.

The following steps may be included in the method:

1. Run wireline-conveyed perforating bottom hole assembly 22 (which is capable of perforating multiple zones 40*a,b* at respective different times) into the wellbore 14.
2. Perforate the zone 40*a*.
3. Move bottom hole assembly 22 in wellbore 14 (see step 3 alternatives below).
4. Fracture the zone 40*a* with fluid and/or proppant slurry.
5. Pump plugging devices 60 from surface to seal off perforations 46*a*
6. Move bottom hole assembly 22 to next zone 40*b*.
7. Repeat steps 2-6 until the desired number of zones is completed (although steps 5 & 6 may not be performed for the last zone).

Alternatives for step 3:

a. Move bottom hole assembly 22 up above new perforations (devices 60 will be pumped past perforating bottom hole assembly 22 during fracturing).
   b. Pull bottom hole assembly 22 up past a top of a liner 16 into a larger ID liner or casing, in order to reduce flow velocity around assembly 22 during fracturing (devices 60 will be pumped past perforating BHA 22 during fracturing).
   c. Lower/pump assembly 22 below new perforations (devices 60 will land on perforations 46*a* above perforating BHA 22).

The following steps may be included in another example of the method:

1. Run BHA 22 (which includes at least two individually operable perforators 48, or the ability to individually perforate separate zones) in wellbore 14. The BHA 22 may also include means (such as, dispenser tool 300) of releasing devices 60 at different times (e.g., two individually operable dispenser tools 300, or one tool which can be used to dispense devices 60 at least two separate times.)
2. Perforate a zone 40*a*.
3. Move assembly 22 in wellbore 14 (see alternatives for step 3 below).
4. Fracture the zone 40*a* with fluid and/or proppant slurry.
5. Release devices 60 to seal off perforations 46*a* when fluid 208 is pumped into the wellbore 14.
6. Move assembly 22 to next zone 40*b*.
7. Repeat steps 2-6 until the desired number of zones is completed (although steps 5 & 6 may not be performed for the last zone).

Alternatives for Step 3:

a. Move assembly 22 up above new perforations 46*a* (devices 60 will be released from a dispenser 300 above or below the perforators 48 of the BHA 22 during fracturing).
   b. Pull assembly 22 up past a top of a liner 16 and into a larger ID liner or casing, in order to reduce flow velocity around assembly 22 during fracturing (devices 60 will be released from a dispenser 300 above or below the perforators 48 of the BHA 22 during fracturing).
   c. Lower or pump assembly 22 below new perforations 46*a* (devices 60 will be released from a dispenser 300 above or below the perforators 48 of the BHA 22 during fracturing).

For the methods described above, measures may be taken to mitigate or prevent fracturing fluid from damaging the wireline 204 when it is positioned across open perforations during a fracturing operation. Such measures can include:

1. Use erosion resistant cable.
2. Use armored cable.
3. Centralize the cable in the wellbore 14 or casing 16 so it is not near the high velocity flow going into the perforations.
4. Use rubber coated cable.
5. Use cable designed to seal on perforations during fracturing operation.

6. Use hollow weight bars on the cable to protect the cable from fracturing fluid erosion.

It may now be fully appreciated that the above disclosure provides significant advancements to the art of controlling flow in subterranean wells. In some examples described above, the plugging device 60 may be used to block flow through openings in a well, with the device being uniquely configured so that its conveyance with the flow is enhanced and/or its sealing engagement with an opening is enhanced. A dispensing tool 300 can be used to deploy the devices 60 downhole, so that a desired location and spacing between the devices is achieved. Dispensing apparatus 90, 100 may be used at surface.

The above disclosure provides to the art a method of plugging an opening 46, 68 in a subterranean well. In one example, the method can comprise deploying a plugging device 60 into the well, the plugging device 60 including a body 64, and an outer material 306 enveloping the body 64 (e.g., completely surrounding the body 64 on all sides, as in the examples of FIGS. 43-45), the outer material 306 having a greater flexibility than a material of the body 64; and conveying the plugging device 60 by fluid flow 74, 208 into engagement with the opening 46, 68, the body 64 preventing the plugging device 60 from extruding through the opening 46, 68, and the outer material 306 blocking the fluid flow 74, 208 between the body 64 and the opening 46, 68.

The method may include forming the outer material 306 with a relatively low density material, or at least one of a foam material and a sponge material. The method may include forming the outer material with at least one of a wrapper, a bag, a fabric, a mesh material, a net material and a gauze material.

Another method of plugging an opening 46, 68 in a subterranean well is described above. In this example, the method comprises: deploying a plugging device 60 into the well, the plugging device 60 including at least two bodies 64, and a washer element 308 connected between the bodies 64, the washer element 308 being generally disk-shaped and comprising a hole 310, a line 66 extending through the hole 310 and connected to the bodies 64 on respective opposite sides of the washer element 308; and conveying the plugging device 60 by fluid flow 74, 208 into engagement with the opening 46, 68, the washer element 308 preventing the plugging device 60 from being conveyed through the opening 46, 68, and the washer element 308 blocking the fluid flow 74, 208 through the opening 46, 68.

The conveying step may include at least one of the bodies 64 being conveyed into the opening 46, 68. The conveying step may include at least one of the bodies 64 being conveyed through the opening 46, 68.

The line 66 may comprise joined together fibers 62. The line 66 may comprise a rope.

The method may include forming the bodies 64 as knots in the line 66. The method may include forming the bodies 64 with fibers 62 extending outwardly from the bodies 64.

A method of completing a well is also provided to the art by the above disclosure. In one example, the method can comprise: conveying a bottom hole assembly 22 into the well on a conveyance 204, the bottom hole assembly 22 comprising at least one perforator 48; forming perforations 46*a* in the well with the perforator 48; then displacing the bottom hole assembly 22 further into the well, thereby extending the conveyance 204 longitudinally across the first perforations 46*a*; and then flowing a stimulation fluid 208 into the first perforations 46*a*.

The conveyance 204 may extend longitudinally across the first perforations 46*a* during the stimulation fluid 208 flowing step. The conveyance 204 may comprise a wireline, and the wireline may extend longitudinally across the first perforations 46*a* during the stimulation fluid 208 flowing step.

The method may include plugging the first perforations 46*a*, displacing the bottom hole assembly 22 to a desired position in the well, forming second perforations 46*b* at the desired position, and flowing the stimulation fluid 208 into the second perforations 46*b*.

The plugging step and the second perforations 46*b* forming step may be performed without withdrawing the bottom hole assembly 22 from the well. These steps can be performed in a single trip of the bottom hole assembly 22 into the wellbore 14.

The first perforations 46*a* forming step, the second perforations 46*b* forming step, the stimulation fluid 208 flowing into the first perforations 46*a* step and the stimulation fluid 208 flowing into the second perforations 46*b* step may be performed without withdrawing the bottom hole assembly 22 from the well. These steps can be performed in a single trip of the bottom hole assembly 22 into the wellbore 14.

Another method of completing a well is described above. In this example, the method comprises: perforating a first zone 40*a* with a perforator 48 of a bottom hole assembly 22 in the well; fracturing the first zone 40*a*; perforating a second zone 40*b*; and fracturing the second zone 40*b*. The first zone 40*a* perforating step, the first zone 40*a* fracturing step, the second zone 40*b* perforating step and the second zone 40*b* fracturing step can be performed without withdrawing the bottom hole assembly 22 from the well. These steps can be performed in a single trip of the bottom hole assembly 22 into the wellbore 14.

At least one of the first zone 40*a* fracturing step and the second zone 40*b* fracturing step may be performed while the bottom hole assembly 22 is positioned in the well.

The method may comprise conveying the bottom hole assembly 22 into the well with a conveyance 204. The conveyance 204 may extend longitudinally across the first zone 40*a* after the first zone 40*a* perforating step and during the second zone 40*b* fracturing step. The conveyance 204 may comprise a wireline.

The conveying step may include displacing the bottom hole assembly 22 by fluid flow 74, 208 through the well.

The method may include displacing the bottom hole assembly 22 to an increased diameter section of the well prior to the first zone 40*a* fracturing.

The method may include, after the first zone 40*a* perforating step, displacing the bottom hole assembly 22 to a position downhole from the first zone 40*a*, and the bottom hole assembly 22 remaining at the position during the first zone 40*a* fracturing step.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method of completing a well, the method comprising:

conveying a bottom hole assembly into the well on a conveyance, the bottom hole assembly comprising at least one perforator;

forming first perforations in the well with the perforator;

then displacing the bottom hole assembly further into the well, thereby extending the conveyance longitudinally across the first perforations;

then flowing a stimulation fluid into the first perforations;

plugging the first perforations;

then displacing the bottom hole assembly to a desired position in the well;

then forming second perforations at the desired position; and flowing the stimulation fluid into the second perforations without positioning a packer between the first and second perforations.

2. The method of claim 1, wherein the conveyance extends longitudinally across the first perforations during the stimulation fluid flowing.

3. The method of claim 1, wherein the conveyance comprises a wireline, and wherein the wireline extends longitudinally across the first perforations during the stimulation fluid flowing.

4. The method of claim 1, wherein the plugging and the second perforations forming are performed without withdrawing the bottom hole assembly from the well.

5. The method of claim 1, wherein the first perforations forming, the second perforations forming, the stimulation fluid flowing into the first perforations and the stimulation fluid flowing into the second perforations are performed without withdrawing the bottom hole assembly from the well.

* * * * *